US009056689B2

(12) United States Patent
Rasmussen et al.

(10) Patent No.: US 9,056,689 B2
(45) Date of Patent: Jun. 16, 2015

(54) METHOD FOR ADSORBING PROPELLENT GAS FOR A BEER DISPENSING SYSTEM

(75) Inventors: Jan Norager Rasmussen, Olstykke (DK); Steen Vesborg, Gentofte (DK)

(73) Assignee: CARLSBERG BREWERIES A/S, Copenhagen V (DK)

( * ) Notice: Subject to any disclaimer, the term of this patent is extended or adjusted under 35 U.S.C. 154(b) by 239 days.

(21) Appl. No.: 13/703,332

(22) PCT Filed: Jun. 16, 2011

(86) PCT No.: PCT/EP2011/060011

§ 371 (c)(1),
(2), (4) Date: Dec. 10, 2012

(87) PCT Pub. No.: WO2011/157786

PCT Pub. Date: Dec. 22, 2011

(65) Prior Publication Data

US 2013/0074978 A1 Mar. 28, 2013

(30) Foreign Application Priority Data

| | | |
|---|---|---|
| Jun. 17, 2010 | (EP) | 10166356 |
| Jun. 17, 2010 | (EP) | 10166360 |
| Jun. 17, 2010 | (EP) | 10166363 |
| Jun. 17, 2010 | (EP) | 10166368 |
| Jun. 17, 2010 | (EP) | 10166370 |
| Oct. 20, 2010 | (EP) | 10188263 |
| Mar. 18, 2011 | (EP) | 11158862 |

(51) Int. Cl.
*B65B 1/00* (2006.01)
*B67D 1/04* (2006.01)

(52) U.S. Cl.
CPC ..... *B65B 1/00* (2013.01); *B67D 1/0443* (2013.01)

(58) Field of Classification Search
CPC ..... C10J 2300/0969; A23L 2/54; B01D 15/00
USPC ..... 141/3, 20; 53/403, 428, 432, 474; 426/426, 474, 477
See application file for complete search history.

(56) References Cited

U.S. PATENT DOCUMENTS 3,992,493 A * 11/1976 Whyte et al. ..... 261/121.1
4,460,612 A * 7/1984 Saleeb et al. ..... 426/477

(Continued)

FOREIGN PATENT DOCUMENTS

EP 1139006 10/2001
EP 1306605 5/2003

OTHER PUBLICATIONS

Najibi et al.; "Methane/Natural Gas Storage and Delivered Capacity for Activated Carbons in Dry and Wet Conditions"; Fuel, IPC Science and Technology Press, Guildford, GB; vol. 87, No. 1, pp. 7-13; Nov. 14, 2007.

(Continued)

*Primary Examiner* — Jason K Niesz
*Assistant Examiner* — Andrew Schmid
(74) *Attorney, Agent, or Firm* — Klein, O'Neill & Singh, LLP

(57) ABSTRACT

A method of filling a canister containing activated carbon having a first temperature with a propellant gas, wherein the method includes (a) providing a volume of liquefied propellant gas at a second temperature and a first elevated pressure that prevents it from evaporating; (b) evacuating the canister to create a vacuum within the canister, thereby cooling the activated carbon to a third temperature lower than the second temperature; (c) injecting the volume of liquefied propellant gas into the canister at a second elevated pressure that prevents it from evaporating; and (d) allowing the liquefied propellant gas to evaporate, consuming energy as evaporation heat, the energy being generated due to the propellant gas being adsorbed by the activated carbon, thereby reducing the heating of the activated carbon.

14 Claims, 33 Drawing Sheets

(56) References Cited

U.S. PATENT DOCUMENTS

| | | | | |
|---|---|---|---|---|
| 5,522,228 | A * | 6/1996 | Guillot et al. | 62/101 |
| 5,620,725 | A * | 4/1997 | Jamieson et al. | 426/112 |
| 6,360,923 | B1 * | 3/2002 | Vlooswijk | 222/399 |
| 6,745,922 | B1 * | 6/2004 | Vlooswijk et al. | 222/399 |
| 8,066,156 | B2 * | 11/2011 | Schiff et al. | 222/396 |
| 2008/0185067 | A1 * | 8/2008 | Lim et al. | 141/3 |
| 2012/0043352 | A1 * | 2/2012 | Rasmussen et al. | 222/386.5 |
| 2012/0058230 | A1 * | 3/2012 | Rasmussen et al. | 426/115 |
| 2013/0074978 | A1 * | 3/2013 | Rasmussen et al. | 141/2 |
| 2013/0133761 | A1 * | 5/2013 | Cull et al. | 137/528 |
| 2014/0027453 | A1 * | 1/2014 | Landman | 220/203.01 |

OTHER PUBLICATIONS

International Search Report on related PCT application (PCT/EP2011/060011); International Searching Authority (EPO) dated Sep. 20, 2011.

* cited by examiner

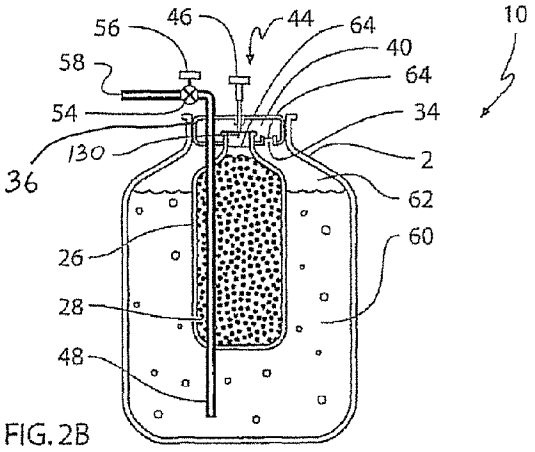
FIG. 2B
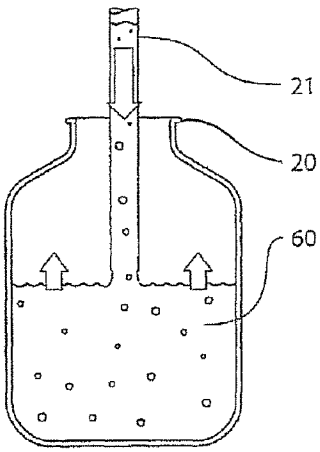
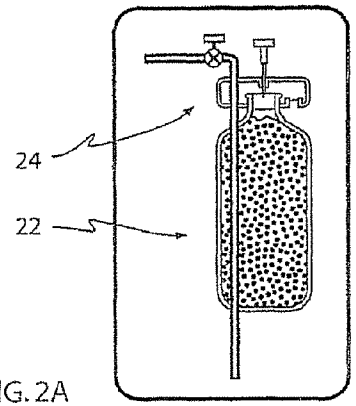
FIG. 2A
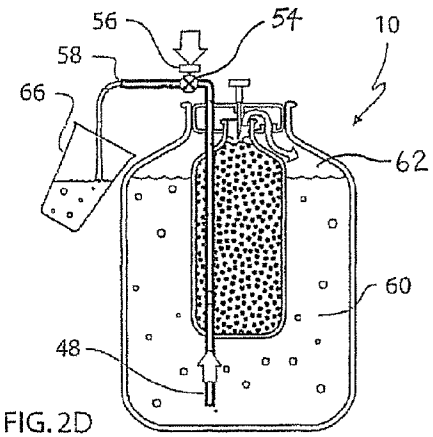
FIG. 2D
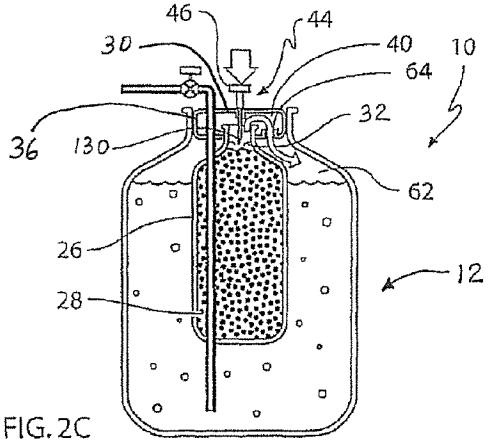
FIG. 2C

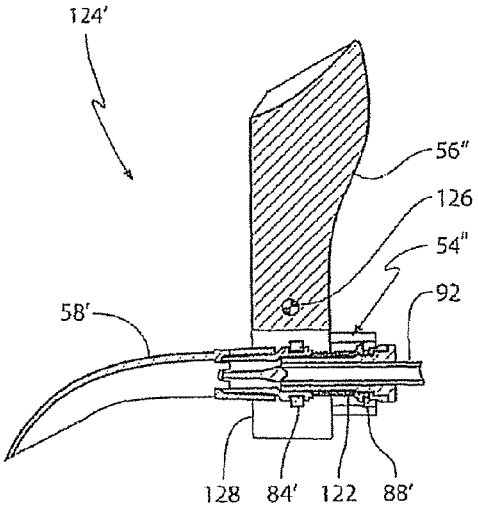
FIG. 9A1
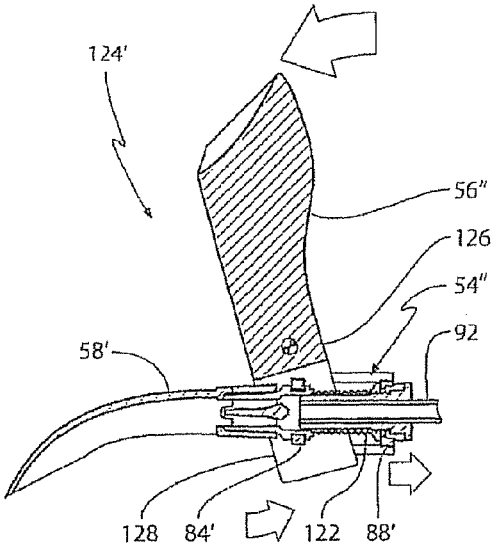
FIG. 9A2
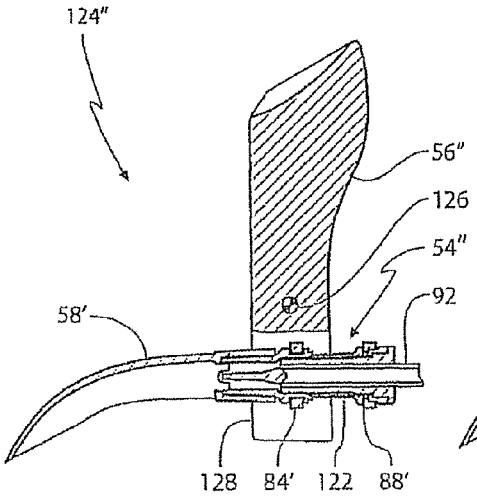
FIG. 9B1
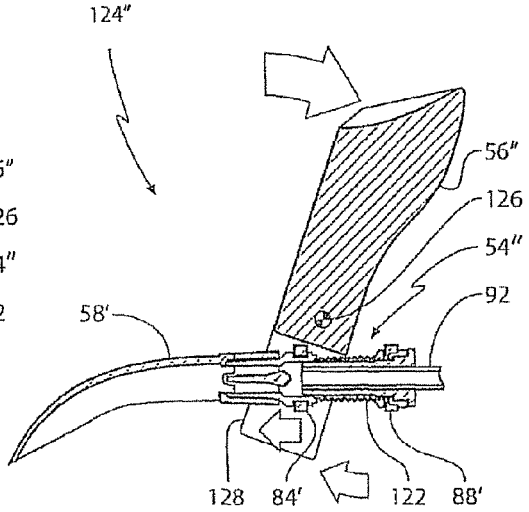
FIG. 9B2

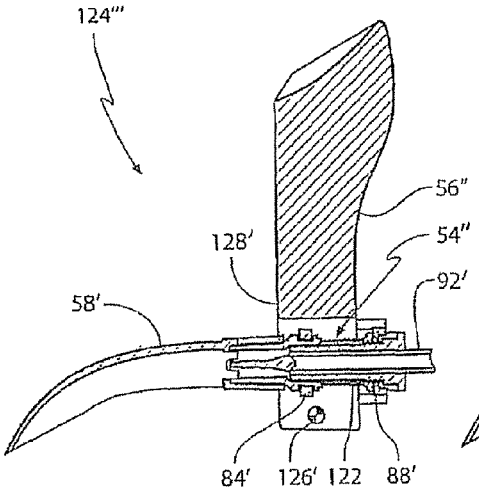
FIG. 9C1
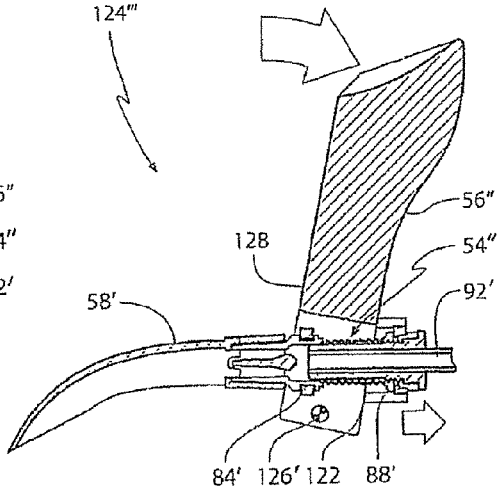
FIG. 9C2
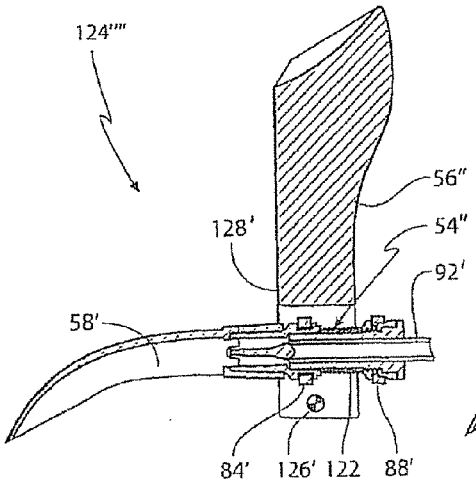
FIG. 9D1
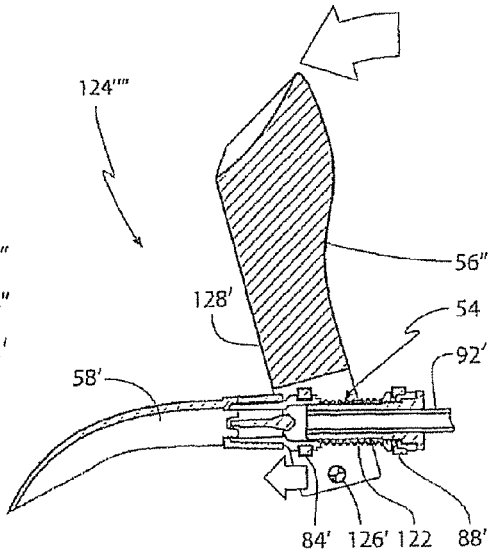
FIG. 9D2

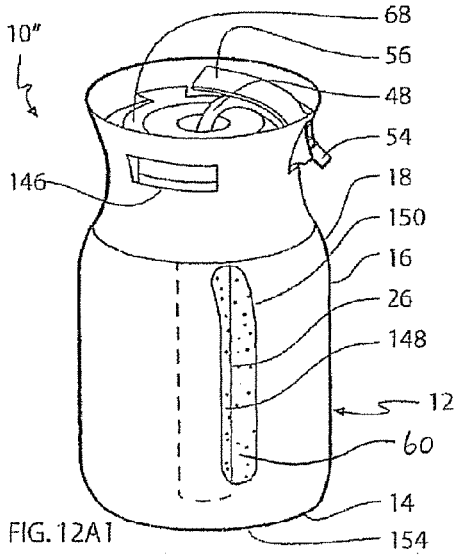
FIG. 12A1
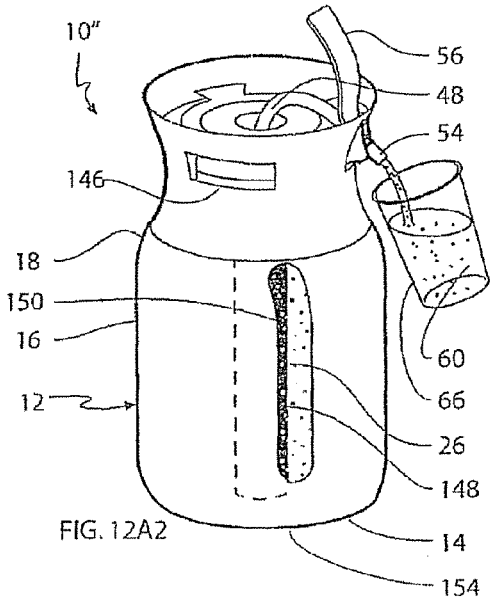
FIG. 12A2
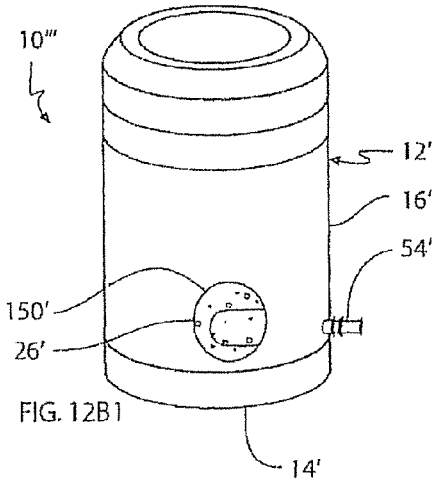
FIG. 12B1
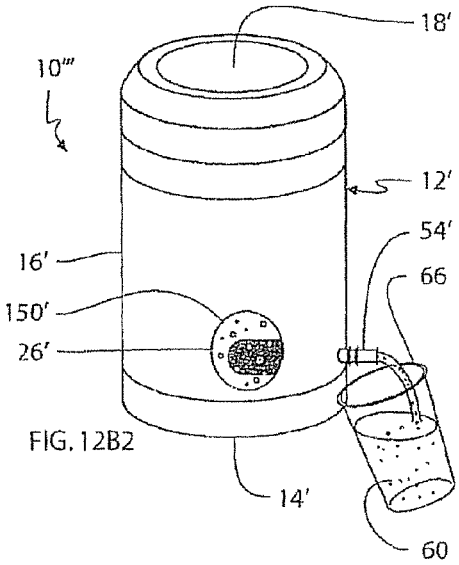
FIG. 12B2

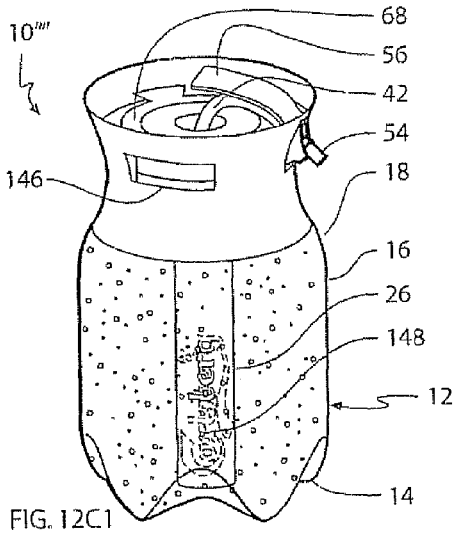
FIG. 12C1
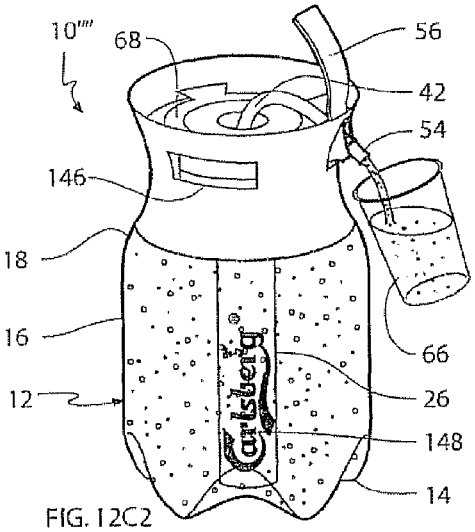
FIG. 12C2
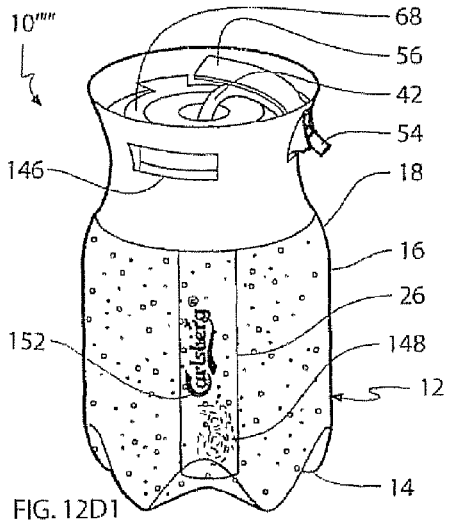
FIG. 12D1
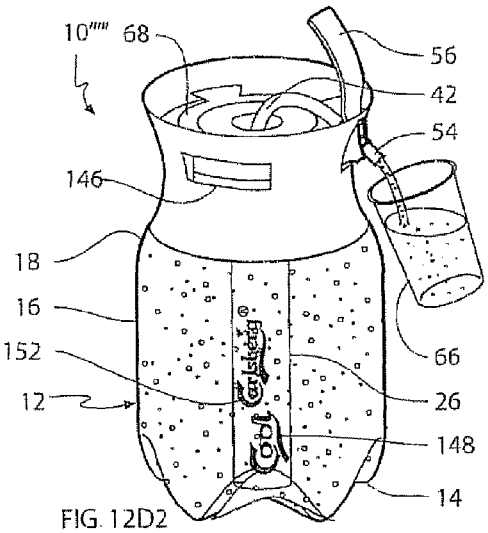
FIG. 12D2

METHOD FOR ADSORBING PROPELLENT GAS FOR A BEER DISPENSING SYSTEM

CROSS-REFERENCE TO RELATED APPLICATION

This application is a national phase filing, under 35 U.S.C. §371(c), of International Application No. PCT/EP2011/060011, filed Jun. 16, 2011, the disclosure of which is incorporated herein by reference in its entirety.

FEDERALLY SPONSORED RESEARCH OR DEVELOPMENT

Not Applicable

BACKGROUND

The present invention relates to a beverage dispensing system and a method of dispensing beverage.

INTRODUCTION

Carbonated beverages, such as beer and soft drinks, are typically provided under elevated pressure in pressure-proof containers such as cans or kegs. Once the keg or can has been opened, the pressure reduction in the container will cause the carbon dioxide dissolved in the beverage to escape. After some time, such as a few hours, the escape of carbon dioxide ($CO_2$) will cause the beverage to become unsuitable for drinking for the beverage consumer, since it will assume a flat and less flavoured taste. For non-professional users, such as households and similar private users, carbonated beverages are typically provided in small containers such as bottles or cans which are suitable for a single serving of beverage and have a volume around 0.25-1.5 liters. The consumer is expected to finish the can or bottle within a few hours and preferably less, since when the beverage container has been opened $CO_2$ will start escaping the beverage. Additionally, oxygen will enter the beverage. The oxygen entering the beverage container causes the beverage to deteriorate and will decrease the storage time of the beverage inside the opened beverage container. Typically, the quality of the beverage and the intensity of carbonisation will have reached unacceptably low levels within a few hours or at most a few days depending on external conditions after opening the beverage container and the possibility of re-sealing the beverage container.

Professional users such as bars and restaurants and similar establishments having a large turnover of carbonated beverages may use a beverage dispensing system intended for multiple servings of beverage instead of individual bottles and cans. Professional beverage dispensing systems typically use large beverage containers, such as kegs, which are connected to a carbon dioxide source for carbonating the beverage and for maintaining a pressure inside the beverage container while dispensing the beverage through a tapping device. Thus, the level of carbon dioxide in the beverage may be held constant while at the same time oxygen is prevented from entering the container. Thus, a beverage inside a beverage container connected to a beverage dispensing system may be kept in suitable drinking condition for weeks since the beverage dispensing system is effectively compensating for the loss of carbon dioxide from the beverage, substituting the dispensed beverage volume for maintaining an elevated pressure inside the beverage container as well as keeping the drink free from oxygen, which would otherwise deteriorate the flavour of the beverage. Beverage dispensing systems may also include a cooling device for keeping the beverage at suitable drinking and storage temperature and are typically reusable, i.e. when a beverage keg is empty, the beverage dispensing system may be opened and a new full beverage keg may be installed.

Professional beverage dispensing systems typically operate with large containers or kegs, which may contain 10-50 liters or more of beverage. Smaller and portable beverage dispensing systems for private or professional use may typically contain 5-10 liters of beverage. One example of a beverage dispensing system is the DraughtMaster™ system provided by the applicant company and described in the PCT applications WO2007/019848, WO2007/019849, WO2007/019850, WO2007/019851 and WO2007/019853. The DraughtMaster™ system seals the beverage container from the surrounding oxygen and provides pressurisation and cooling to avoid loss of carbon dioxide and deterioration of the beverage.

Some consumers prefer to use a so-called mini-keg or party-keg when providing beverage at minor social events, such as private parties, family events and conferences etc. Mini-kegs may also be used in professional beverage dispensing establishments, such as for smaller professional establishments, establishments lacking access to pressurisation sources and establishments where highly pressurised containers may be unsuitable, such as in airplanes and other means of transportation A mini-keg is a cheap and single-use beverage dispensing system for providing a larger amount of beverage than allowed in a can while not requiring the consumer to invest in a reusable beverage dispensing system. The mini-keg allows multiple beverage servings without loss of carbonisation or flavour even if some time is allowed to pass between the servings. It also gives the user the option of choosing the amount of beverage for each serving. Typically, state of the art mini-kegs constitute single use beverage dispensing systems and include a tapping device for dispensing the beverage and a carbon dioxide canister for keeping the beverage in the mini-keg in a suitable drinking condition over an extended time period such as several days or weeks, even if the mini-keg has been opened. For avoiding loss of carbonisation and flavour, mini-kegs include a carbonisation canister for keeping a pressurised carbon dioxide atmosphere inside the keg and compensate for pressure loss due to beverage dispensing. Such mini-kegs typically having a volume ranging between the professional kegs and the single-use cans, such as 2-15 liters or 3-10 liters and in particular 5 liters. Furthermore, mini-kegs are known in which no carbon dioxide regulation is included.

SUMMARY

There is thus a need for a cheap and simple solution for pressurising a beverage container. Some examples of self-pressurising beverage containers are found in European patent publications EP 1 737 759 and EP 1 170 247. Both the above known technologies make use of commercially available $CO_2$ canisters containing pressurised $CO_2$ (carbon dioxide) and a pressure regulation mechanism. The $CO_2$ canisters release $CO_2$ via the pressure regulator, which is used for pressurising the beverage and the beverage container as the pressure is reduced due to the dispensing of the beverage as well as due to leakage during storage of the beverage container in-between servings. The canister will occupy space, which cannot be used for beverage. Therefore, the canister should preferably be small in relation to the volume of the beverage container. To be able to generate a suitable amount of $CO_2$ from a small canister to pressurise a significantly larger beverage container the canister must have a high pressure. The above-mentioned publications EP 1 737 759 and EP 1 170 247 suggest the use of a filler material such as activated carbon for reducing the pressure inside the canister. In the present context, reference is made to the previously filed international applications WO 2010/119056 and WO 2010/119054 which relate to a pressure maintaining beverage dispenser.

The above-mentioned technologies have some drawbacks. The high pressure in the canisters of the above-mentioned technologies may constitute a safety hazard due to the risk of explosion, especially in case the canister is heated. The above technologies further include a mechanical pressure-reducing regulator, which may jam or break. The $CO_2$ canister and the pressure regulator must typically be made of metal to withstand the high pressures. Some mini-kegs may therefore be made entirely out of metal or a combination of metal and plastic. While many plastic materials may be disposed of in an environment-friendly manner by combustion, metal should be recycled in order to be considered an environment-friendly material. However, in many cases the above metal mini-kegs are not suitable for recycling since they differ from normal recyclable metal cans and kegs since they may contain a multitude of different plastic materials, which may not be separable and recyclable or disposed of in an environment-friendly manner. There is thus a risk that such mini-kegs will not be properly recycled.

Most beverage containers and kegs are provided in the form of cylindrical drums. The cylindrical shape is preferred since it will allow a stable positioning. Cylindrical bodies further provide a large inner volume in relation to the outer surface, thus allowing less material to be used. It is well known that the optimal dimensions for maximizing the volume while minimizing the outer surface is achieved when the diameter of the container is about the same as the height of the container. Further, the mouth of the beverage container should be kept as small as possible for reducing the leakage from the beverage container. Typical beverage containers therefore have a height roughly corresponding to the diameter and a small mouth opening. Such containers have been produced for years and a change of the dimensions will, in addition to resulting in a less than optimal container, require costly modifications to the production line. The above restrictions in relation to the length of the container and the diameter of the mouth constitute technical restrictions of the permissible dimensions of the $CO_2$ canister. The canister is filled by fine active carbon granulates in order to reduce the pressure inside the canister. Active carbon granulates constitute a non-compressible but substantially flowable material. The problem thereby is that the length and the opening of the canister which must be defined by the beverage container mostly is not sufficient for allowing a sufficient amount of $CO_2$ to be stored in the $CO_2$ canister. It is therefore an object of the present invention to provide technologies for allowing $CO_2$ canisters of greater volume to be inserted into the above mentioned optimized beverage containers.

Mini-kegs presently on the market have separate tapping devices and pressure generating devices often requiring two separate openings in the beverage container for being able to operate the pressurization device separately from the dispensing device. Apart from increasing the leakage, the provision of two openings in the beverage container often requires a custom made container which is expensive. Further, conventional blow moulding techniques cannot be used since blow moulded containers typically only have a single outlet. Other mini-kegs, such as one of the prior art documents described herein, use a single opening, however, the pressure generating device is fixated to the dispensing device. This has the drawback that the complete length of the beverage container cannot be used for the pressure generating device. It is therefore an object of the present invention to provide a combined pressurization and dispensing device requiring a single opening in the container only.

A problem often associated with beverage dispensing after the tapping handle has been returned to the non beverage dispensing position is dripping of the tapping spout. Dripping occurs since some beverage is trapped within the tapping spout after the valve connected to the tapping handle has been closed. The beverage cannot escape immediately since air cannot get into the beverage spout to substitute the trapped beverage. Further, the applicant has found out that gravity pull alone may not be sufficient to clear the tapping spout even when using a ventilated tapping spout, since some beverage tend to stick to the inner surface of the spout due to surface tension. However, the trapped or stuck beverage may be released, or drip, at some time after the user has returned the tapping handle to the non-beverage dispensing position. In case the user has already removed his beverage glass, the dripping will result in a spillage. Reusable and permanent beverage dispensing systems are mostly provided with a drip tray for collecting such spillage located below the tapping spout and the loss of the user will be limited to the relative small volume of beverage falling into the drip tray. However, concerning single use mini-kegs it would be very cumbersome to provide a drip tray and most often none is provided. Beverage dispensing without a drip tray will inevitably cause spillage which will soil the underlying surface of the beverage dispensing system. Users may then resort to ad-hoc solutions such as providing towels or homemade drip trays. However, the above problem does negatively affect the beverage dispensing experience. Further, beverage remaining in the tapping spout may deteriorate and bacterial growth in the spout may result. Further, residual beverage in the spout may dry and result in clogging of the spout. The problem of avoiding build-up of biological material on surfaces has been studied in the publication "Mechanical factors favoring release from fouling release coatings", by R. F. Brady and I. L. Singer, published in "Biofouling", Volume 15, Issue 1-3, 2000, pages 73-81, of 1 Jan. 2000, where it was found that elastic modulus and coating thickness is important in relation to the release of biofoulants. However, this publication only concerns the marine coating industry. It is thus an object of the present invention to provide technologies for drip-free dispensing using a beverage dispensing system.

Filling of canisters including activated carbon with pressurized $CO_2$ causes the activated carbon to increase in temperature due to an exothermal process in relation to the adsorption of gas in the activated carbon. In case the filling is performed by high pressure and quickly the activated carbon is not allowed to cool and the temperature of the activated carbon will become very high. A high temperature of the activated carbon may cause desorption of the $CO_2$ and even thermal destruction of both the canister and the activated carbon. The applicant has found out that quick filling of canisters using a pressure of 5 bar or more of $CO_2$ will not be possible due to the above-mentioned problem. It is therefore an object of the present invention to provide technologies for filling of canisters including activated carbon with pressurized $CO_2$ to a pressure above 5 bar without suffering from the above-mentioned temperature dependent drawbacks.

Mini-kegs do normally not provide for internal cooling and must consequently be cooled down to a suitable serving temperature by resting in a cold storage room or refrigerator for a specific time period. The time period needed for the cooling of the beverage may vary significantly depending on the properties of the container, beverage, cold storage room or refrigerator. Similarly, when the cold mini-keg has been removed from the cold storage and placed in the beverage dispensing establishment being at ambient temperature, the beverage will heat up depending on the ambient temperature of the beverage dispensing establishment. The heating may be accelerated when the mini-keg is exposed to sunshine or the like. It can therefore be difficult for the user to determine the temperature of the beverage of a particular mini-keg at a specific time without tapping some beverage. It is therefore an object of the present invention to provide technologies for visually determining from the outside the temperature of a beverage inside a container of a beverage dispensing system constituting a mini-keg.

After the canister has been filled by $CO_2$ the canister should be at least temporarily sealed in order to transport it to a beverage filling station in which the canister is places inside a beverage container together with the beverage to be dispensed. It is generally known that in many cases it may be more beneficial to modify an existing product than to develop an entirely new product. A canister of about 0.5 liters volume would be suitable for pressurizing a beverage container of about 5 liters. In the present technical field it is known to provide moulded PET beverage containers having a volume corresponding to the volume of such canisters, i.e. about 0.5 liters. Since such known beverage containers are produced in very large numbers, it would be very suitable to use such containers as canisters in a mini keg system. Such known beverage containers are further provided with a standardized moulded lid or bottle cap. Such lid or cap is e.g. disclosed in U.S. Pat. No. 4,476,987, which document is hereby incorporated by reference.

A further object of the present invention is therefore to provide technologies allowing a known beverage container to be used in a mini-keg system as described above. In particular, it is an object of the present invention to provide methods and systems for filling, capping, activating and using a canister constituting a container of moulded PET.

SUMMARY OF THE INVENTION

The above need and the above object together with numerous other needs and objects, which will be evident from the below detailed description, are according to a first aspect of the present invention obtained by a spout for use in a beverage dispensing system, the spout defining an inlet for receiving beverage, preferably being a carbonated beverage, and an outlet for releasing the beverage, the outlet being located below the inlet when the spout is attached to the beverage dispensing system, the spout comprising one or more capillary flow passages extending between the inlet and the outlet, each of the one or more capillary flow passages define:

- a monotonically decreasing flow area from the inlet to the outlet, and
- a ventilation opening for allowing air to flow from the outside into the capillary flow passage.

The beverage dispensing system is preferably for single use and of the mini-keg type, however, the spout may also be used together with a reusable beverage dispensing system such as a professional beverage dispensing system. The inlet receives beverage from a beverage container of the beverage dispensing system typically via a dispensing line and a dispensing valve allowing user selective dispensing. The outlet should be located below the inlet such that a stream of beverage entering the inlet will remain within the spout and will be drawn from the inlet towards the outlet by gravity pull. The statement that the outlet should be located below the inlet refers to the spout when mounted on a beverage dispensing system and the beverage dispensing system being positioned on a substantially flat surface in its normal, non-inverted orientation.

The capillary flow passages should have a width small enough for a capillary force or capillary action to be present. Capillary action is understood to be a self suction capability inherent to small passages. It is well known in the art that the capillary force is reverse proportional to the radius of the capillary flow passage. Although the capillary action is greatest in tiny passages, e.g. passages of only a few microns, the capillary action is still noticeable in passages of up to a few cm for aqueous substances. The capillary flow passages should further be monotonically decreasing. In this way the capillary force will increase from the inlet to the outlet. The flow area of the capillary flow passage will thus vary between the inlet and the outlet. It is contemplated that the minimum flow area near the outlet will determine the time needed for dispensing a drink, and therefore the dispensing time may be decreased by either making the minimum flow area larger or adding further flow passages.

The applicant has surprisingly found out that in the present context the capillary flow passages will provide the additional downwardly force in addition to the gravity pull for completely clearing the spout immediately after the dispensing valve has been closed and the beverage dispensing has been interrupted. The maximum flow area which may be allowed near the inlet should still permits a sufficiently high capillary force for preventing any beverage to remain in the spout. In particular, the flow passage should have a flow area smaller than the circumference of a typical drop of the beverage. In this way a drop of beverage cannot be accommodated inside the spout without being subjected to a significant capillary force.

In addition to the above, the spout includes a ventilation opening for allowing air to flow into the capillary flow passages. At the moment when beverage dispensing is interrupted, air is required to substitute the beverage stream which is located within the spout. The opening is preferably located near the inlet of the spout in order to evacuate the beverage in the whole spout. Unless the spout is ventilated, the suction effect will prevent any beverage from leaving the spout immediately. However, the beverage may leave the spout later due to leakage. The ventilation opening may be separate for each capillary flow passage or a common opening for all capillaries.

According to a further embodiment of the spout, the one or more capillary flow passages constitute at least one central capillary flow passage and at least one peripheral capillary flow passage outside of the central capillary flow passage. The provision of at least two capillary flow passages is preferred since the dispensing time will be reduced to substantially 50% of the time needed when a single capillary flow passage is used. By orienting the flow passages as defined above, i.e. substantially coaxial, the beverage will be substantially uniformly distributed between the flow passages.

According to a further embodiment of the spout, the central capillary flow passage exhibits a smaller flow area than the peripheral capillary flow passage at any given distance between the inlet and the outlet and thereby provides a substantially flat or planar flow profile. A flat flow profile is preferred since the amount of turbulence is significantly reduced. High amounts of turbulence should be avoided since it may cause some beverage to form small droplets which may remain inside the capillary flow passage. As the beverage entering from e.g. a dispensing line will typically have a parabolic flow profile, the velocity of the central part of the flow should be reduced and the peripheral flow passage should be increased. This is performed by reducing the flow area of the central flow passage and increasing the flow areas of the peripheral flow passage for decreasing and increasing the flow resistance, respectively. It is contemplated that further flow passages may be added in the same coaxial manner having an increasing flow area from the center towards the periphery.

According to a further embodiment of the spout, each capillary flow passage is established between two longitudinal wall parts extending between the inlet and the outlet and a transversal wall part extending between the two longitudinal wall parts. In this way a channel constituting the capillary flow passage is achieved.

According to a further embodiment of the spout, each of the one or more flow passage define a maximum distance between the first and second longitudinal walls of 1 to 5 mm, such as a maximum distance of 3 mm. The distance between the walls of the capillary flow passage should be less than the diameter of a drop while still allowing a substantial amount of beverage to flow trough.

According to a further embodiment of the spout, the transversal wall part defines a concave surface between upper ends of the longitudinal walls the first longitudinal wall and the second longitudinal wall. A concave surface will allow a large flow area while still maintaining a high capillary force.

According to a further embodiment of the spout, the one or more ventilation openings of the one or more capillary flow passages constitute a single opening which is located at the lower side of the spout. A single broad opening is preferred instead of several small openings which may possibly be clogged by beverage. The beverage is held inside the spout by the capillary force and therefore the ventilation opening may preferably be located at the lower side of the spout.

According to a further embodiment of the spout, the ventilation opening extends between the inlet and the outlet. To ensure a complete evacuation of the beverage in the spout after interruption of beverage dispensing, the opening preferably extends the whole way from the inlet to the outlet, thereby allowing a complete ventilation of the spout.

According to a further embodiment of the spout, the longitudinal walls converge towards a point at the outlet. By allowing the spout to converge to a point, the outlet will be constituted by a point forming the lowest point of the spout. In this way it is ensured that only a single drop may remain attached to the point at the outlet.

According to a further embodiment of the spout, the spout is made of or at least has a coating of a material having an e-modulus (elastic modulus) of less than 3, such as in the range 0.5 to 3, preferably less than 0.1, more preferably less than 0.01, such as 0.002, the material most preferably being (poly(dimethylsiloxane)). It has further been found out that materials having a low e-modulus (elastic modulus), i.e. "soft" materials, will prevent wetting to a larger extent than materials having a high e-modulus, i.e. "hard" materials. By choosing the material of the spout according to the above, or at least providing the spout with a coating of such material, the beverage cannot or can only partially wet the inner walls of the spout.

According to a further embodiment of the spout, the spout is substantially transparent for allowing visual inspection of the one or more capillary flow passages from the outside. In this way the user may visually inspect the spout to ensure that the beverage glass receiving the beverage from the outlet is not removed until the beverage stream has left the spout completely.

A further embodiment of the first aspect of the present invention is obtained by a beverage dispensing system including the spout according to the first aspect, the beverage dispensing system further including:

- a beverage container for holding the beverage,
- a dispensing valve having a valve discharge opening being in fluid communication with the beverage container and having a beverage dispensing position for allowing flow of beverage through the dispensing valve and a non-beverage dispensing position for preventing flow of beverage through the dispensing valve, the inlet of the spout being in fluid communication with the valve discharge opening of the dispensing valve, and
- a dispensing handle for operating the dispensing valve between the beverage dispensing position and the non-beverage dispensing position.

The above spout is preferably installed on or provided with a beverage dispensing system, which may be a single use "mini-keg" system or a reusable system for private or professional users. The system includes a beverage container which may be pressurized or not, a dispensing valve for controlling the flow of beverage from the beverage container to the spout, and a dispensing handle for controlling the dispensing valve.

According to a further embodiment of the spout, the inlet of the spout is located immediately downstream of a shut-off plug of the dispensing valve. To ensure that no beverage remains downstream of the dispensing valve, the spout is preferably located immediately downstream of the shut-off plug of the dispensing valve. The shut-off plug establishes the actual closing of the valve by moving from a position in which fluid communication is allowed between the inlet and the outlet of the valve to a position where the plug completely blocks the fluid communication between the inlet and the outlet.

According to a further embodiment of the spout, the beverage is received in the inlet subjected to a pressure of at least 0.25 bar above atmospheric pressure, such as 0.5 to 5 bar, preferably between 1 bar and 3 bar, more preferably 2 bar. Preferably, the beverage container is pressurized for allowing the beverage to enter the spout having a suitable velocity. However, too much pressure may cause turbulence. Therefore, pressures as described above are contemplated to be suitable.

A further embodiment of the first aspect of the present invention is obtained by a method of dispensing a beverage, preferably a carbonated beverage, the method comprising providing a beverage dispensing system according to the above and performing the steps of:

- operating the handle from the non-beverage dispensing position to the beverage dispensing position,
- receiving a stream of beverage from the dispensing valve of the beverage dispensing system into the inlet of the spout,
- transporting the stream of beverage from the inlet of the spout, via the one or more capillary flow passages, to the outlet of the spout, by utilizing the capillary effect,
- releasing the stream of beverage at the outlet of the spout,
- operating the handle from the beverage dispensing position to the non-beverage dispensing position, and
- emptying the one or more capillary flow passages by utilizing the capillary effect for allowing substantial all residual beverage within the one or more capillary flow passages to be released at the outlet of the spout.

The above method described the steps of dispensing beverage in a drip free manner using the beverage dispensing system.

The above need and the above object together with numerous other needs and objects, which will be evident from the below detailed description, are according to a second aspect of the present invention obtained by a method of introducing a canister into a beverage container, the beverage container defining:

an opening defining a first perimeter, an opposing wall portion of the container located opposite the opening, a length between the opening and the opposing wall portion, and a second perimeter within the container and transversal to the length, the second perimeter being larger than the first perimeter, the canister defining:

a bottom surface, an opposite top surface, and a cylindrical surface interconnecting the bottom surface and the top surface, the cylindrical surface defining a height between the top surface and the bottom surface, the height initially being larger than the length, the cylindrical surface defining a third perimeter being transversal to the height and being smaller than or equal to the first perimeter, the cylindrical surface comprising an inwardly oriented fold extending along at least a part of the height, the canister being filled with a flowable and substantially non-compressible material, the method comprising performing the steps of i) providing the canister and the beverage container, ii) inserting the canister into the beverage container in a non-inverted orientation via the opening of the beverage container, iii) juxtaposing the bottom surface of the canister and the opposing wall portion of the container, iv) subjecting the top surface of the canister to a force directed towards the bottom surface, the force causing a reformation of the canister while the volume of the canister is substantially maintained, the reformation substantially simultaneously comprising:

reducing the height to less than the length, relocating the flowable and substantially non-compressible material, and unfolding the fold of the cylindrical surface, thereby expanding the third perimeter to exceed the first perimeter but not to exceed the second perimeter.

By perimeter is typically understood a substantially circular shape, however, other shapes are feasible as well. The second perimeter is understood to be defined at the location defining the largest circumference of the container, i.e. typically within the so-called body of the container. The "body" part of the container is typically circular cylindrical and located between a shoulder or neck part of the container and a bottom part of the container. The canister may initially be higher than the container in order for the canister to include a sufficient amount of flowable material while still fitting though the opening of the container. The container is typically blow moulded and substantially rigid, while the canister may be of a flexible material, preferably a polymeric material. However, the canister may also be made of thin sheet of flexible metal, such as a thin sheet of aluminium or tin. The canister may include predetermined folding lines transversal to the inwardly oriented fold which are adapted to fold together when subjected to pressure. Alternatively the location of the reformation is occasional and canister is elastic enough to withstand a deformation. The inwardly oriented fold allows the canister to assume a diameter smaller than the opening of the container when the fold is present and a diameter larger than the opening of the container when the fold is unfolded. In the present context the word fold is to be construed broadly and include bulges and the like allowing the above mentioned change of dimension. Unfold should be construed to include also a partial unfolding allowing the canister to increase its diameter. Unfolding should also be construed to include the possibility that an outwardly oriented fold will appear instead of the inwardly oriented fold. In case the canister is prefilled by $CO_2$ and has an internal pressure being higher than the atmospheric pressure, it is understood that the inwardly oriented fold is kept from unfolding before being inserted into the container, either due to the rigidity of the canister itself of alternatively by subjecting the canister to an outer elevated pressure being the same or higher than the internal pressure, or, yet alternatively by keeping the inwardly oriented fold intact by mechanical means such as a rubber band or the like.

After the third step, the canister will rest on the bottom of the beverage container and the top surface of the canister will protrude through the opening of the container. The reformation is then performed by pressing the top surface of the canister downwardly such that the height of the canister is reduced, the flowable material located near the top of the canister is relocated downwards and the flowable material located near the fold of the canister is relocated outwardly, thereby unfolding the fold. The pressure may be applied mechanically such as by hydraulic means or alternately pneumatically by the use of compressed $CO_2$. Non compressible and flowable materials should be construed to include all materials which are capable of deforming but substantially not compressing when subjected to a force. Typical examples include most liquids and granulated solids. The height of the canister after reformation is less or equal to the height of the container. It is understood that the canister may be equipped with a cap or similar, which at the same time should function as seal of the opening of the container and such cap may of course extend slightly above the opening even after reformation.

According to a further embodiment of the method, the flowable material is constituted by granulates of activated carbon. In the preferred embodiment the flowable material is granulates of activated carbon. Such granulates are very fine and are therefore flowable, behaving similar to a liquid.

According to a further embodiment of the method, the canister is made of polymeric material. Polymeric materials such as plastics are preferred due to being flexible, durable and disposable.

According to a further embodiment of the method, the canister is made of PE or HDPE. Suitable polymers include the above-mentioned.

According to a further embodiment of the method, the force is between 10N and 100 kN, such as between 100N and 10 kN and typically 1 kN. The force needed for achieving the deformation will depend on the shape and thickness of the canister as well as the viscosity of the flowable material.

According to a further embodiment of the method, in step iv) the height is reduced by at least 10%, such as at least 20%, preferably at least 30%, more preferably at least 40% and most preferably at least 50%. A large compression will allow the container to have a smaller opening and/or a greater amount of flowable material to be included in the canister.

According to a further embodiment of the method, the length is between 0.1 m and 1 m, typically between 0.2 m and 0.6 m, such as between 0.3 m and 0.5 m. The above lengths of the container is typical for accommodating between 5 liters and 150 liters of beverage.

According to a further embodiment of the method, the first perimeter defines a diameter being between 1 cm and 10 cm, such as between 2 cm and 8 cm, typically between 3 cm and 5 cm. The above diameters correspond to the diameters of the opening of typical beverage containers and/or kegs.

According to a further embodiment of the method, the second perimeter defines a diameter being between 0.5 and 1.5 times the length, or typically between 0.75 and 1 times the length. The diameter of the container is often equal to or slightly smaller than the length, or height, of the beverage container.

According to a further embodiment of the method, the cylindrical surface comprises one or more further inwardly oriented folds extending along at least a part of the height. Further inwardly folds may be provided for allowing the canister to expand substantially symmetrical.

According to a further embodiment of the method, the canister further comprises a cap for sealing the opening. A common cap may be used for sealing off both the canister and the container. The cap may be pushed into the opening and held in place by the friction force between the opening and the cap, similar to a cork of a champagne bottle.

According to a further embodiment of the method, the cap and the opening comprise mutually engaging protrusions. Mutually engaging protrusions on the inner surface of the mouth of the opening and on the outer surface of the cap may be used to secure the cap in the opening.

According to a further embodiment of the method, the method is performed in a chamber subjected to an elevated gas pressure. The present method may be performed after or at the same time as the beverage container is filled by beverage, such as carbonated beverage, and/or, the canister being filled by gas, such as carbon dioxide gas.

A further embodiment of the second aspect of the present invention is obtained by a container assembly comprising a canister and a beverage container, the beverage container defining:

an opening defining a first perimeter, an opposing wall portion of the container located opposite the opening, a length between the opening and the opposing wall portion, and a second perimeter within the container and transversal to the length, the second perimeter being larger than the first perimeter, the canister defining:

a bottom surface, an opposite top surface, and a cylindrical surface interconnecting the bottom surface and the top surface, the cylindrical surface defining a height between the top surface and the bottom surface, the height being smaller than the length, the cylindrical surface defining a third perimeter being transversal to the height and being larger than the first perimeter, the canister being filled with a flowable and substantially non-compressible material, the canister originating from a process in which:

i) the canister has been inserted into the beverage container in a non-inverted orientation via the opening of the beverage container, ii) the bottom surface of the canister has been juxtaposing the opposing wall portion of the container, and iii) the top surface of the canister has been subjected to a force directed towards the bottom surface, the canister has been reformed while the volume of the canister has been substantially maintained, in which reformation substantially simultaneously:

the height has been reduced to less than the length, the flowable and substantially non-compressible material has been relocated, and a fold of the cylindrical surface has been unfolded, thereby expanding the third perimeter to exceed the first perimeter but not to exceed the second perimeter.

The container assembly may preferably be used together with the method.

A further embodiment of the second aspect of the present invention is obtained by a canister for use in a container assembly comprising the canister and a beverage container, the beverage container defining:

an opening defining a first perimeter, an opposing wall portion of the container located opposite the opening, a length between the opening and the opposing wall portion, and a second perimeter within the container and transversal to the length, the second perimeter being larger than the first perimeter, the canister defining:

a bottom surface, an opposite top surface, and a cylindrical surface interconnecting the bottom surface and the top surface, the cylindrical surface defining a height between the top surface and the bottom surface, the height being larger than the length, the cylindrical surface defining a third perimeter being transversal to the height and being smaller than or equal to the first perimeter, the cylindrical surface comprising an inwardly oriented fold extending along at least a part of the height, the canister being filled with a flowable and substantially non-compressible material, the canister being suitable for a process in which:

i) the canister being inserted into the beverage container in a non-inverted orientation via the opening of the beverage container, ii) the bottom surface of the canister being juxtaposing the opposing wall portion of the container, and iii) the top surface of the canister being subjected to a force directed towards the bottom surface, the canister being reformed while the volume of the canister has been substantially maintained, in which reformation substantially simultaneously:

a) the height being reduced to less than the length, b) the flowable and substantially non-compressible material being relocated, and c) the fold of the cylindrical surface being unfolded, thereby expanding the third perimeter to exceed the first perimeter but not to exceed the second perimeter.

The canister may preferably be used together with the container assembly and/or the method.

The above need and the above object together with numerous other needs and objects, which will be evident from the below detailed description, are according to a third aspect of the present invention obtained by a container assembly comprising:

a beverage container for containing a beverage, preferably a carbonated beverage, the beverage establishing a head space and a beverage space within the container, a canister located within the beverage container and defining an inner space for containing propellant gas under an elevated pressure, and a cap sealing off both the beverage container and the canister, the cap comprising a first fluid passage for allowing a propellant gas flow from the inner space of the canister to the head space of the beverage container and a second fluid passage allowing a beverage flow from the beverage space of the beverage container to the outside of the beverage container, the first passage and the second passage being separated.

The beverage container may preferably be a standard blow moulded plastic container having a single opening and being pressure proof. Suitable pressures may be in the range 1-5 bar. Alternatively, a metal container may be used, however, for ecological reasons metal is less preferred. The beverage is preferably intended to be stored and dispensed under pressure. The beverage fills a portion, preferably the greater portion, of the container, which portion is known as the beverage space. After the beverage container has been filled by beverage, a head space, i.e. a small gas pocket, should remain at the opening. The head space should be sufficiently large to accommodate the pressure generating device. For example, a six liters beverage container may be suitable for establishing a beverage space of about five liters and a head space of about one liter. When beverage is dispensed, the head space increases and the beverage space decreases. The cap should be adapted to seal off the opening of the container.

The canister also has preferably one opening which is intended to be sealed off by the cap. The canister should fit into the container and the opening of the canister may preferably be smaller than the opening of the container. Preferably, the beverage container is located in an upright position; however, an inverted position is as well feasible. In an inverted position, the beverage space is located adjacent the cap, and fluid communication between the first fluid passage and the head space is achieved via the beverage. In case an upright position is preferred, the head space is located adjacent the cap and an ascending pipe is required to provide fluid communication between the second fluid passage and the beverage space. The first and second fluid passages should be separated, however, they may preferably be adjacent each other.

According to a further embodiment of the container assembly, the cap comprises an outer wall, an inner wall and a circumferential wall interconnecting the outer and inner walls, the circumferential wall sealing against the beverage container and the inner wall sealing against the canister. Preferably, the cap is fixated in the mouth of the beverage container thereby sealing the beverage container. The opening of the canister may then be sealed toward an inner wall of the canister.

According to a further embodiment of the container assembly, the cap further comprises an activation mechanism, the activation mechanism defining a non-activated state in which the first flow passage and/or the second flow passage is closed off, and, an activated state in which the first flow passage and/or the second flow passage is open. The cap may include a button or knob for activating the assembly. The assembly may be provided to the customer in a non-activated state in which beverage dispensing is not possible since either the first flow passage, the second flow passage or both flow passages are closed. By activation is understood an operation in which either the first flow passage, the second flow passage or both flow passages are opened, respectively. The activation step is performed to prevent unauthorized or accidental dispensing of the beverage, as well as preventing fluid leakage.

According to a further embodiment of the container assembly, the activation mechanism includes:

a piercable membrane sealing off the first fluid passage and/or the second fluid passage, and a piercing member for piercing the piercable membrane, the piercing member being in the non-activated state distant to the piercing membrane and the piercing member being in the activated state in a position in which the piercable membrane is pierced by the piercing member, the piercable membrane being positioned either in the cap or alternatively in the canister. The activation mechanism may include a piercable membrane and a piercing member. The piercable membrane may be closing off the first fluid passage for preventing pressurization of the head space before activation. Alternatively, the piercable membrane may be closing off the second fluid passage for preventing dispensing of the beverage before activation. Yet alternatively, both the first and the second fluid passages may be closed off by two separate piercable membranes.

According to a further embodiment of the container assembly, the propellant gas is constituted by carbon dioxide. Carbon dioxide may be used for both pressurizing the container and for carbonizing the beverage. Alternatively, perfluorether may be used as propellant gas.

According to a further embodiment of the container assembly, a dispensing valve is either within or downstream the second fluid passage, the dispensing valve being operable between a non-dispensing position preventing beverage dispensing via the second passage and a dispensing position allowing beverage dispensing via the second passage. After the optional activation, beverage dispensing may be controlled by the user via a dispensing valve. The dispensing valve may be coupled to a dispensing handle.

According to a further embodiment of the container assembly, the cap part comprises a centrally located inner chamber establishing at least a part of the second fluid passage and an outer chamber at least partially enclosing the inner chamber and establishing the first fluid passage. The second fluid passage is preferably centrally located in order to make the beverage container symmetrical to facilitate the installation of a tapping device downstream the second fluid passage. The tapping device may then communicate to the center of the cap and may thus be installed independently on the orientation of the beverage container.

According to a further embodiment of the container assembly, the cap part further includes a gas permeable membrane for preventing liquid flowing from the beverage space of the container to the inner space of the canister via the first fluid passage. For preventing any beverage from entering the canister, the second fluid passage may be provided with a gas permeable but liquid impermeable membrane. Such membrane may be e.g. a Gore-Tex® membrane.

According to a further embodiment of the container assembly, the first passage and/or the second passage is connected to a pipe which is extending into the head space and/or beverage space, respectively. A pipe may be beneficial in some embodiments in order to establish a proper fluid communication between the cap and the opposite bottom of the beverage container. In case an inverted beverage container, i.e. a beverage container having the cap oriented downwardly, is used, a pipe may be provided extending from the first passage to the head space. In case a non-inverted beverage container is used, a pipe, i.e. an ascending pipe, may be used to provide fluid communication between the second passage and the beverage space.

According to a further embodiment of the container assembly, the gas permeable membrane defines a liquid barrier of at least 70 mN/m and a gas permeability of more than 0.014 l/sec.bar. The above values for barrier and permeability of the gas permeable membrane have been proven to be suitable for preventing at all times any beverage from entering the canister via the first fluid passage while allowing a sufficient flow of propellant gas from the inside of the canister to the head space for maintaining a sufficiently high driving pressure in turn allowing a suitable beverage flow during the whole beverage dispensing operation.

According to a further embodiment of the container assembly, the inner space of the canister further comprises activated carbon. In a preferred embodiment the inner space is filled by activated carbon in order to reduce the necessary pressure inside the canister.

A further embodiment of the third aspect of the present invention is obtained by a method of dispensing beverage by providing a container assembly, the container assembly comprising:

a beverage container containing a beverage, the beverage establishing a head space and a beverage space within the container, a canister located within the beverage container and defining an inner space containing propellant gas under an elevated pressure, and a cap sealing off both the beverage container and the canister, the cap comprising a first fluid passage for allowing a propellant gas flow from the inner space of the canister to the head space of the beverage container and a second fluid passage allowing a beverage flow from the beverage space of the beverage container to the outside of the beverage container, the first passage and the second passage being separated, the method comprising the steps of:

transporting a stream of propellant gas from the inner space of the canister to the head space of the beverage container via the first fluid passage, and transporting a stream of beverage from the beverage space of the beverage container to the outside of the beverage container via the second fluid passage.

The above method may preferably be used in connection with the container assembly according to the present invention. The above steps are preferably performed simultaneously by operating a dispensing valve.

A further embodiment of the third aspect of the present invention is obtained by a method of assembling a container assembly by performing the steps of:

providing a beverage container for containing a fluid beverage, providing a canister defining an inner space, and providing a cap for sealing off both the beverage container and the canister, the cap comprising a first fluid passage and a second fluid passage, the first passage and the second passage being separated, establishing a head space and a beverage space within the beverage container by filling the beverage container with a first amount of beverage, filling the canister by a second amount of propellant gas under an elevated pressure, mounting the cap onto the canister, and mounting the cap onto the beverage container such that the canister is located within the beverage container, the first fluid passage is leading from the inner space of the canister to the head space of the beverage container and the second fluid passage is leading from the beverage space of the beverage container to the outside of the beverage container.

The above method is preferably used for assembling a container assembly according to the present invention.

According to a further embodiment of the method, the canister is sealed by a rupturable membrane after the filling by a second amount of propellant gas. In this way the canister may be assembled at a distant location and transported to the beverage filling location in a convenient manner.

A further embodiment of the third aspect of the present invention is obtained by a cap for sealing off both a beverage container and a canister, the beverage container containing a beverage for establishing a head space and a beverage space, the canister defining an inner space for containing propellant gas under an elevated pressure, the cap comprising a first fluid passage for allowing a propellant gas flow from the inner space of the canister to the head space of the beverage container and a second fluid passage allowing a beverage flow from the beverage space of the beverage container to the outside of the beverage container, the first passage and the second passage being separated.

The cap according to the present invention is preferably used in the assembly or in any of the methods according to the third aspect.

The above need and the above object together with numerous other needs and objects, which will be evident from the below detailed description, are according to a fourth aspect of the present invention obtained by a method of filling a canister with propellant gas by performing the following steps:

providing a canister having a specific volume filled with activated carbon, the activated carbon having a first temperature, causing the activated carbon to adsorb a first amount of propellant gas while allowing the activated carbon to assume a second temperature, the second temperature being higher than the first temperature, allowing the activated carbon to cool to a third temperature, the third temperature being lower than the second temperature, and causing the activated carbon to adsorb a second amount of propellant gas while allowing the activated carbon to assume a fourth temperature, the fourth temperature being higher than the third temperature, the second and fourth temperatures being below the self-destruction or self-desorption temperature of the activated carbon.

The present method will allow a canister to be filled by a larger amount of propellant gas than otherwise possible due to the self heating of the activated carbon during adsorption. The canister is provided having a specific volume which may differ significantly depending on the area of application of the canister. Preferably, the canister is used in a so-called mini-keg system comprising a beverage container of about 5-10 liters which may be pressurized by carbon dioxide as propellant gas. In the above case, the canister may be in the range 0.5-1 liter.

The canister should be filled by activated carbon in order to reduce the pressure required inside the canister. In this way a canister of 0.5 liter and a propellant gas pressure of 2-3 bar will be sufficient to dispense 4-5 liters of beverage without any significant pressure loss, whereas without activated carbon a pressure exceeding 30 bar plus a pressure regulating mechanism would be necessary. The canister and the activated carbon is provided at a first temperature which should be significantly lower than the self-destruction or self-desorption temperature of activated carbon, such as preferably room temperature or below.

The canister may be filled by the first amount of propellant gas by simply connecting the canister to a propellant gas filling hose. The propellant gas will be adsorbed by the activated carbon. During the adsorption process a significant amount of heat is released by the adsorbent, i.e. the carbon dioxide, thereby heating the activated carbon above the first temperature. The more carbon dioxide to be adsorbed, the higher temperature will be achieved, provided no external cooling is used. After a first amount of propellant gas has been adsorbed, the temperature will have risen to a second temperature which should be below the self-destruction or self-desorption temperature of activated carbon. The first amount must consequently always be smaller than the amount which is sufficient for reaching the self-destruction or self-desorption temperature of activated carbon. Any external cooling, such as heat conduction to the outside environment, is hereby neglected. The self-destruction or self-desorption temperature of activated carbon is the temperature where activated carbon will self-ignite or where a release of the majority of the adsorbed propellant gas will occur spontaneously. Typical temperatures for this to occur are at 400-600 C.

After the first filling of the canister by propellant gas the canister is allowed to cool down to a third temperature which is significantly lower that the self-destruction or self-desorption temperature of activated carbon. The cooling may be performed by simply resting the canister in a cool environment for a sufficiently long time period. This time period may advantageously be used to transport the canister to a new location.

After the canister is cool it may be filled a second time with a second amount of propellant gas. The second amount must as well always be smaller than the amount which is sufficient for reaching the self-destruction or self-desorption temperature of activated carbon. It is evident that further filling cycles may be added in case a very large amount of propellant gas should be adsorbed.

According to a further embodiment of the method, the first and third temperatures are substantially equal to room temperature or less. To allow the first and the second amounts of propellant gas to be as large as possible, the first and third temperatures should be as low as possible. Preferably, room temperature or lower is used for allowing the first and third amounts to correspond to the temperature rise between room temperature and the self-destruction or self-desorption temperature of activated carbon.

According to a further embodiment of the method, each of the first and second amount of $CO_2$ corresponds to a gas volume at atmospheric pressure which exceeds the specific volume of the activated carbon by at least a factor 5, preferably a factor 10. The amount of activated carbon is preferably as large as possible in relation to the volume of the canister in order to accommodate as much propellant gas as possible in relation to the volume of the canister.

According to a further embodiment of the method, the canister further comprises a specific quantity of an oxygen scavenger. An oxygen scavenger may preferably be used to prevent any oxygen within the propellant gas. Oxygen may affect certain products, in particular beverages such as beer, negatively, e.g. the shelf life of the product may be significantly reduced.

According to a further embodiment of the method, the oxygen scavenger is comprising Fe-powder. Iron powder may preferably be used as scavenger. The iron powder should be as fine as possible in order to work as an effective scavenger.

According to a further embodiment of the method, the Fe-powder amounts to 0.01-0.1% by weight of the activated carbon. Only a relatively small amount of iron powder is sufficient in order to remove the relatively small amounts of oxygen which may be present in the activated carbon.

According to a further embodiment of the method, the oxygen scavenger is located at an opening of the canister. To take care of any oxygen leaking into the canister from the outside, the oxygen scavenger is preferably located near an opening of the canister.

According to a further embodiment of the method, the canister is sealed when the canister is allowed to cool to the third temperature. In case the canister is to be transported to another location, the canister may preferably be sealed during such transport to prevent any gas exchange with the outside of the canister. Typically a membrane such as a tear off tab or the like is used as a seal.

According to a further embodiment of the method, the canister is cooled by being rested for a specific long time in a temperature above 0° C., or, alternatively, wherein the canister is cooled by being rested for a specific short time in a temperature equal to or less than 0° C. The canister may be rested at room temperature for a specific long time, typically Several hours or more, in order to reach the third temperature. Alternatively, the canister may be rapidly cooled down by being stored at a low temperature.

According to a further embodiment of the method, the canister has an opening being sealed by a burstable membrane. The opening of the canister may be sealed by a burstable membrane, such that the propellant gas cannot escape before the membrane has been ruptured. The burstable membrane may be applied either during the cooling or after the final filling of propellant gas. The membrane may be ruptured by means such as an elevated gas pressure or a piercing member.

According to a further embodiment of the method, the first and second amounts of propellant gas are substantially equal. Preferably, the first and second amounts are equal in order to achieve the most efficient filling and for achieving a fourth temperature being approximately equal to the second temperature.

According to a further embodiment of the method, the propellant gas is constituted by $CO_2$. Carbon dioxide is preferably used as propellant gas, in particular in case the propellant gas is to be used together with a carbonated beverage, such as beer. Otherwise, perfluorether may be used as propellant gas.

According to a further embodiment of the method, the canister has an absolute pressure of between 1-4 bar, such as 3 bar, before adsorbing the second amount of propellant gas and an absolute pressure of between 4-8 bar, such as 6 bar, after adsorbing the second amount of propellant gas. Typically, the pressure will increase after each filling operation.

According to a further embodiment of the method, the first and second amounts of propellant gas are adsorbed by the activated carbon during a time period not exceeding 10 seconds, preferably not exceeding 5 seconds. The present method is suitable for industrial mass production of canisters and a rapid filling time, such as a few seconds per filling operation.

A further embodiment of the fourth aspect of the present invention is obtained by a canister filled with a specific volume of activated carbon, the specific volume exceeding the volume which can be filled in a single filling step, the canister being provided at a first temperature constituting room temperature or below, the canister has been filled in two filling steps in which in a first step the activated carbon having adsorbed a first amount of propellant gas at a filling pressure of between 1-4 bar, and in a second step the specific volume of activated carbon having adsorbed a second amount of propellant gas at a filling pressure of between 4-8 bar while the activated carbon is allowed to assume a second temperature, the second temperature being higher than the first temperature while not exceeding the self-destruction or self-desorption temperature of the activated carbon. The above canister is preferably used together with the method.

The above need and the above object together with numerous other needs and objects, which will be evident from the below detailed description, are according to a fifth aspect of the present invention obtained by a beverage container assembly comprising:

a beverage container defining a top, an oppositely located bottom and a wall extending between the top and the bottom, the wall defining at least a visual inspection wall section, the beverage container having a beverage space for containing a beverage, and a temperature indicator located within the beverage container and at least partly extending into the beverage space, the temperature indicator being visible from the outside of the beverage container through the visual inspection wall section of the beverage container.

The beverage container may be made of metal or preferably of blow moulded plastic. Other materials are possible, such as glass or wood. The visual inspection wall section may be a window which is transparent or at least translucent, to some wavelengths within the visual spectrum. The size of the visual inspection wall section may vary. In some embodiments the visual inspection wall section may even cover the whole wall of the container, while in other embodiments a tiny visual inspection wall section is provided.

The beverage space is typically located near the bottom of the beverage container. The beverage space may be filled by an alcoholic or non alcoholic beverage, such as beer, soda or other carbonated beverages which are intended to be served cool. The beverage may also be a non-carbonated beverage such as milk or wine. Further, beverages intended to be served hot, such as coffee, tea or hot chocolate may as well be filled into the beverage space. Above the beverage space, near the top of the beverage container, typically a head space constituting a small gas pocket is provided, which gas pocket will increase in volume when the amount of beverage in the beverage space is reduced as a result of the dispensing of the beverage.

The temperature indicator should be located within the beverage container and extending at least partly into the beverage space. The temperature indicator should, at least when the beverage space is filled by beverage, thereby be in contact with the beverage. The temperature indicator should be visible from the outside and visibly communicate to a user located outside the beverage container information about the temperature of the beverage. Possible temperature indicators include analog or digital thermometers, liquid crystals, inks, bimetallic strips, phase change material and similar means which are generally known.

According to a further embodiment of the beverage container assembly, the temperature indicator is capable of shifting between a first visual indication associated with a first temperature range and a second visual indication associated with a second temperature range. The visual indication may be of a reversible type which may again assume the first visual indication in case the first temperature range is reassumed, or, alternatively of a non-reversible type remaining at the second visual indication irrespective of a later return to the first temperature range.

According to a further embodiment of the beverage container assembly, the first temperature range includes temperatures in which the beverage is non-suitable for consumption while the second temperature range includes temperatures in which the beverage is suitable for consumption. In particular, the user should be informed if the beverage is within its optimal drinking temperature or not. Some beverages are purchased at room temperature, but having the optimal drinking temperature either lower, such as most carbonated beverages, or higher than room temperature. Most beers are purchased in boxes, kegs, containers or packs stored at room temperature, while the optimal drinking temperature is less than room temperature at 5° C.-12° C. Thus, the first temperature range may be above 12° C. and the second temperature may be equal to or below 12° C. The user performing the cooling of the beverage, e.g. by keeping the container inside a refrigerator, will then have an indication whether or not the beverage has reached the optimal drinking temperature. An optional third temperature range may be below 5° C.

According to a further embodiment of the beverage container assembly, the visual inspection wall section has a specific optical filter characteristic, the optical filter characteristic prevents transmission of light emitted by the first visual indication or alternatively the second visual indication, and, allows transmission of light emitted by the second visual indication or alternatively the first visual indication, respectively. In a preferred embodiment the inspection wall section does not transmit light emitted by the first visual indicator when the first temperature range is assumed for achieving the effect that the temperature indicator appear to be invisible, e.g. when the beverage is having a non-optimal temperature. When the beverage assumes the second temperature range and thus the light of the second visual indication is emitted, the temperature indicator appears visible to show that the beverage is suitable for drinking. The opposite, i.e. the temperature indicator appears visible to show that the beverage is non-suitable for drinking is of course also feasible. By emitting should be understood also reflecting and similar optical or visual effects.

According to a further embodiment of the beverage container assembly, the first visual indication constitutes a first color range and the second visual indication constitutes a second color range. Most conveniently, different color ranges are used to indicate the non-optimal and optimal drinking temperature ranges, respectively.

According to a further embodiment of the beverage container assembly, the first color range corresponds to light wavelengths below 510 nm and the second color range corresponds to light wavelengths above 510 nm.

According to a further embodiment of the beverage container assembly, the temperature indicator is a layer of a heat sensitive ink. In the preferred embodiment a heat sensitive ink is used as the temperature indicator. Such inks are commercially available in a plurality of temperature ranges and both reversible and non-reversible. Consequently, the properties of the ink must therefore not be discussed in detail here. The ink should be non-toxic or at least be having a coating of a non-toxic material.

According to a further embodiment of the beverage container assembly, the temperature indicator is applied at least partially covering the visual inspection wall section of the beverage container.

According to a further embodiment of the beverage container assembly, the temperature indicator is completely enclosed within the beverage space. Preferably, the beverage covers the temperature indicator completely so that the visual indication is unambiguous and not influenced by a possibly different temperature in the head space.

According to a further embodiment of the beverage container assembly, the temperature indicator is applied on a canister located within the beverage container, the canister extending at least partly into the beverage space. In case the canister is located near the center of the beverage, the result may be more accurate since it is not influenced by a possibly warmer or colder boundary layer near the wall of the beverage container.

According to a further embodiment of the beverage container assembly, the canister is constituted by a canister filled with propellant gas such as $CO_2$. The canister may thus be a canister which is used for carbonizing and/or pressurizing the beverage in the beverage container.

According to a further embodiment of the beverage container assembly, the visual inspection wall section extends at least from the top to the bottom of the beverage container. To achieve a temperature indication irrespective of the orientation of the beverage container, it is preferred that the visual inspection wall section extends at least from the top to the bottom of the beverage container.

According to a further embodiment of the beverage container assembly, the temperature indicator is located near the bottom of the beverage container and the beverage space is located near the bottom of the beverage container. To achieve a temperature indication, also when the beverage container is almost empty, the temperature indicator is located near the bottom of the beverage container.

According to a further embodiment of the beverage container assembly, the visual inspection wall section or alternatively the canister is graduated and constitutes a measure of the volume of the beverage within the beverage space while allowing the temperature indicator to be visible from the outside of the beverage container. In this way both the temperature of the beverage and the amount of beverage remaining may be easily visually detected by the user.

A further embodiment of the fifth aspect of the present invention is obtained by a method of handling a beverage comprising providing a beverage container assembly, the beverage container assembly comprising:

a beverage container defining a top, an oppositely located bottom and a wall extending between the top and the bottom, the wall defining at least a visual inspection wall section, the beverage container having a beverage space containing a beverage, and a temperature indicator located within the beverage container and extending at least partly into the beverage space, the temperature indicator being visible from the outside of the beverage container through the visual inspection wall section of the beverage container, the method comprising the steps of:

providing the beverage container assembly at a first temperature, cooling the beverage container assembly to a second temperature, inspecting the temperature indicator from the outside of the beverage container, and dispensing at least a part of the beverage from the beverage container.

The method of handling a beverage is preferably conducted using the beverage container assembly as described above.

The above need and the above object together with numerous other needs and objects, which will be evident from the below detailed description, are according to a further aspect of the present invention obtained by a method of filling a canister with propellant gas by performing the following steps:

providing a canister, the canister defining a body part and a cylindrical neck part, the body part defining an inner space, the cylindrical neck part defining an opening for allowing access to the inner space of the body part, an upper neck portion located adjacent the opening and a lower neck portion located adjacent the body part, the cylindrical neck part comprising a first screw thread encircling the cylindrical neck part along the upper neck portion and the lower neck portion, the canister further comprising a lid for sealing off the opening of the neck part, the lid defining a second screw thread for cooperating with the first screw thread of the neck part, the first screw thread and/or the second screw thread comprising a first and/or a second pressure relief vent, respectively, intersecting the first screw thread and/or the second screw thread, respectively, for allowing a gas flow through the first screw thread and/or the second screw thread when the lid is applied in a loose position to the cylindrical neck part, introducing a specific volume of adsorption material into the canister via the opening, the propellant gas being adsorbable in and releasable from the adsorption material, applying the lid onto the cylindrical neck part in the loose position by allowing the first and second screw threads to partly engage while maintaining gaseous communication between the inner space of the canister and the outside via the first and/or second pressure relief vents, establishing a specific temperature such as a temperature below room temperature within the adsorption material, causing the adsorption material to adsorb a specific amount of propellant gas by introducing the propellant gas though the first and/or second pressure relief vent and the opening, while allowing the adsorption material to be heated from the specific temperature to an elevated temperature, the elevated temperature being below the temperature at which the adsorption material is destructed, decomposed or destroyed, or, at which the adsorption material is desorbing the propellant gas to a substantial extent, and fastening the lid onto the neck part in a sealed position by allowing the first and second screw threads to engage further for causing the lid to seal the opening and preventing gaseous communication between the inner space of the canister and the outside.

In the present context the applicant has surprisingly found out that the canister may be provided with the lid already directly after it has been filled by adsorption material and before the canister is pressurized and filled by carbon dioxide. After filling the canister by adsorption material, which is provided in granulate form, the lid may be loosely screwed on the cylindrical neck. The canister may thereafter be inserted into a pressure chamber, or alternatively a pressure nozzle may be attached to the opening of the canister with the lid already attached in the loose position.

The pressure relief vents are slots or grooves which intersect the screw threads of the lid and/or the neck of the canister. The pressure relief slots are known as such from e.g. U.S. Pat. No. 4,476,987 for, in conventional beverage bottles, allowing pressurized carbon dioxide to leave the head space of the beverage container while the beverage container is being opened. The pressurized carbon dioxide should escape the head space before the screw threads of the neck part and the lid disengage in order to prevent the lid from being ejected by the pressure force and possibly causing personal injury or descruction of property. Thus, during unscrewing of the lid, at the time when the lid looses contact with the opening but still remains engaged via the screw threads, the pressurized gas may escape via the pressure relief vents.

The applicant has now found out that the pressure relief vents allow the pressurized propellant gas to enter the canister via the opening although the cap is covering the neck of the canister. In this way the lid must, after carbon dioxide filling is completed, only be fastened. It is thus not necessary to provide a separate mechanism for applying the lid under pressure, merely a mechanism for tightening or fastening the lid under pressure.

Further, the applicant has found out that the adsorption material may be established at a specific temperature, such as a temperature below room temperature, in order to avoid temperature dependent destruction of the adsorption material or desorption of carbon dioxide as described above.

According to a further embodiment, the adsorption material comprises a specific volume of granulates, the granulates including a first group of granulates and a second group of granulates, the first group including granulates of a first size and the second group including granulates of a second size, the first size being at least ten times greater than the second size.

To increase the density of the adsorption material, the adsorption material may be provided in granulate form in two different granulate sizes. The smaller granulates may fill the space which exists between individual large granulates. The applicant has found out that the larger sized granulates should be about 10 times greater that the smaller sized granulates in order to achieve a advantageous density of the adsorption material. A higher density of the adsorption material will allow a smaller canister for the same size of beverage container. In the present context, the applicant company has calculated that about 78% of the available space of the canister may be filled in case only one size of granulates is used. Consequently, about 22% of the available space of the canister will remain unfilled by adsorption material. In case two sizes of granulates are used and provided the smaller granulates are about 10 times smaller than the larger granulates, about 78% of the remaining 22% of the available space in the canister will be filled, Consequently, the filling percentage will increase by about 16%, yielding a total of 94% of the available space in the canister being filled by adsorption material.

According to a further embodiment, the specific volume of adsorption material within the canister defines a specific density of at least 0.45 kg/liter, preferably at least 0.50 kg/liter, most preferably 0.54 kg/liter.

The applicant has found out that the specific density may be increased beyond 0.45 kg/liter by applying the above method.

According to a further embodiment, the canister defines a volume of between 0.1 and 5 liters, preferably between 0.2 and 1 liter, more preferably between 0.3 and 0.7 liters, such as 0.4 liters, 0.5 liters or 0.6 liters. The typical canister size is about 0.5 liters for a beverage container of about 5 liters.

According to a further embodiment, the canister is made by rigid plastics, such as PET. Preferably, a standard PET beverage bottle is used as a canister.

According to a further embodiment, the adsorption material is activated carbon and/or the propellant gas is carbon dioxide. Preferably, for carbonated beverages, activated carbon, which is non-poisonous, is used as adsorption material together with carbon dioxide ($CO_2$) as propellant gas.

The above need and the above object together with numerous other needs and objects, which will be evident from the below detailed description, are according to a further aspect of the present invention obtained by a pressure generating device comprising:

a carbonisation canister, the canister defining a body part and a cylindrical neck part, the body part defining an inner space, the cylindrical neck part defining an opening for allowing access to the inner space of the body part, an upper neck portion located adjacent the opening and a lower neck portion located adjacent the body part, the canister further comprising a lid for sealing off the opening of the neck part, and a cap part covering the lid of the canister, the cap part establishing a first fluid passage for allowing a propellant gas flow from the inner space of the canister to the outside of the pressure generating device, the first fluid passage including a hydrophobic labyrinth for preventing the ingress of liquid into the pressure generating device to any substantial extent.

Such lid-cap assembly is preferably used in order to be able to seal off both the canister, constituting a small conventional PET bottle, and the beverage container constituting the mini-keg. However, in some embodiments the opening of the beverage container may be sealed off by a separate cap. Beverage which enters the first passage of the cap part may be stored therein or within the canister and may be impossible to dispense and thus constitute a loss for the user. Even worse, beverage may enter into the canister and deteriorate the adsorption material which is typically employed within the inner space of the canister. The hydrophobic labyrinth should be understood to be a fluid passage which will hinder a large amount of beverage to enter the cap part and proceed into the inner space of the canister. The hydrophobic labyrinth may, in its simplest configuration, constitute a constriction which prevents a significant flow of beverage while allowing a substantially free flow of gas into the first fluid passage.

According to a further embodiment, the cap part comprising a second fluid passage allowing a beverage flow through the cap part, the first fluid passage and the second fluid passage being separated.

As stated above, the cap part preferably seals off the opening of the beverage container. To avoid the need for two openings in the beverage container, the cap part preferably includes a second fluid passage, optionally including an ascending pipe, in order to dispense the beverage. The first and second fluid passage should be entirely separated.

According to a further embodiment, the lid including a piercable water and gas impermeable membrane, the piercabel membrane of the lid initially being unpierced, the cap part including a piercing mechanism for piercing the piercable membrane and establishing the first fluid passage when the cap is pushed onto the lid, the piercable membrane preferably being made of aluminium.

In order to activate the pressure generating device, the lid may have a piercable membrane. The piercable membrane is initially gas and liquid tight such that the pressure generating device may be transported in a pressurized state. When the pressure generating device is or is about to be installed, the piercable membrane may be ruptured by pushing the piercing mechanism of the cap part into the piercable membrane for establishing fluid communication between the inner space of the canister and the first fluid passage.

According to a further embodiment, the hydrophobic labyrinth comprises one or more capillary pipes, the one or more capillary pipes preferably each having a diameter of less than 1000 microns, more preferably less than 100 microns, most preferably less than 10 microns.

The hydrophobic labyrinth may comprise one or more capillary pipes which prevent large amounts of liquid, i.e. beverage, to pass.

According to a further embodiment, the hydrophobic labyrinth is at least partially established by a groove or grooves along the outer circumferential surface of the lid and/or the corresponding inner surface of the cap part.

The hydrophobic labyrinth may be established by a groove or grooves along the outer circumferential surface of the lid and/or the corresponding inner surface of the cap part. In a particular embodiment, the capillary pipes are established by a groove or grooves along the outer circumferential surface of the lid and/or the corresponding inner surface of the cap part.

According to a further embodiment, the hydrophobic labyrinth further comprises a liquid impermeable and gas permeable membrane such as a GORE-TEX™ membrane or a similar membrane produced by another company.

As a further precautionary measure, the hydrophobic labyrinth optionally comprises a liquid impermeable and gas permeable membrane. Alternative, the canister includes such membrane.

According to a further embodiment, the hydrophobic labyrinth defines a liquid barrier of at least 70 mN/m and a gas permeability of more than 0.014 l/sec.bar.

The above values are typical barrier and permeability values suitable for allowing the interior of the canister to be free from beverage even in case the beverage container is shaken or put upside down.

It is understood that the pressure generating device can be used together with the filling methods described above.

The above need and the above object together with numerous other needs and objects, which will be evident from the below detailed description, are according to a further aspect of the present invention obtained by a self regulating and constant pressure maintaining beverage dispenser assembly comprising a dispensing device and a beverage container, the beverage container defining an inner space, the inner space constituting:

a beverage space filled with carbonated beverage and communicating with the dispensing device for allowing dispensation of the carbonated beverage, and a head space communicating with the beverage space and filled with $CO_2$ having an initial pressure of 0.1-3 bar above the atmospheric pressure when subjected to a specific temperature of 2° C.-50° C., preferably 3° C.-25° C. and more preferably 5° C.-15° C., the beverage dispenser assembly further comprising a pressure generating device as described above, the cylindrical neck part of the canister comprising a first screw thread encircling the cylindrical neck part along the upper neck portion and the lower neck portion, the lid defining a second screw thread for cooperating with the first screw thread of the neck part, the first screw thread and/or the second screw thread comprising a first and/or a second pressure relief vent, respectively, intersecting the first screw thread and/or the second screw thread, respectively, for allowing a gas flow through the first screw thread and/or the second screw thread when the lid is applied in a loose position to the cylindrical neck part, the canister communicating with the head space via the hydrophobic labyrinth and comprising a particular amount of adsorption material having adsorbed a specific amount of $CO_2$, the particular amount of adsorption material being inherently capable of regulating the pressure in the head space and capable of preserving the carbonisation of the carbonated beverage in the beverage space by releasing $CO_2$ into the head space via the hydrophobic labyrinth or by adsorbing $CO_2$ from the head space via the hydrophobic labyrinth, the specific amount of $CO_2$ being sufficient for allowing the head space to increase in volume and substituting the beverage space when the carbonated beverage having the specific temperature is being dispensed from the container by using the dispensing device and maintaining the initial pressure, or at least a pressure of 0.1-3 bar above the atmospheric pressure in the head space during the complete substitution of the beverage space by the head space.

By self-regulating is in the present context understood that the pressure regulation is inherent in the beverage dispensing assembly and that no external supply of gas is required. The pressure should be maintained in the beverage dispensing preferably without any substantial loss of pressure in the beverage space for avoiding the carbonated beverage from becoming flat. Since maintaining a constant pressure may require large volumes of adsorption material, it may in some cases be preferred to allow a certain pressure loss in the beverage space provided that a sufficient driving pressure remains for allowing an efficient beverage dispensing.

By self-regulating, the inherent pressure regulation is further established in accordance with and while maintaining the equilibrium of the beverage, i.e. without causing to any substantial extent any change in the beverage as such, also including the carbon dioxide content of the beverage, and in doing so preventing any change of the beverage, which change might else deteriorate the taste of the beverage. It is to be understood that the most critical issue in relation to pressure regulation in the beverage dispensing assembly is the preservation of the taste of the beverage or alternatively the elimination of any substantial change of the taste due to change of the content of carbon dioxide or any other constituent of the beverage.

The beverage container may preferably be blow moulded for allowing a large inner space in relation to the raw material usage. The inner space may in some cases be compartmentalised, such as a flexible inner bag defining the beverage space and a rigid outer container defining the head space between the inner bag and the outer container, also known from e.g. bag-in-keg and bag-in-box concepts, however, in most cases the inner space will be unitary. The beverage space is defined by the portion of the inner space which is filled with carbonated beverage. The dispensing device typically comprises a tapping line and a tapping valve. The tapping line may constitute an ascending pipe and/or a tapping hose. The tapping valve should normally be in a closed position preventing beverage dispensing except when beverage dispensing is desired where the valve should be temporarily shifted to an open position allowing a user-defined amount of beverage to flow from the beverage space via the dispensing device into a glass or the like supplied by the user and positioned close to the outlet of the tapping valve.

The head space is defined by the portion of the inner space which is not filled with beverage. The head space is typically located above the beverage space and is delimited from the beverage space by the surface of the carbonated beverage. The initial pressure in the head space should be elevated in relation to the outside atmospheric pressure for preserving the carbonisation of the carbonated beverage and preserving the equilibration of the carbonated beverage. It is contemplated that the pressure in the inner space is uniform, i.e. the pressure is equal in the head space and the beverage space. The initial pressure in the head space may range from 0.1-3 bar depending on the kind of carbonated beverage and the dispensing pressure needed for causing the beverage to flow out through the dispensing device. The initial pressure also influences the initial carbonisation of the beverage, i.e. a high initial $CO_2$ pressure causes the beverage to absorb more $CO_2$, which results in a high level of carbonisation of the beverage. It is contemplated that different kinds of carbonated beverages may have a different desired carbonisation level. Especially concerning beer, the initial carbonisation varies greatly between different kinds of beer.

The beverage temperature at the time of serving is typically slightly lower than room temperature in the range of 5° C.-15° C. for most carbonated beverages. To reach such temperatures, the beverage container may be stored in a cool storage room or refrigerator. The carbonated beverage contains water and $CO_2$, which is dissolved in the water. When the beverage temperature sinks, more $CO_2$ is allowed to dissolve in the water, and vice versa when the beverage temperature is elevated, the water may contain less $CO_2$ and consequently $CO_2$ is dissolved and causing a pressure increase in the beverage container. It is contemplated that the beverage container may be stored at temperatures differing from the typical serving temperatures. Such storing temperatures may typically range from about 2° C.-50° C.

The canisters provided for communicating with the head space may preferably be located inside the inner space of the beverage container, however, in some embodiments it may be preferred to locate the canisters outside the beverage container and connect the head space and the canister by a hose. The canister may e.g. be floating at the surface between the beverage space and the head space. The hydrophobic labyrinth is intended for preventing any beverage from accidentally entering the canister and for keeping the interior of the canister dry. The canister is filled with the adsorption material capable of adsorbing and releasing a large amount of $CO_2$ per volume unit when stored in a dry state. The adsorption material inside the canister should be primarily communicating with the head space, at least when the beverage container is in a stable position. However, since the head space is communicating with the beverage space, beverage may occasionally enter the head space, especially when the beverage container is moved. Beverage entering the canister and coming into contact with the adsorption material may significantly reduce the efficiency of the adsorption material. The hydrophobic labyrinth may e.g. be a membrane of a porous material or the like capable of preventing liquid communication and allowing gaseous communication between the adsorption material and the head space. Any number of canisters may be used, e.g. one large canister or alternatively a plurality of small canisters.

When the tapping valve is opened the pressure in the head space drives the beverage out of the beverage container, thereby reducing the beverage space and substituting it by the head space. As the volume in the head space is increased during beverage dispensing, the pressure is reduced, provided the beverage temperature is constant. The pressure in the head space is also slowly reduced during storage due to diffusion through the beverage container materials. Without the provision of the canister or canisters having adsorption material, the reduced pressure in the head space would cause less pressure for dispensing the beverage and finally an interruption of the beverage dispensing operation when the pressure has equalised between the inner space and the outside. A lower pressure inside the beverage space would also cause the $CO_2$ in the beverage to escape, causing the beverage to go flat and become unsuitable for serving. By providing canisters having the particular amount of adsorption material which is sufficient for allowing the adsorption material to adsorb a specific amount of $CO_2$ sufficient for substituting the complete beverage space without any significant pressure loss in the head space, the driving pressure as well as the carbonisation of the beverage is maintained. The driving pressure is understood to be the pressure difference between the inner space and the outside needed for dispensing the beverage. By choosing an adsorption material having a high adsorption capability, the canisters as well as the head space may be small in relation to the beverage space which will reduce the use of material. The adsorption material should have an inherent capability of both adsorbing and releasing $CO_2$ depending on the pressure in the head space. A reduction of the pressure in the head space will be immediately counteracted by the adsorption material inherently releasing $CO_2$ for substantially neutralising the pressure reduction, thereby preventing the carbonated beverage from going flat and maintaining the beverage driving pressure. In the present context, it is understood that a certain pressure loss is unavoidable during the complete dispensation of the beverage in the beverage container, however, by providing a sufficiently large particular amount of adsorption material and specific amount of $CO_2$, the pressure loss may be minimised for at least substantially maintaining the pressure. Additionally, for some beverages a larger pressure loss may be tolerated, as long as the driving pressure is sufficient. It should especially be noted that in contrast to the prior art, the present canisters will not require any mechanical pressure regulators of any kind, since the regulation is inherent in the adsorption material.

Although it is recommended to enjoy most beverages at a certain beverage-specific temperature, some consumers may like their beverage at a slightly different temperature than other consumers. In some cases proper cooling of the beverage container may not be available due to e.g. lack of refrigeration or cold storage. Since the beverage dispensing assembly typically will be portable, it is further contemplated that some users will transport it to locations having no cooling possibilities, such as public or private gardens, recreation areas, sports arenas, beaches etc. In case of temperature rise, the $CO_2$ of the carbonated beverage will release into the head space, causing a pressure rise in the head space. Such a temperature dependent pressure rise is well known among consumers of carbonated beverages and may lead to an undesired dispensing behaviour and spillage. In such cases, the adsorption material in the canister will counteract to neutralise the pressure rise by adsorbing the $CO_2$ released by the carbonated beverage. The canister will allow suitable beverage dispensing behaviour over a much broader temperature range than allowed by standard state of the art products by allowing re-adsorption of excessive $CO_2$.

It is evident that the handling of all parts of the beverage dispensing assembly should be performed in a sterile environment. Further, it is evident that the method of filling and the pressure generating device as described above may be used together with the assembly described above.

The above need and the above object together with numerous other needs and objects, which will be evident from the below detailed description, are according to a further aspect of the present invention obtained by a method of filling a canister with propellant gas by performing the following steps:

- providing a canister having a specific volume filled with activated carbon, the activated carbon having a first temperature,
- providing a volume of liquefied propellant gas at a second temperature and a first elevated pressure preventing the liquefied propellant gas from evaporating,
- evacuating the canister for creating a state of vacuum within the canister, thereby cooling the activated carbon to a third temperature, preferably lower than the second temperature,
- injecting the volume of liquefied propellant gas into the canister at a second elevated pressure preventing the liquefied propellant gas from evaporating, and
- allowing the liquefied propellant gas to evaporate and in doing so consuming energy as evaporation heat, the energy being generated due to the propellant gas being adsorbed by the activated carbon, thereby reducing the heating of the activated carbon.

The above method is a preferred alternative to the previously mentioned two step filling for avoiding self desorption or self destruction of the activated carbon. The canister is preferably completely filled by activated carbon. The volume of the canister should be significantly smaller than the volume of the beverage container in which the canister is to be mounted. Nevertheless, the amount of activated carbon should be sufficient for adsorbing an amount of carbon dioxide being sufficient for carbonizing and dispensing the beverage held in the beverage container. The activated carbon is held at a first temperature preferable being above room temperature in order to desorb any water vapor or oxygen which may have been adsorbed during transport and storage. Oxygen may be particular harmful to the beverage and may significantly shorten the shelf life of the product.

The liquefied propellant gas may comprise any element or compound which is in gaseous state at atmospheric pressure and room temperature but which is liquefied when being held at a temperature below room temperature and at a pressure above atmospheric pressure. In other words, the liquefied propellant gas is a condensed gas. The liquefied propellant gas should be non poisonous and preferably non flammable. The liquefied propellant gas should be stored under such pressure and temperature conditions allowing the liquefied gas to remain in a liquid state. The volume of liquefied propellant gas should be sufficient for being adsorbed by the activated carbon and, when in gaseous state, for carbonizing and dispensing the beverage stored in the beverage container.

By state of vacuum is meant a partial vacuum, i.e. a pressure significantly below atmospheric pressure. It is understood that the activated carbon should not be evacuated, but should remain in the canister. A dust filter may be employed in order to ensure that no active carbon escaped during evacuation. During evacuation, any significant amount gas remaining within the canister, either adsorbed by the activated carbon or remaining within the canister outside the activated carbon, will be removed. During evacuation the temperature of the activated carbon will sink, preferably to a temperature being equal to or below the temperature of the liquefied propellant gas.

The liquefied propellant gas is injected into the canister while ensuring that most of it remains in liquid state, thus the injecting is performed under high pressure. When the propellant gas has been injected, the canister may be sealed off in order to prevent the escape of any propellant gas. The liquefied propellant gas should not evaporate immediately upon contact with the activated carbon since the activated carbon is held at a low temperature. Nevertheless, some liquefied propellant gas will vaporize as the temperature increases and/or pressure decreases.

As the liquefied propellant gas vaporizes, it will consume energy as evaporation heat. This will cool the activated carbon. However, as the propellant gas is adsorbed by the activated carbon, energy is generated in the form of adsorption heat. The evaporation heat consumed, i.e. cooling generated, when the liquefied propellant gas vaporized will to a large extent compensate for the heating generated from adsorption of the carbon dioxide in the activated carbon, i.e. the heating of the activated carbon will be reduced compared to adsorbing propellant gas provided in gaseous form. Thus, all of the propellant gas may be adsorbed by the activated carbon without the activated carbon reaching its self desorption or self destruction temperatures.

According to a further embodiment, the liquefied propellant gas is liquefied $CO_2$. In case the canister is to be used together with a carbonated beverage it is an advantage to use CO2 as propellant gas since it will allow a carbonization of the beverage.

According to a further embodiment, the first temperature is between 0 and 500 degrees Celsius, preferably between 20 and 100 degrees Celsius, such as 20-30, 30-40, 40-50, 50-60, 60-70, 70-80, 80-90 or 90-100 degrees Celsius. A temperature in the range of about 40 degrees Celsius is preferable, since it will allow most of the water vapor and oxygen to desorb from the activated carbon According to a further embodiment, the second temperature is between −57 and −20 degrees Celsius, preferably between −50 and −40 degrees Celsius. The above temperature will allow the preferred propellant gas $CO_2$ to remain in liquid state at reasonable pressures, as seen in FIG. 19.

According to a further embodiment, the third temperature is between −50 and −100 degrees Celsius, such as −50-70 or −70--90 degrees Celsius. The above temperatures will prevent an instant evaporation of the liquefied propellant gas upon contact with the activated carbon, and thereby possible deterioration, of the activated carbon. Further, a low initial temperature of the activated carbon will help keeping it below the self desorption/self destruction temperature.

According to a further embodiment, the first elevated pressure and the second elevated pressure is between 5.11 bar and 80 bar absolute pressure, preferably between 6-10 bar, such as 6-7, 7-8, 8-9 or 9-10 bar absolute pressure. Preferably, a pressure slightly above 5.11 bar, being the lowest possible pressure for having $CO_2$ in liquid state, should be used in order to be able to use standard pressurization equipment.

According to a further embodiment, the canister defines a volume of between 0.1 and 5 liters, preferably between 0.2 and 1 liter, more preferably between 0.3 and 0.7 liters, such as 0.3-0.4 liters, 0.4-0.5 liters 0.5-0.6 liters or 0.6-0.7 liters. The above volumes constitute adequate sizes for pressurizing commercially available 5 liter "party kegs".

According to a further embodiment, the volume of liquefied propellant gas is between 1 ml and 10 ml, preferably between 2 ml and 7 ml, such as 2-3 ml, 3-4 ml. 4-5 ml. 5-6 ml, 6-7 ml or 3.7 ml. A volume of 3.7 ml of liquefied $CO_2$ will generate 23 liters of gas at room temperature and pressure. This will be adequate for dispensing 5-10 liters of beverage.

According to a further embodiment, the activated carbon comprises a specific volume of granulates, the granulates including a first group of granulates and a second group of granulates, the first group including granulates of a first size and the second group including granulates of a second size, the first size being at least ten times greater than the second size. Preferably, to be able to increase the adsorption capabilities of the activated carbon, two sizes of granulates are used as described in more detail above.

According to a further embodiment, wherein the specific volume of activated carbon within the canister defines a specific density of at least 0.45 kg/liter, preferably at least 0.50 kg/liter, most preferably 0.54 kg/liter. The applicant has found out that the specific density may be increased beyond 0.45 kg/liter by applying the above method.

According to a further embodiment, the canister is made by rigid plastics, such as PET. PET is suitable since it will allow the canister to withstand high pressures without deformation or leakage and at the same time being environmentally friendly disposable and safe for use tighter with food products.

According to a further embodiment, the volume of liquefied $CO_2$ corresponds to a gas volume at atmospheric pressure which exceeds the specific volume of the activated carbon by at least a factor 5, preferably a factor 10, more preferably a factor 20, most preferably a factor 50. Preferably, about 0.5 liters of activated carbon is used to store 25 liters of propellant gas.

According to a further embodiment, the first and second amount of propellant gas is adsorbed by the activated carbon during a time period not exceeding 10 seconds, preferably not exceeding 5 seconds. The above method will allow the adsorption to be performed in a short period of time such that an efficient production line may be achieved.

According to a further embodiment, the canister defining a body part and a cylindrical neck part, the body part defining an inner space, the cylindrical neck part defining an opening for allowing access to the inner space of the body part, an upper neck portion located adjacent the opening and a lower neck portion located adjacent the body part, the cylindrical neck part comprising a first screw thread encircling the cylindrical neck part along the upper neck portion and the lower neck portion, the canister further comprising a lid for sealing off the opening of the neck part, the lid defining a second screw thread for cooperating with the first screw thread of the neck part, the first screw thread and/or the second screw thread comprising a first and/or a second pressure relief vent, respectively, intersecting the first screw thread and/or the second screw thread, respectively, for allowing a gas flow through the first screw thread and/or the second screw thread when the lid is applied in a loose position to the cylindrical neck part, the lid initially being applied onto the cylindrical neck part in the loose position by allowing the first and second screw threads to partly engage while maintaining gaseous communication between the inner space of the canister and the outside via the first and/or second pressure relief vents, the volume of liquefied propellant gas being injected via the pressure relief vents, the method comprising the final step of fastening the lid onto the neck part in a sealed position by allowing the first and second screw threads to engage further for causing the lid to seal the opening and preventing gaseous communication between the inner space of the canister and the outside. The filling may preferably be made according to the above method which has been explained in more detail above.

The above need and the above object together with numerous other needs and objects, which will be evident from the below detailed description, are according to a further aspect of the present invention obtained by a canister produced according to the method of any of the claims 1-14, the canister having an internal pressure between 1 and 3, such as 1-2, 2-3 or about 2 bar above atmospheric pressure when at room temperature. A dispensing pressure of about 2 bar above atmospheric pressure will ensure proper dispensing conditions.

BRIEF DESCRIPTION OF THE DRAWINGS

FIGS. 2A-2D are a series showing the filling and dispensing of beverage using a beverage-dispensing system according to the present invention.

FIGS. 9A1-9D2 are a series showing different operational modes of further handle assemblies according to the present invention.

FIGS. 10A-10C are an exploded view of a cap part according to the present invention showing the gas flow and the beverage flow there through.

FIGS. 12A1-12D2 are a series showing cool and warm states of embodiments of beverage dispensing systems according to the present invention.

DETAILED DESCRIPTION OF THE FIGURES

Figure 1A:
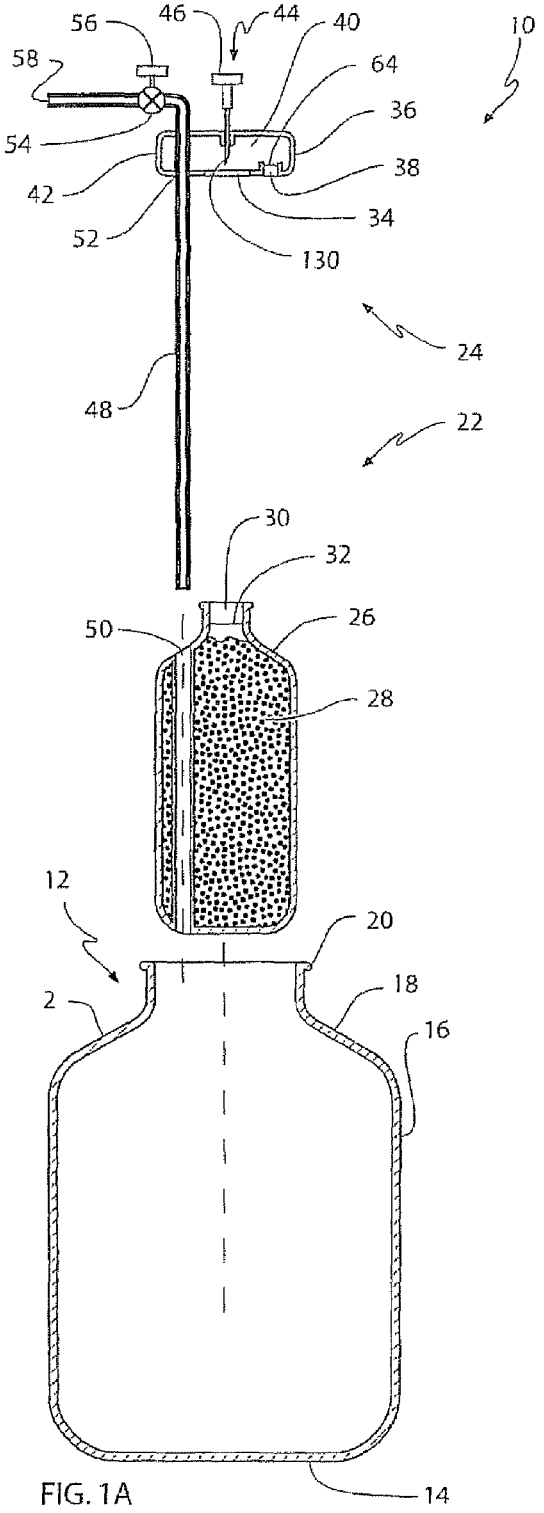
FIGS. 1A-1B show a first embodiment of a beverage-dispensing system according to the present invention.

FIG. 1A shows a beverage-dispensing system 10 according to the present invention. The beverage dispensing system 10 includes a container 12. The container 12 comprises a bottom part 14, a cylindrical wall part 16, a shoulder part 18 and a mouth part 20 constituting an opening for accessing the interior of the beverage container 12, which interior defines an inner space. The container 12 is preferably made of disposable and/or combustible materials such as plastic materials. Alternatively, other materials such as glass, metal, cardboard or a combination of the above materials may be used. Preferably, the entire beverage-dispensing system is made of single use plastic materials which may be recycled in an environment-friendly way by combustion. The size of the beverage container 12 may range from about 0.5 liters or 1.0 liters for smaller containers intended for one person only, up to 20 liters, 40 liters, 50 liters or more for containers intended for professional beverage-dispensing establishments such as bars, restaurants and the like. Preferably, the size of the beverage container 12 is in the range of 5 to 10 liters in the form of a mini-keg or party-keg for use in connection with smaller social events such as parties.

The beverage-dispensing system 10 further includes a pressure-generating device 22. The pressure-generating device 22 comprises a dispensing device 24 and a canister 26. The canister 26 is filled with pressurized carbon dioxide gas, which has been adsorbed by granulates of activated carbon 28. The canister 26 comprises an opening 30, which is sealed by a burst membrane 32. The width of the canister 26 corresponds to the width of the mouth 20 of the beverage container 12 so that the canister 26 may be easily inserted and accommodated inside the beverage container 12. The canister 26 may be of blow molded plastic similar to the container 12. The opening 30 of the canister 26 cooperates with a gas inlet 34 of a cap part 36 of the dispensing device 24. The cap part 36 comprises a gas outlet 38 in fluid communication with the gas inlet 34 via an outer chamber 40 of the cap part 36. The cap part 36 further comprises a circumferential wall 42 having a width equal to or slightly larger than the width of the mouth 20 of the beverage container 12. The cap part 36 further comprises a piercing element 44. The piercing element 44 comprises a knob 46 located outside the cap part 36, and a needle 130 located inside the cap part 36, which needle 130 is oriented towards the gas inlet 34.

The dispensing device 24 further comprises a dispensing line 48. The dispensing line 48 extends through a channel 50 of the canister 26 and further to a first passage 52 of the cap part 36 to a dispensing valve 54 located outside the cap part 36. The dispensing valve 54 is controlled by a tapping handle 56. The handle 56 is operable between a non-beverage-dispensing position in which the dispensing valve 54 is closed and beverage dispensing is prevented, and a beverage-dispensing position in which the dispensing valve 54 is in an open position, allowing beverage to flow from the beverage container 12 through the dispensing line 48 to a beverage spout 58.

Figure 1B:
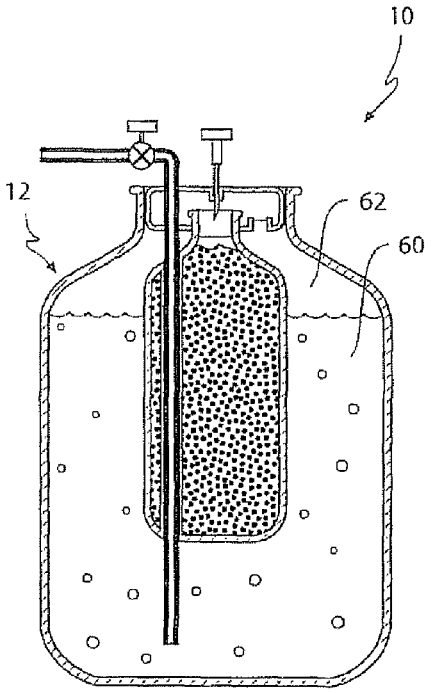

FIG. 1B shows a beverage-dispensing system 10 when the pressure-generating device 22 has been installed at the mouth 20 of the beverage container 12. The circumferential wall 42 fixates against the mouth 20 of the container 12 by subjecting the mouth 20 of the container 12 to an outwardly directed force in order to seal the cap part 36 securely onto the beverage container 12. The beverage container 12 has previously been filled with a beverage 60 preferably a carbonated beverage such as beer. The canister 26 is located inside the container 12 and the opening 30 of the canister 26 is attached to the gas inlet 34 of the cap part 36. The gas outlet 38 and the outer chamber 40 of the cap part 36 are in fluid communication with a headspace 62 located above the beverage 60 in the vicinity of the shoulder part 18 of the container 12. The outer chamber 40 thereby constitutes a second passage through the cap part 36. The gas outlet 38 is sealed by a gas-permeable membrane 64 which is liquid-impermeable and constituted by e.g. a Gore-Tex® membrane. The beverage-dispensing system 10 as shown in FIG. 1B is in the state in which it is distributed to the customers.

FIG. 2A shows the filling of the beverage container 12. The beverage container 12 is filled by introducing a hose into the mouth 20 of the beverage container 12 and filling the interior of the beverage container 12 by beverage 60 to a level of about 80% for allowing the remaining 20% of the beverage container to accommodate the pressure generating device 22 and the establishment of a small head space. FIG. 2A further shows the pressure generating device 22 being stored in a pressurized carbon dioxide environment indicated by a box. The pressure generating device is thereby charged by a specific amount of carbon dioxide which is capable of pressurizing the beverage container 12 and substituting the beverage 60 during subsequent dispensing.

FIG. 2B shows the beverage dispensing system when the pressure generating device 22 has been introduced into the beverage container 12. The pressure generating device includes the cap part 36 for sealing the mouth 20 and the canister 26 including activated carbon.

FIG. 2C shows the activation of the pressure-generating device 22 of the beverage-dispensing system 10. Activation should take place at a user location such as a bar, a restaurant, a private home or the like, immediately before the first beverage dispensing operation. The user such as a bartender or a private user may push the knob 46 of the piercing element 44 downwardly towards the cap part 36 as shown by the first arrow to cause the needle 130 of the piercing element 44 to rupture the sealing membrane 32 of the opening 30 of the canister 26. When the sealing membrane 32 has been ruptured, gaseous communication is established between the interior of the canister 26 and the head space 62 of the beverage container 12 via the gas inlet 34 (FIG. 1A), the outer chamber 40 and the gas outlet 38 as shown by the second arrow. The gas-permeable membrane 64 allows carbon dioxide to escape from the canister 26 and enter the headspace 62 while preventing any beverage 60 from entering the outer chamber 40 of the cap part 36 or the interior of the canister 26.

FIG. 2D shows beverage-dispensing by using the beverage-dispensing system 10 according to the present invention. By pressing the handle 56 (as shown by the downwardly oriented arrow) beverage can be caused to flow out of the beverage spout 58 and into a beverage glass 66. By pressing the handle 56 as shown by the first arrow, the dispensing valve 54 is operated from the non-beverage-dispensing position to the beverage-dispensing position. The pressure in the headspace 62 of the beverage container 12, being in the range of 1.5-10 bars above atmospheric pressure, typically being 6-8 bars above atmospheric pressure, causes the beverage to enter the dispensing line 48 close to the bottom 14 of the beverage container 12 as shown by the arrow and to proceed upwardly through the channel 50 of the canister 26 and through the first passage 52 of the cap part 36 to the outside of the beverage container 12 via the open dispensing valve 54 through the beverage spout 58. As the beverage 60 is being dispensed through the dispensing line 48, the pressure in the headspace 62 will decrease, which would cause the dispensing pressure to decrease as well. This is prevented by the release of carbon dioxide from the activated carbon 28 of the canister 26. Carbon dioxide gas will flow from the canister 26 as shown by the arrow into the headspace 62, thereby minimizing the pressure loss inside the headspace 62 so that a pressure of at least about 2-3 bars may be maintained until substantially all of the beverage 60 has been dispensed through the dispensing line 48.

Figure 3:
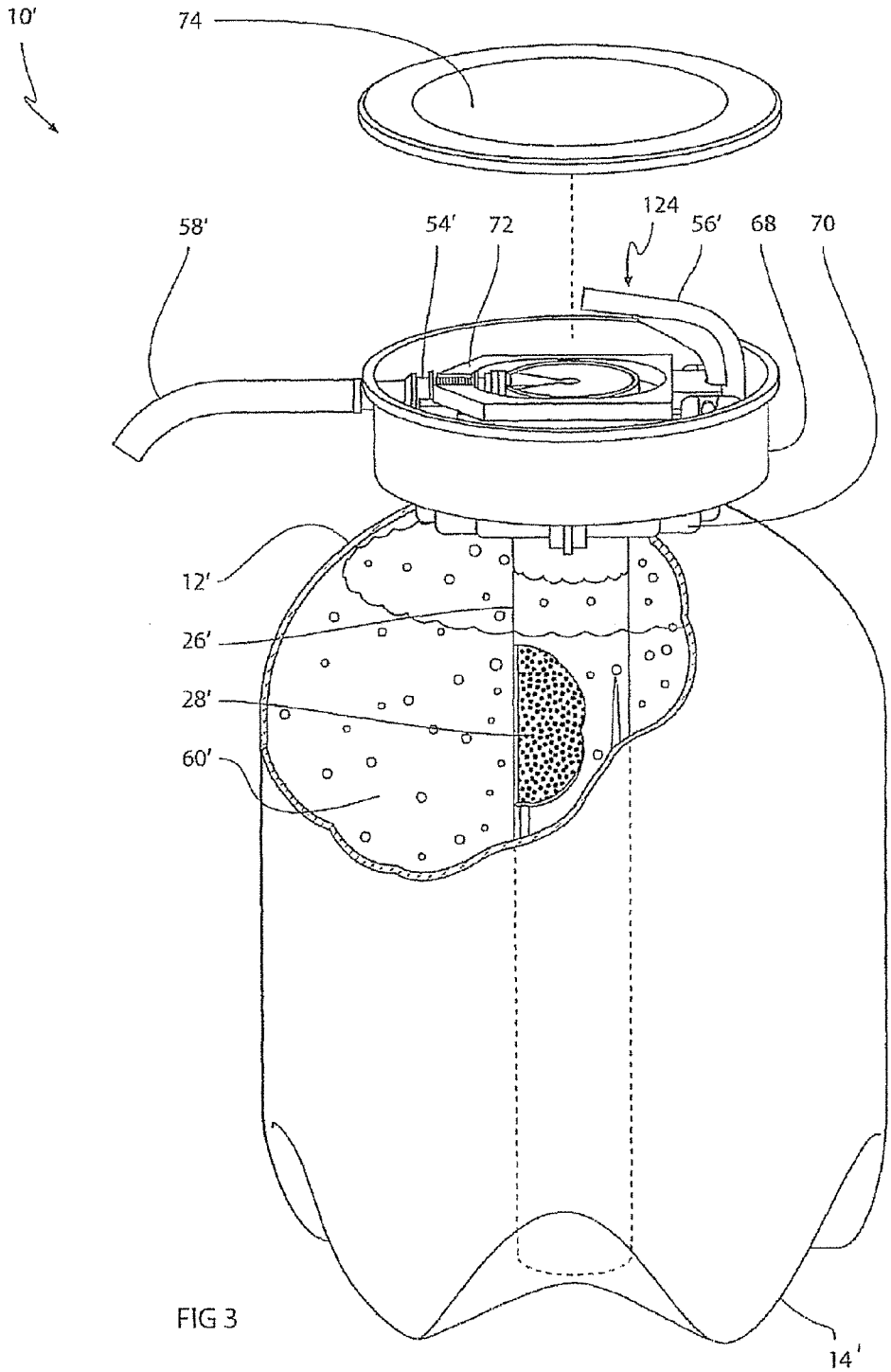
FIG. 3 is a perspective view of a further embodiment of beverage-dispensing system according to the present invention.

FIG. 3 is a perspective view of a beverage-dispensing system 10' being a presently preferred embodiment. The container 12' is similar to the container 12 as described in the previous embodiment, however, it features a corrugated bottom 14' which is intended to establish a secure and stable position of the beverage container 12' onto a substantially flat surface such as a table, desk or bar counter. Alternatively, a rounded bottom may be used together with a base, as will be shown later. It is also well-known in the field of container manufacture that in order to produce a container having a maximized volume with respect to the amount of material used for the manufacture of the beverage container, the height vs. the width of the beverage container should establish a ratio of approx. 1. By keeping the ratio between the height and the width, i.e. the diameter, of the beverage container near 1, the beverage container 12' will also assume a stable position, the beverage container 12' will have a shape which is easy to transport and have an attractive appearance. The beverage-dispensing system 10' further comprises a circular base part 68 fixed to the mouth (not shown here) of the container 12'. The base part 68 is additionally supported by a support 70. The beverage-dispensing system 10' further features a removable beverage spout 58' and a removable tapping handle 56'. The tapping handle 56' is connected to an actuation member 72 which in turn is connected to a tapping valve 54', all of which form parts of a handle assembly 124. The beverage spout 58' and the tapping handle 56' may be removed and stored inside the base part 68 during transport of the beverage-dispensing system 10'. During transport, the base part 68 may be closed off by a hood 74 for keeping the interior of the base part 68 clean and for preventing loss of the removable parts, viz. the handle 56' and the beverage spout 58'. When the user is ready to start beverage dispensing operations, the hood 74 may be removed and optionally used for the purpose of a drip tray at the user location. Subsequently, the handle 56' is attached to the actuation member 72, and the beverage spout 58' is attached to the dispensing valve 54'.

Figure 4:
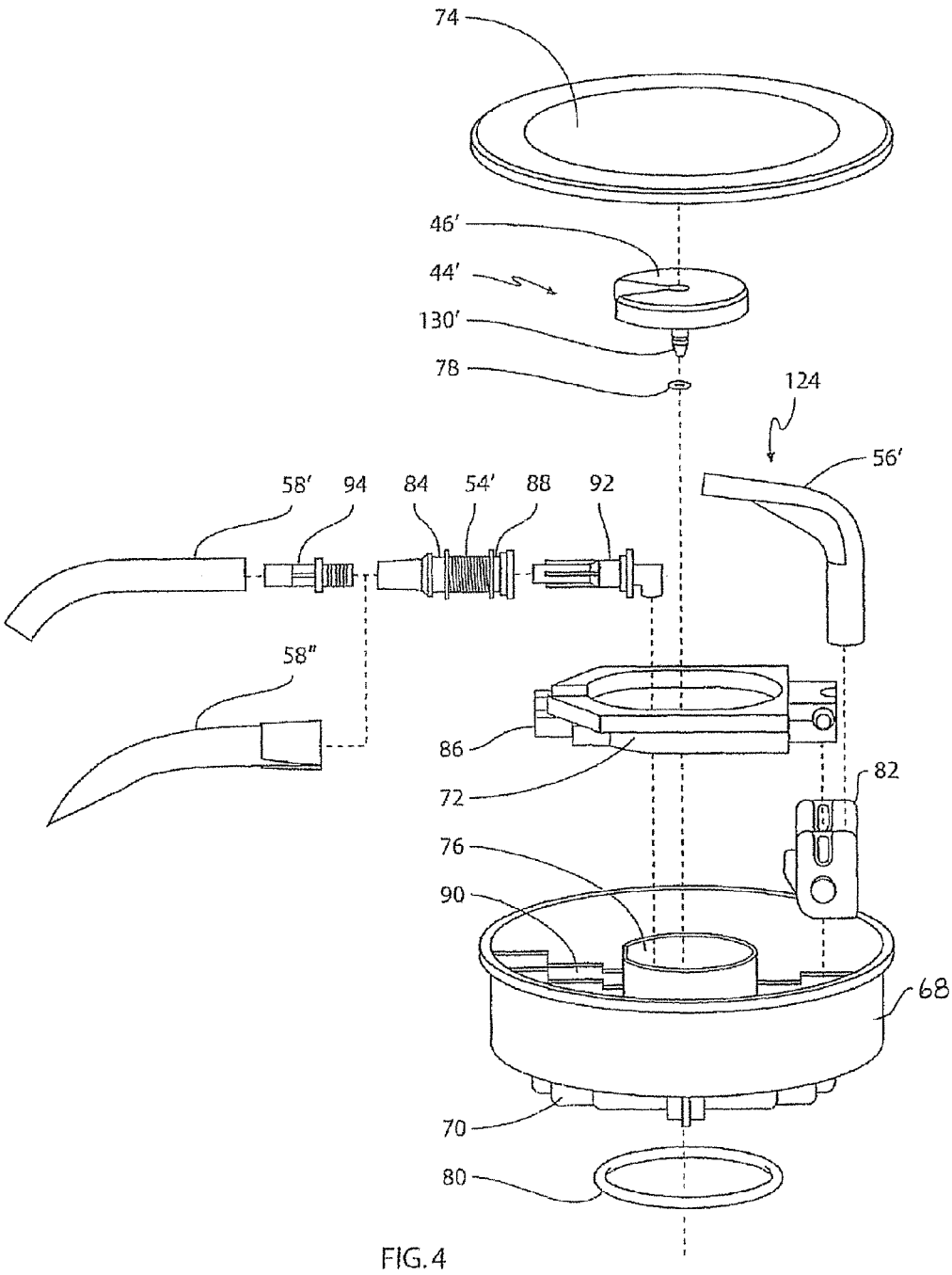
FIG. 4 is an exploded perspective view of a base part and handle assembly according to the present invention.

FIG. 4 is an exploded perspective view of the base part 68 of FIG. 3 and in particular showing the handle assembly 124. The base part 68 comprises a centrally located aperture 76. Inside the aperture 76 a piercing element 44' is accommodated. The piercing element 44' comprises an upwardly oriented knob 46' and a downwardly oriented needle 130'. The needle 130' is sealed to the bottom wall of the base part 68 by a small O-ring 78. The lower wall of the base part 68 is further sealed to the mouth 20 of the beverage container 12 (not shown) by a large O-ring 80.

The actuation member 72 is situated outside the aperture 76 and mechanically interconnects the dispensing valve 54' and a connecting part 82, which connecting part 82 is pivotally connected to the base part 68. The connecting part 82 is further connected to the handle 56'. By pressing the handle 56' downwardly towards the beverage container 12', the connecting part 82 will be pivoted towards the dispensing valve 54'. Since the actuation member 72 is connected to the connecting part 82, the actuation member 72 will perform a translatory movement towards the dispensing valve 54'. The tapping valve 54' has a first projection 84 cooperating with a fork 86 of the actuation member 72. The valve 54' further comprises a second projection 88 cooperating with a step 90 of the base part 68. By operating the handle 56', the dispensing valve 54' will thus be expanded, allowing a fluid passage through the dispensing valve 54'. The dispensing valve 54' is in fluid communication with on the one side a dispensing line part 92 providing fluid communication between the dispensing valve 54' and the aperture 76, and on the other side a connector 94 providing fluid communication between the dispensing valve 54' and a beverage spout 58'. The spout may either be of a standard tubular type as shown under reference numeral 58' or alternatively of an improved, drip free, type designated the reference numeral 58". The improved spout 58" will be explained in more detail in connection with FIG. 10. It should be noted that in case the improved spout 58" is used, the connector 94 may be omitted.

Figure 5A:
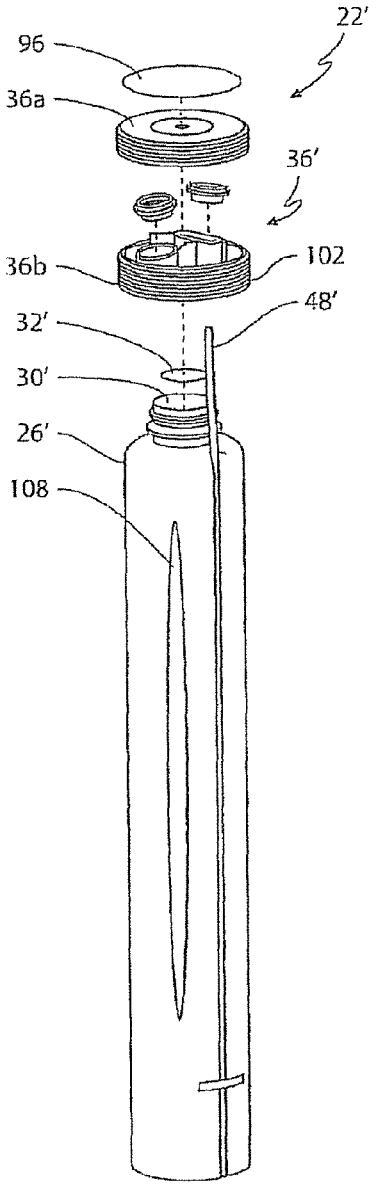
FIGS. 5A-5B are a perspective views of a pressure-generating device according to a preferred embodiment of the present invention.

FIG. 5A shows a preferred embodiment of a pressure-generating device 22' according to the present invention. The pressure-generating device 22' comprises a canister 26' and a dispensing device 24' constituting a cap part 36'. A dispensing line 48' is fixated to the outside of the canister 26' and extends from the bottom of the canister 26' to the top of the canister 26'. The canister 26' is filled with activated carbon and carbon dioxide, and the opening 30' of the canister 26' is sealed by a sealing membrane 32'. The filling and sealing process will be explained in more detail in the subsequent FIGS. 6A to 6D.

The cap part 36' is divided into an upper cap part **36*a* and a lower cap part 36*b*, the upper cap part 36*a* further comprising a pierceable membrane 96. The cap part 36'** will be explained in more detail below.

Figure 5B:
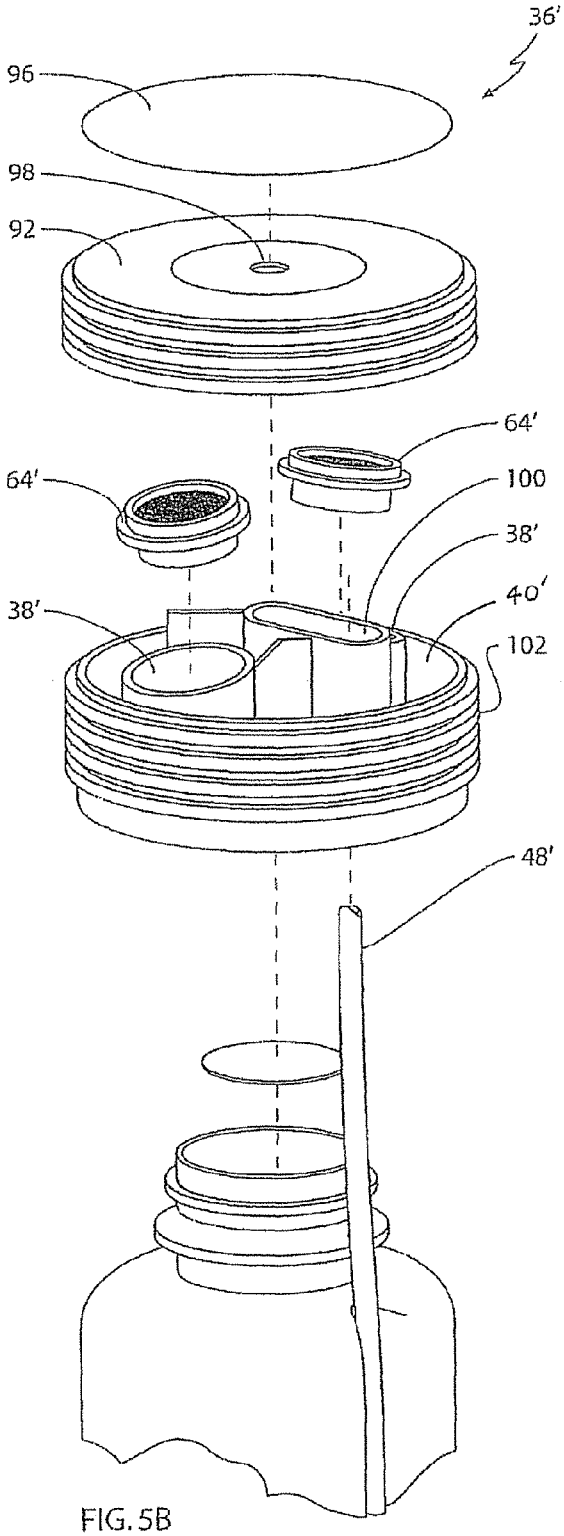

FIG. 5B shows a close-up perspective view of the cap part 36' of FIG. 5A. As previously explained, the cap part 36' comprises an upper cap part **36*a* and lower cap part 36*b*. The upper cap part 36*a* comprises a hole 98 for accessing an inner chamber 100 of the cap part 36'. The hole 98 is covered by a pierceable membrane 96 which is applied on top of the upper cap part 36*a*. The inner chamber 100 is surrounded by an outer chamber 40' constituting a second fluid passage, and full communication is prevented between the inner chamber 100 constituting the second fluid passage and the outer chamber 40' constituting the first fluid passage. The lower cap part 36*b* further comprises two separate gas outlets, both being designated the reference numeral 38'. Each of the gas outlets 38' is covered by a gas-permeable membrane, both membranes being designated the reference numeral 64'. Each of the gas-permeable membranes allows gaseous communication between the outer chamber 40' and the outside of the lower cap part 94 intended to face the interior of the beverage container (not shown here). The upper part of the dispensing line 48' is in fluid communication with the inner chamber 100 of the cap part 36'. When the upper cap part 36*a* is connected to the lower cap part 36*b* to form the cap part 36', the inner chamber 100 and the outer chamber 40' are completely separated. The circumferential wall of the cap part 36' is provided with sealing lips 102**.

When the cap part 36' is assembled onto the opening 30' of the canister 26', two fully separated fluid passages are established. The fluid passages comprise a first fluid passage from the opening 30' of the canister 26' via the outer chamber 40' to the gas outlet 38', the opening 30' being sealed off by the sealing membrane 32' and the gas outlet 38' being sealed off for liquids by the gas-permeable membrane 64'. A second fluid passage is formed from the dispensing line 48' through the inner chamber 100 of the cap part 36' to the hole 98. The hole is sealed by the pierceable membrane 96, Thus, the first fluid passage is intended for carbon dioxide gas and the second fluid passage is intended for beverage. The first fluid passage is established by bursting the sealing membrane 32' and the second fluid path is established by piercing the pierceable membrane 96. The establishment of the fluid path is understood as an activation of the beverage dispensing system, i.e. making the fluid passages ready for use.

Figure 6D:
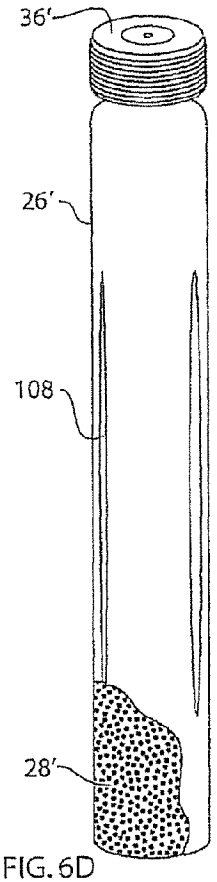
FIGS. 6A-6D are a series showing a first step of installing a pressure-generating device onto a beverage dispensing system according to the present invention.
Figure 6C:
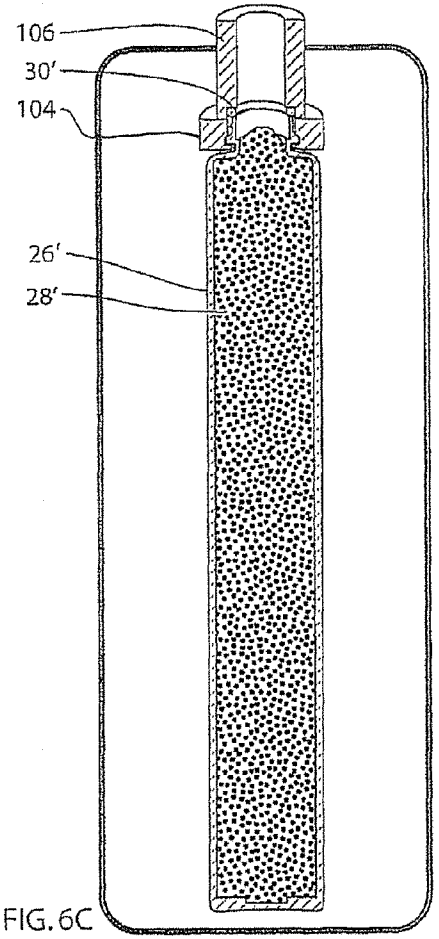
Figure 6B:
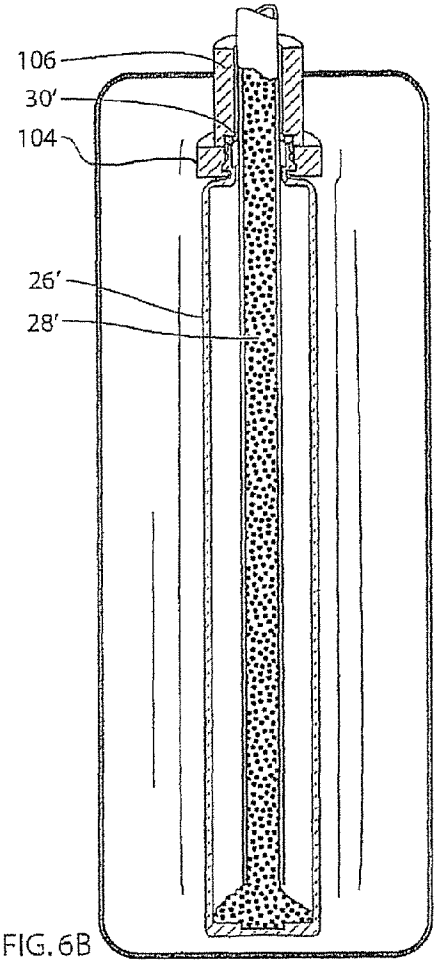
Figure 6A:
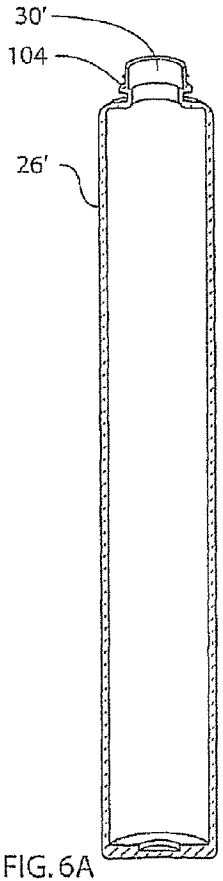

FIG. 6A shows an empty canister 26' for a pressure generating device. The canister 26' has an opening 30 having a rim 104. The canister 26' may be blow moulded and preferably being made of a flexible plastic material such as PE, PP, PET or the like.

FIG. 6B shows the filling of the canister 26' with activated carbon, the activated carbon being designated the reference numeral 28'. During the filling process, the canister 26' is optionally kept within a filling chamber indicated in the figure by a box. The filling chamber contains pressurized carbon dioxide gas at a pressure of preferably 2 to 3 bars. In case the canister 26 is not kept within carbon dioxide atmosphere, the canister must initially be drained of all oxygen and flushed by carbon dioxide. The filling of the oxygen free canister comprises a first step in which a filling nozzle 106 is fixed and sealed to the rim 104 the opening 30' of the canister 26'. In the next step, the activated carbon 28' is introduced into the canister 26' while the canister 26' is kept vibrating or shaking (shown in the figure by parallel lines) for allowing the activated carbon 28' to be packed uniformly and avoiding any bubble formation or cavity formation within the activated carbon 28' inside the canister 26'.

FIG. 6C shows the canister 26' inside the filling chamber (indicated by a box) after the canister 26' has been completely filled with activated carbon. Subsequent to the filling with activated carbon 28', pressurized carbon dioxide gas is introduced into the canister 26' and is adsorbed by the activated carbon 28'. In the present context, the applicant has found that a filling pressure of about 2 to 3 bars will allow a suitable amount of carbon dioxide to be adsorbed by the activated carbon 28' without allowing the activated carbon 28' to self-heat by exothermal process resulting from the adsorption of carbon dioxide. In case higher filling pressures are used, the self-heating will result in a temperature above the de-adsorption, self-ignition or self-destruction temperature of the activated carbon 28'. In the present context, it is understood that suitable dispensing pressure are achieved around 5 to 6 bars, and thus a second filling with carbon dioxide gas will be required at a later stage.

FIG. 6D shows the canister 26' in its finished state. After the pressurization of the canister 26' inside the filling chamber 104, the cap part 36' is attached to and seals off the opening 30' of the canister 26'. Thereafter, the canister 26' may be removed from the filling chamber 104 and be allowed to cool down to ambient temperatures. The canister 26' as shown in FIG. 6D may then be stored or transported to a separate station where it is installed in a beverage container (not shown). The previously mentioned sealing membrane of the cap part 36' (not shown here) prevents the carbon dioxide to leak to the outside. The canister 26' is provided with inwardly folds 108 which will be explained in more detail later.

Figure 7A:
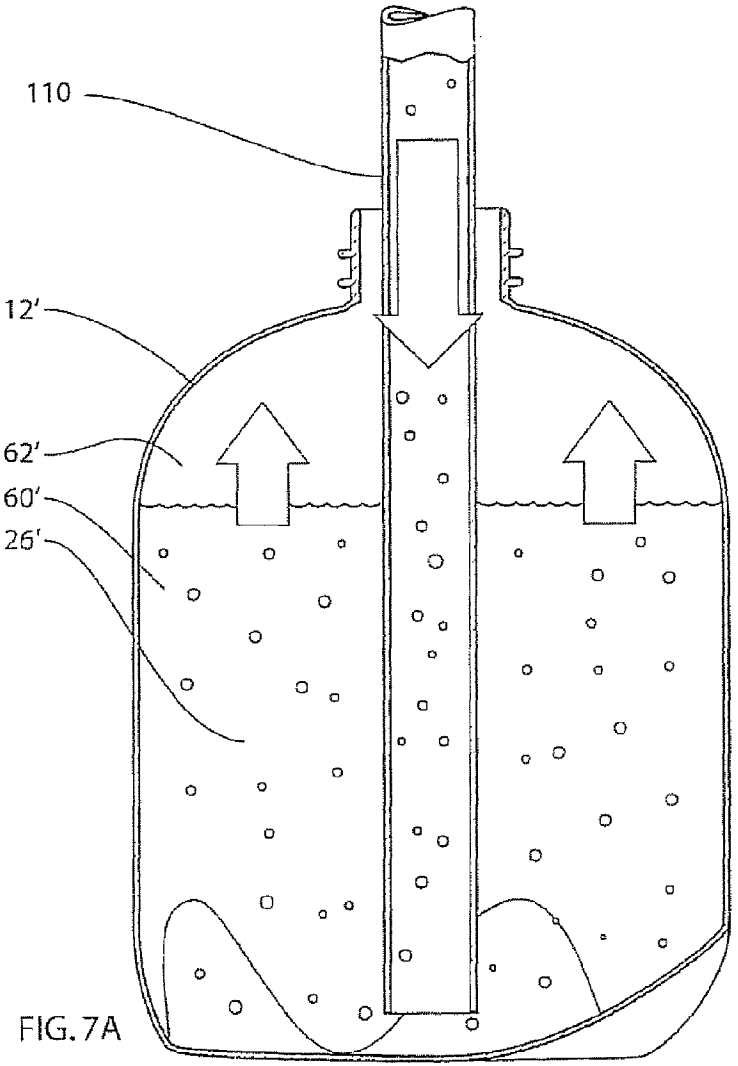
FIGS. 7A-7D are a series showing a second step of installing a pressure-generating device onto a beverage dispensing system according to the present invention.

FIG. 7A shows the filling of a beverage container 12'. The beverage container 12' is filled by introducing a filling pipe 110 through the mouth 20' of the beverage container 12', forming within the beverage container 12' a volume of beverage 60' and a headspace 62'. When the beverage-filling process is finished, the beverage 60' constitutes between 75 and 85 percent of the volume of the beverage container 12', while the headspace 62' constitutes the remaining 15 to 25 percent of the volume of the beverage container 12'. The applicant performed laboratory tests using a beverage container 12' of 6 l which was filled with 5 l of beer. After the filling, the filling pipe 110 is withdrawn.

Figure 7C:
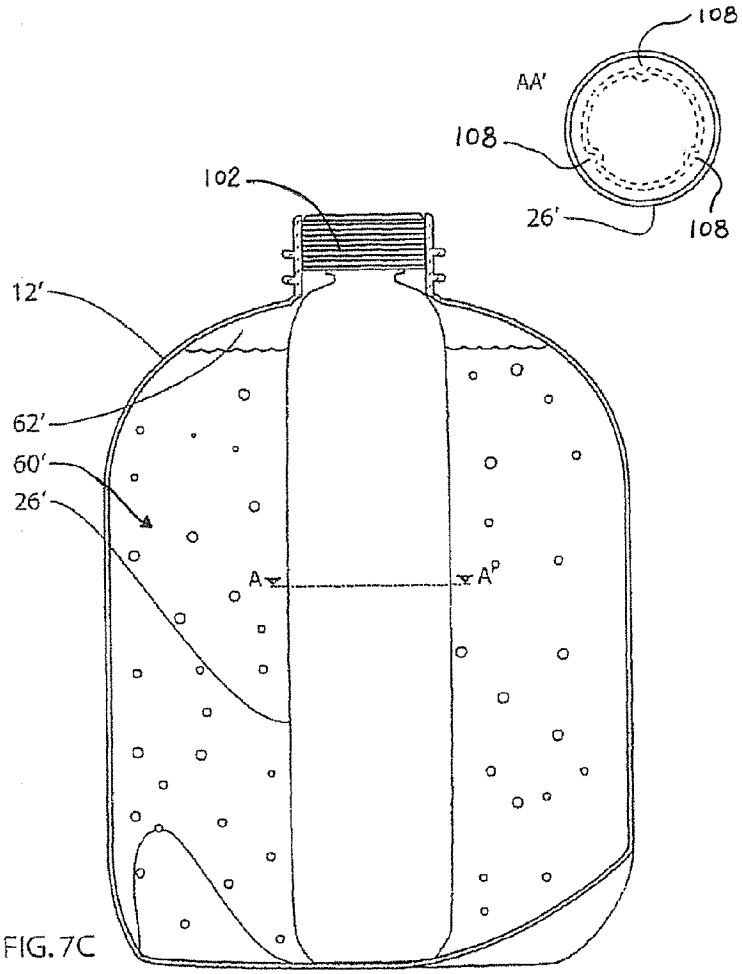
Figure 7B:
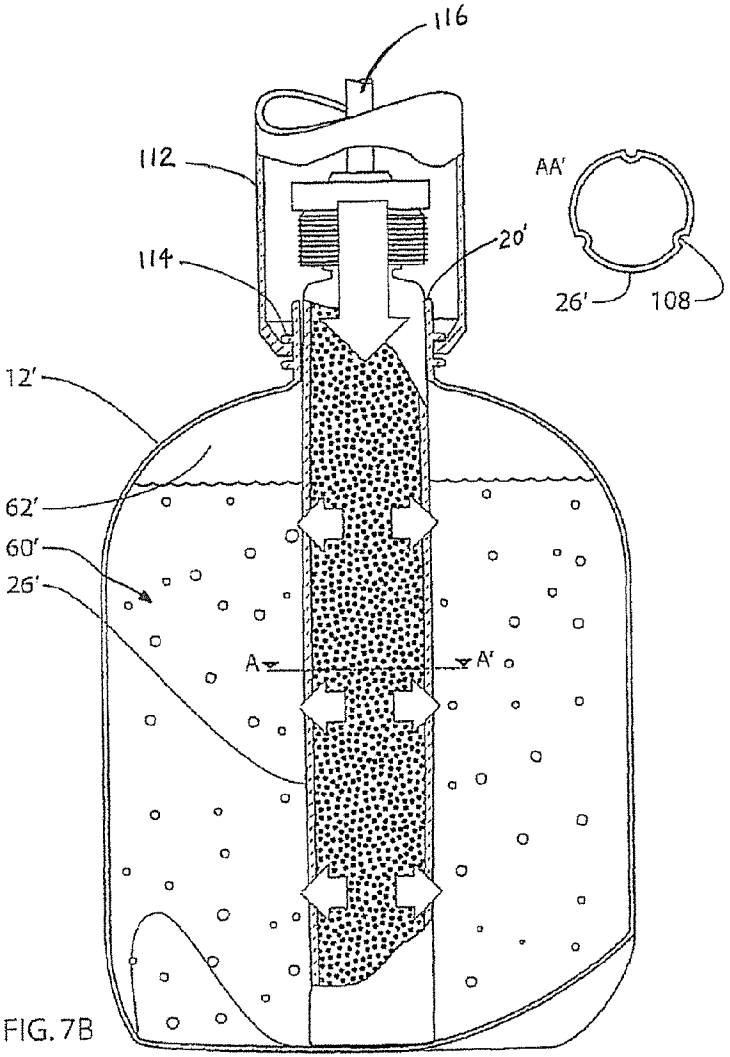

FIG. 7B shows the introduction of the canister 26' into the beverage container 12' and the capping of the beverage container 12'. The width of the canister 26 should be slightly smaller than the width of the mouth 20' of the beverage container 12' for allowing a gas flow from the outside to the inside of the beverage container 12'. The beverage container 12' is then fixed to a pressure station nozzle 112 by using a circumferential flange 114 of the beverage container 12'. The beverage 60', the headspace 62' and the canister 26' are thereafter subjected to a pressure of approx. 5 to 8 bars of carbon dioxide gas. The gas pressure may optionally be used to carbonize the beverage, however, typically the beverage is a pre-carbonized beverage. The carbon dioxide pressure will cause the sealing membrane 32' to burst and allow carbon dioxide to flow into the canister 26' via the second flow path (in the reverse direction). The carbon dioxide gas entering the canister 26' through the cap part 36' will be adsorbed by the activated carbon stored inside the canister 26'. Since the canister 26' has been pre-loaded with carbon dioxide of 2 to 3 bars, the additional carbon dioxide gas being adsorbed by the activated carbon will cause the activated carbon to assume a temperature below the de-adsorption, self-ignition or self-destruction temperature of activated carbon. Not using this two-step carbonated gas filling process by quick filling of pressurized $CO_2$ of above 4 bars may cause the activated carbon to self heat to a temperature above the de-adsorption, self-ignition or self-destruction temperature. With de-adsorption temperature is meant the temperature at which the activated carbon will lose its ability to adsorb carbon dioxide and release any carbon dioxide previously adsorbed. In case the de-adsorption temperature is reached the amount of carbon dioxide storable inside the canister 26' will not be sufficient to regulate the pressure inside the headspace 62' of the beverage container 12'. The expression self-heat is used to describe the exothermal process occurring when pressurized gas is adsorbed by the activated carbon.

It should be noted that the height of the canister 26' exceeds the height of the beverage container 12'. In order to be able to store a sufficient amount of activated carbon and carbon dioxide gas inside the canister 26' while keeping the mouth 20' of the beverage container 12' as small as possible, and the dimensions, i.e. the height-to-width ratio, of the beverage container 12' as beneficial as possible with respect to the volume of the beverage container 12', it is necessary to allow the canister 26' to be longer than the beverage container 12' in an initial state.

By introducing a rod 116 onto the cap part 36', a downward pressure may be applied onto the cap part 36' in order to reduce the height of the canister 26'. During tests, the applicant has applied a pressure force of approx. 1 kN. Since the bottom of the canister 26' is juxtaposing the bottom 14 of the beverage container 12' and the canister 26' is filled by activated carbon which is non compressible, the canister 26' must increase its width as shown by the arrows. The activated carbon 28' is constituted by very fine granulates, thus being flowable similar to a liquid. The activated carbon is thus uncompressible, and the reduction of the height of the canister 26' will cause an increase to the width of the canister 26'. In order to prevent any ruptures in the canister 26', the canister 26' is provided with folds 108 which when subjected to a pressure will fold out, allowing the canister 26' to assume a larger width. This will be explained in more detail below.

Also shown in connection with FIG. 7B is a cross-section of the canister 26' prior to being subjected to the compression by the rod 116. The folds 108 (FIG. 6D) are clearly shown to face inwardly, allowing a smaller width of the canister 26' and the ability the canister 26' of being introduced through the mouth 20' of the container 12'. This will allow a smaller diameter of the mouth 20' and consequently less leakage etc.

FIG. 7C shows the beverage container 12' when the cap part 36' has been introduced into the mouth 20' of the beverage container 12'. The cap part 36' is equal to or slightly larger than the mouth 20' of the beverage container 12', causing the cap part 36' to be clamped securely inside the mouth 20'. The applicant has performed tests showing that the cap part 36' will remain inside the mouth 20' at least up to a pressure of 7 bars before popping out. The maximum pressure allowed is depending on the pressure in the container 12' and the friction between the mouth 20' of the container and the sealing lips 102 of the cap part 36'. Similar caps have been known for a long time in relation to the manufacture and bottling of champagne. As can be further seen from FIG. 7C, the width of the canister 26' now exceeds the width of the mouth, and the headspace 62' is now significantly reduced.

Also shown in connection with FIG. 7C AA' is the cross-section of the canister 26' after it has been compressed. The state of the canister 26' before it has been compressed is illustrated by dashed lines. It can be clearly seen that after the compression the cross-section of the canister 26' has increased and the folds 108 have been unfolded and are thus not present as folds anymore. Alternatively, as shown in figures, the folds 108 may still be present, but extend in an outward direction after the compression of the canister as opposed to the situation before compression, where the folds 108 were protruding inwardly.

Figure 7D:
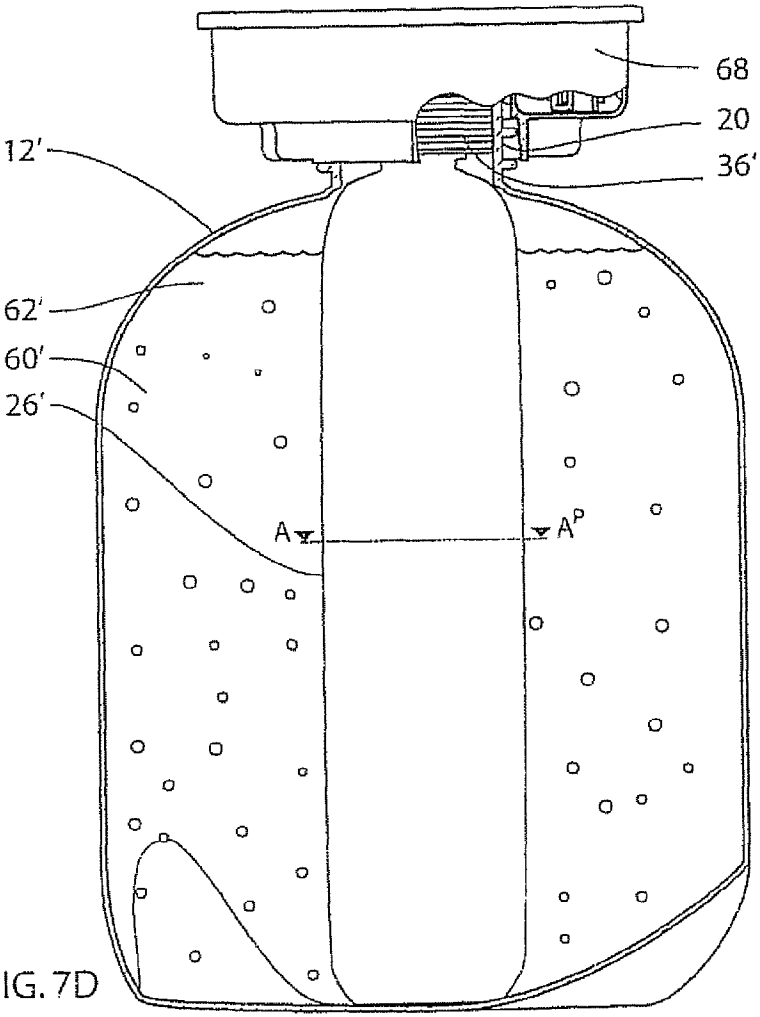

FIG. 7D shows the beverage dispensing system 10' after the cap part 36' has been installed into and sealing the mouth 20 and the base part 68 has been installed and sealed around the mouth 20.

Figure 8A:
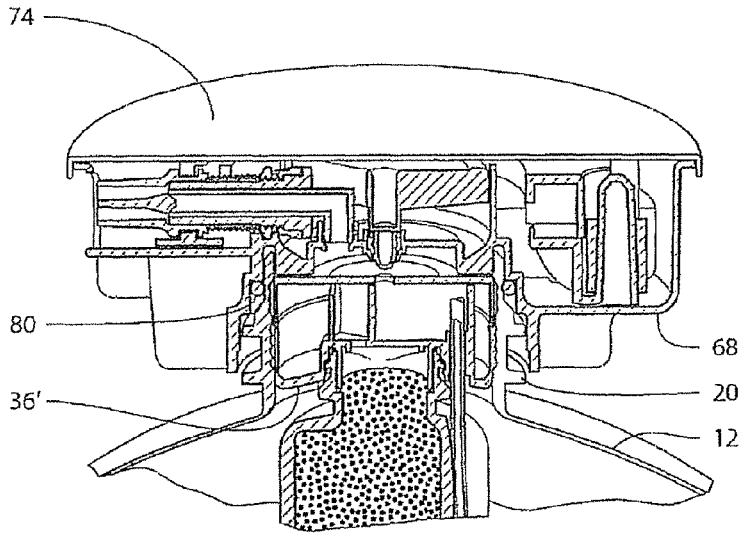
FIGS. 8A-8D are a series showing the tapping of beverage using a handle assembly of a beverage dispensing system according to the present invention.

FIG. 8A shows the base part 68 of FIG. 4 when installed onto the mouth 20 of the beverage container 12. The base part 68 is installed after the cap part 36' has been applied. The base part 68 is sealed onto the mouth 20 by a large o-ring 80. The beverage dispensing system is now in a condition to be shipped to a customer. During transport and storage the interior of the base part 68 is protected from dust and shocks by a hood 74.

Figure 8B:
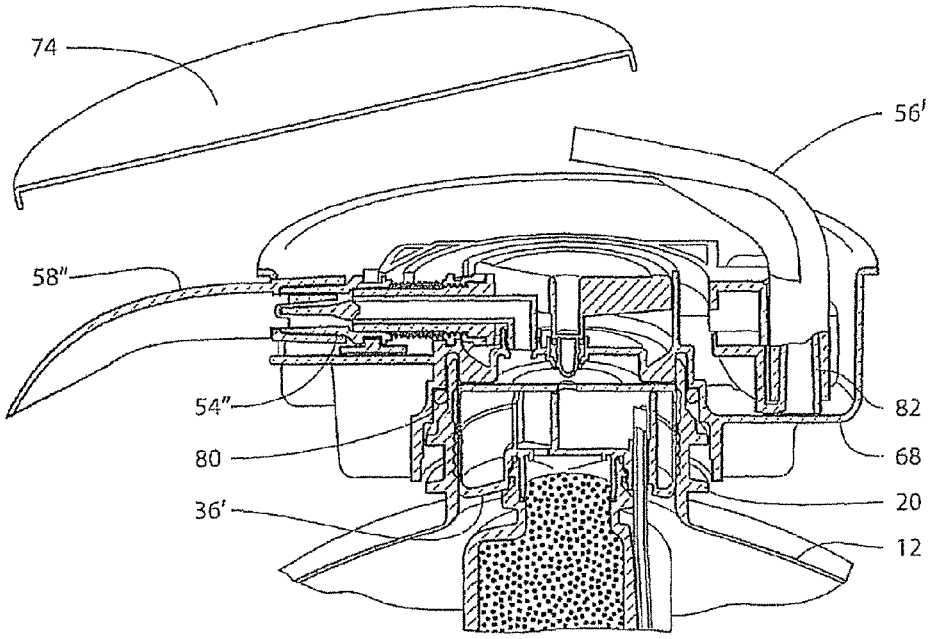

FIG. 8B shows the base part 68 when the hood 74 has been removed, the handle 56' has been assembled onto the connecting part 82 and the beverage spout 58" has been assembled onto the valve 54". During transport to the customer the handle 56' and beverage spout 58" are preferably stored in the base part 68. At the location of the customer the handle 56' and beverage spout 58" are assembled as described above.

Figure 8C:
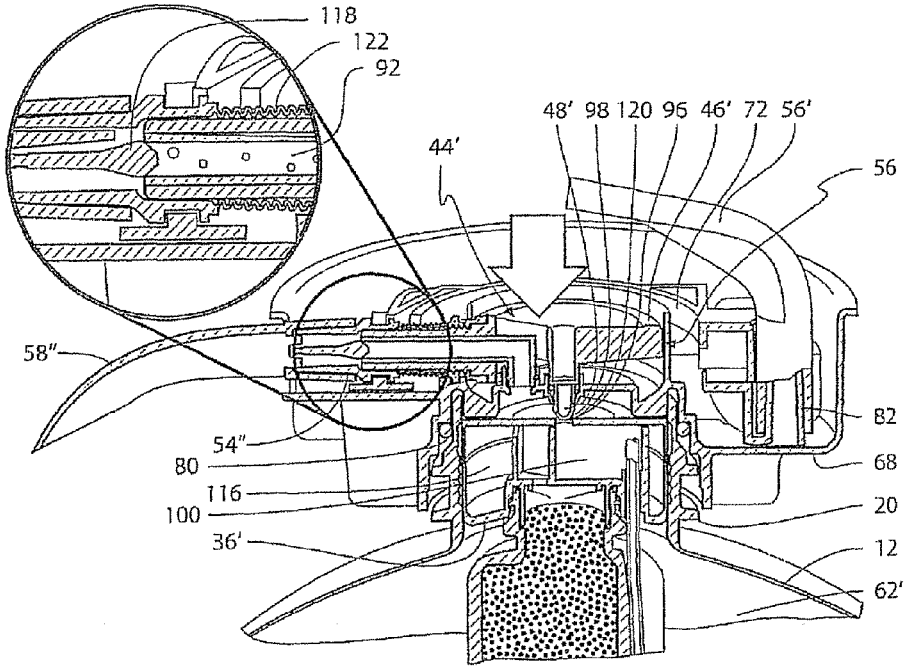

FIG. 8C shows the base part 68 during activation at the location of the user. Before activation, beverage dispensing cannot begin, since the hole 98 of the cap part 36' is closed by the piercable membrane 96 and thus the second fluid passage is not established or activated. By pressing the knob 46' of the piercing element 44' in the direction of the arrow, the needle 130' will pierce the piercable membrane 96 at the hole 98, thereby establishing the second fluid passage. The beverage is now allowed to pass from the inner chamber 100 into an intermediate space 120 located between the cap part 56' and the dispensing line part 92. The beverage dispensing system is now activated and ready for operation, but beverage may still not pass through the valve 56 unless the handle 56' is operated. The valve is presently in a non-beverage dispensing position, in which a plug 118 of the dispensing valve 56 closes off the dispensing line part 92 as can be seen in the close-up view. The valve 56 is operated by the handle 56' via the connecting part 82 and the actuation member 72.

Figure 8D:
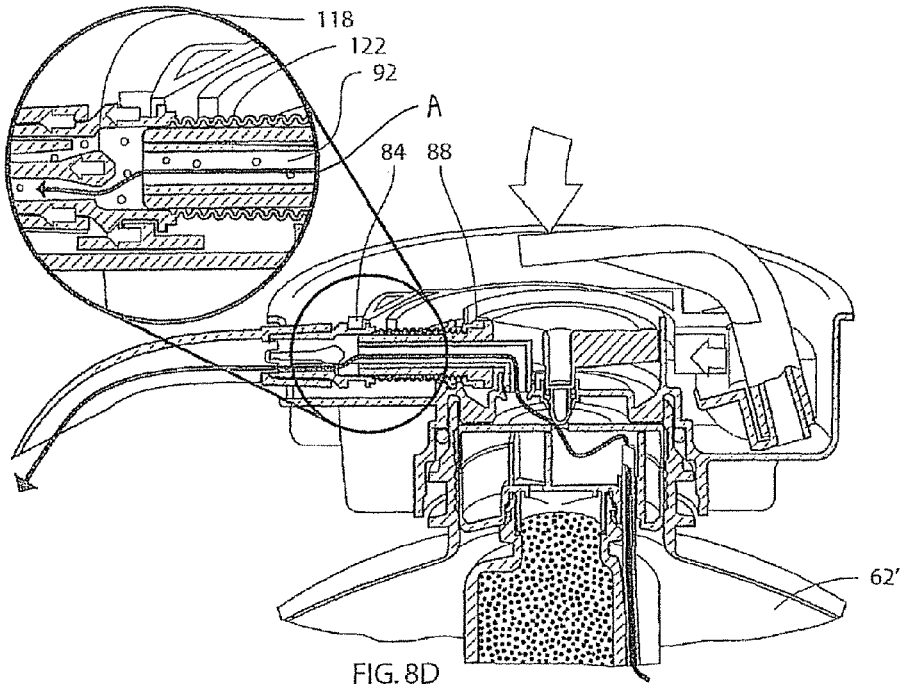

FIG. 8D shows the base part 68 during dispensing. By pressing the handle 56' in a downward direction as indicated by the large arrow, the valve 56 is extended along a flexible valve part 122 located between the first projection 84 and the second projection 88 for causing the plug 118 to be moved away from the dispensing line part 92 as indicated by the small arrows in the close-up view. In this way the complete first fluid path designated A is established from the beverage space (not shown), through the cap part 36' and the base part 68 to the beverage spout 58". Beverage will continue to flow out of the beverage spout 58" as long as the handle 56' is operated, provided the beverage space is not empty. During beverage dispensing, the beverage will reduce in volume and the head space 62' will increase in volume, while the pressure is kept substantially constant due to gas flow through the second flow passage. By releasing the handle 56', beverage dispensing may be interrupted. The beverage spout 58" is designed to prevent any dripping of beverage after the handle 56' has been released by defining a channel being open in a downwardly direction and having a curvature. The details about the beverage spout 58" will be presented later.

FIG. 9A1 shows an embodiment of a handle assembly 124' in which the handle 56" acts directly on the valve 54". The valve 54" has, as previously described a first projection 84' located near the spout 58' and a second projection 88' located near the dispensing line part 92. The flexible valve part 122 of the valve 54" is located between the first projection 84' and the second projection 88'. In the present embodiment, the handle 56' is attached to and rotates about an axle 126 located above the valve 54". An actuating part 128 of the handle 54" extends downwardly and grasps the second projection 88' of the valve 54'. The first projection 84' of the valve 54" is fixed to the base part (not shown) of the beverage dispensing system (not shown). In the present view the valve 58' is closed and the handle 56" is assuming a substantially vertical position.

FIG. 9A2 shows the above embodiment of the handle assembly 124' when the handle 56" has been swung forward from its original vertical position to a position in which the handle 56" is oriented towards the spout 58' as indicated by the large arrow. Since the handle 58' rotates about the axle 126, swinging the handle 58' according to the large arrow will cause the actuating part 128 to swing backward from its original substantially vertical position towards a position in which the actuating part 128 extends towards the dispensing line part 92 as indicated by the small arrow. As the actuating part 128 is fixated to the second projection 88' of the valve 54" and the first projection 84' of the valve 54" is fixed in relation to the base part (not shown) of the beverage dispensing system (not shown), the first projection 84' and the second projection 88' will move away from each other and the flexible valve part 122 will expand, thereby opening the valve 54" and allowing beverage to flow from the dispensing line part 92' to the spout 58'.

FIG. 9B1 shows yet a further embodiment of a handle assembly 124" similar to the embodiment shown above in connection with FIG. 9A1, however, instead of fixing the actuating part 128 to the second projection 88' of the valve 54", the actuating part 128 is fixed to the first projection 84' of the valve 54". Consequently, the second projection 88' of the valve 54" is fixed to the base part (not shown) of the beverage dispensing system (not shown).

FIG. 9B2 shows the above embodiment of the handle assembly 124" when the handle 56" has been swung backward from its original vertical position to a position in which the handle 56" is oriented away from the spout 58' as indicated by the large arrow. Since the handle 58' rotates about the axle 126, swinging the handle 58' according to the large arrow will cause the actuating part 128 to swing forward from its original substantially vertical position towards a position in which the actuating part 128 extends towards the spout 58' as indicated by the small arrow. As the actuating part 128 is fixated to the first projection 84' of the valve 54" and the second projection 88' of the valve 54' is fixated in relation to the base part (not shown) of the beverage dispensing system (not shown), the first projection 84' and the second projection 88' will move away from each other and the flexible valve part 122 will expand, thereby opening the valve 54" and allowing beverage to flow from the dispensing line part 92 to the spout 58'.

FIG. 9C1 shows yet a further embodiment of a handle assembly 124'" similar to the embodiment shown above in connection with FIG. 9A1, however, instead of fixing the handle 56" to the axle 126 located above the valve 54", the handle 56" is fixed to an axle 126' located below the valve 54". Consequently, the second projection 88' of the valve 54" is fixed to the actuating part 128' of the handle 56" above the axle 126'. The first projection 84' of the valve 54" is fixed to the base part (now shown).

FIG. 9C2 shows the above embodiment of the handle assembly 124'" when the handle 56" has been swung backward from its original vertical position to a position in which the handle 56" is oriented away from the spout 58' as indicated by the large arrow. Since the handle 58' rotates about the axle 126', swinging the handle 56" according to the large arrow will cause the actuating part 128' to swing backward as well. As the actuating part 128' is fixed to the second projection 88' of the valve 54" and the first projection 84' of the valve 54" is fixed in relation to the base part (not shown) of the beverage dispensing system (not shown), the first projection 84' and the second projection 88' will move away from each other and the flexible valve part 122 will expand, thereby opening the valve 54" and allowing beverage to flow from the dispensing line part 92' to the spout 58'.

FIG. 9D1 shows yet a further embodiment of a handle assembly 124"" similar to the embodiment shown above in connection with FIG. 9C1, however, instead of fixing the actuating part 128' to the second projection 88' of the valve 54", the actuating part 128' is fixed to the first projection 84' of the valve 54". Consequently, the second projection 88' of the valve 54" is fixed to the base part of the beverage dispensing system (not shown).

FIG. 9D2 shows the above embodiment of the handle assembly 124"" when the handle 56" has been swung forward from its original vertical position to a position in which the handle 56" is oriented towards the spout 58' as indicated by the large arrow. Since the handle 58' rotates about the axle 126', swinging the handle 58" according to the large arrow will cause the actuating part 128' to swing forward from its original substantially vertical position towards a position in which the actuating part 128' extends towards the spout 58' as indicated by the small arrow. As the actuating part 128' is fixed to the first projection 84' of the valve 54" and the second projection 88' of the valve 54" is fixed in relation to the base part of the beverage dispensing system (not shown), the first projection 84' and the second projection 88' will move away from each other and the flexible valve part 122 will expand, thereby opening the valve 54" and allowing beverage to flow from the dispensing line part 92' to the spout 58'.

Figure 10A:
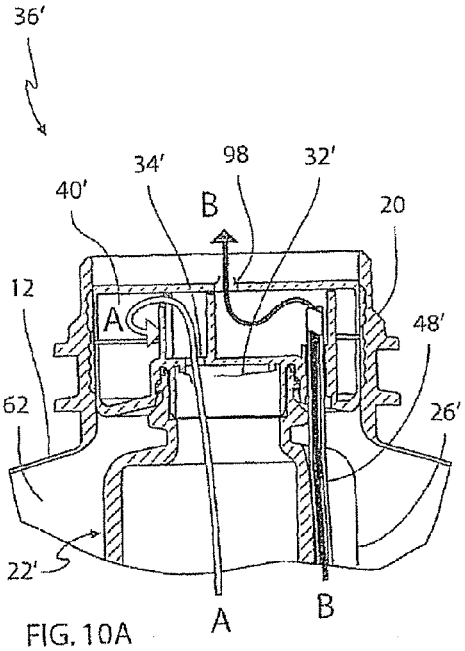

FIG. 10A shows a side view of the pressure generating device 22' of FIG. 5. The pressure generating device 22' has been installed into the beverage container 12 and the cap part 36' forms a seal of the mouth 20 of the beverage container 12. The cap part 36' defines a first flow path, designated A, of gas which has been indicated in the figure by a non-filled arrow. The first flow path A extends from the interior of the canister 26', through the burst membrane 32' of the canister 26' and the gas inlet 34' of the cap part 36' into the outer chamber 40' of the cap part 36'. The first flow path continues into the head space 62 of the beverage container 12 as will be explained in connection with FIG. 10B. The cap part 36' further defines a second flow path, designated B, of beverage which has been indicated in the figure by a filled arrow. The second flow path B extends from the beverage space (not shown) of the beverage container 12, via the dispensing line 48' located outside and along the canister 26', into the inner chamber 100 of the cap part 36' and through the hole 98 of the cap part 36'. The first flow path A and the second flow path B remain fully separated.

Figure 10B:
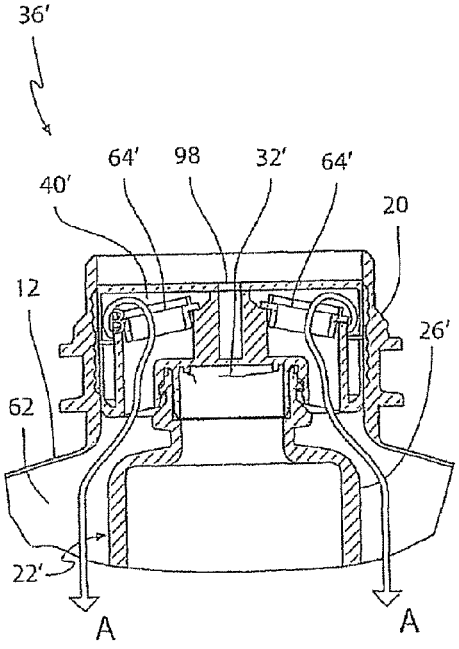

FIG. 10B shows the pressure generating device 22' of FIG. 5 from a second viewing direction being perpendicular to the first viewing direction and showing the continuation of the first flow path A from the outer chamber 40' of the cap part 36' into the head space 62 of the beverage container 12. Continuing from the outer chamber 40', the first flow path A is split up into two flow paths each extending through one of two gas permeable membranes, both designated the reference numeral 64', into the head space 62 of the beverage container. During normal operation of the beverage dispensing system, the carbon dioxide gas will flow in the direction as shown in the figure according to the first flow path A in order to equalize the pressure of the head space 62 with the pressure inside the canister 26' when the pressure in the head space 62 sinks due to e.g. leakage during storage or an expansion of the head space 62 resulting from beverage dispensing operations. However, in exceptional cases, e.g. when the head space is heated by e.g. sunlight, the gas pressure in the head space exceeds the pressure in the interior of the canister 26'. In case the pressure in the head space 62 exceeds the pressure inside the canister 26' the first flow path A will be reversed and gas will flow from the head space 62 to the interior of the canister 26'.

The gas permeable membranes 64' will allow a bidirectional flow of gas. However, the gas permeable membranes 64' will not allow any liquid, e.g. beverage, to pass. This is important in case the beverage container is being shaken or put upside down. The beverage is then prevented from entering the interior of the canister 26'. The gas permeable membrane 64' may e.g. be constituted by a Gore-tex® membrane. Gore-tex® is generally known to have the ability to allow a gas flow but prevent a flow of liquid.

Figure 10C:
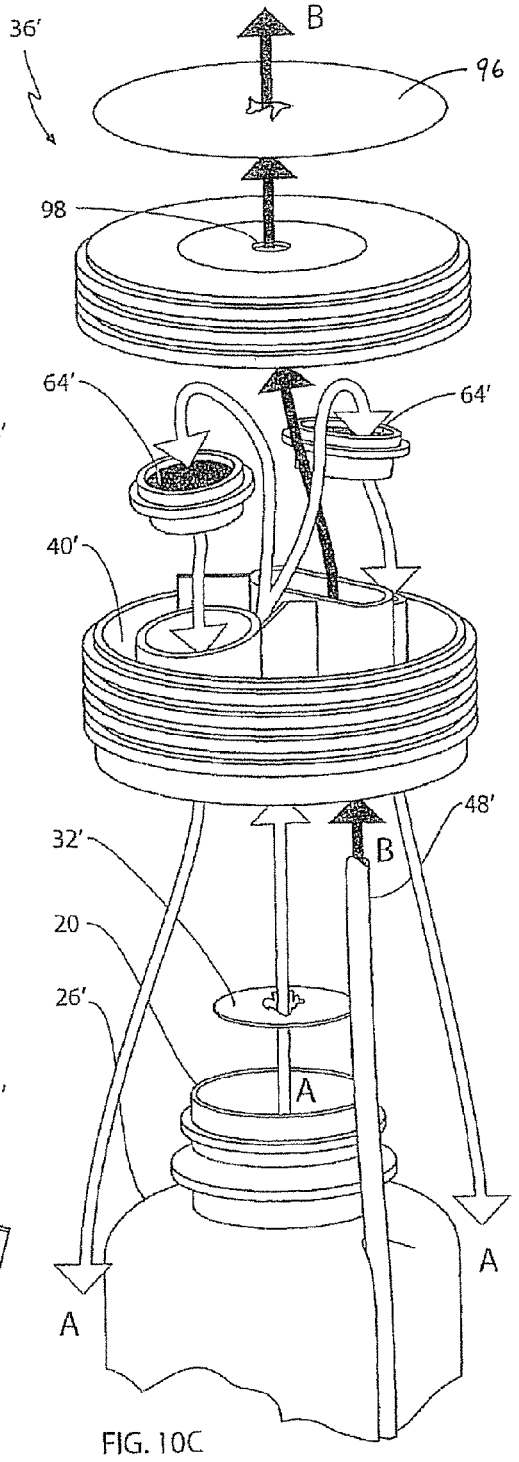

FIG. 10C shows an exploded perspective view of the pressure generating device 22' similar to FIG. 5B, however indicating the first flow path A and the second flow path B. The first flow path A is defined from the interior of the canister 26', through the burst membrane 32', via the outer chamber 40', through the gas permeable membrane 64' and into the head space 62 of the beverage container 12. The second flow path B is, as previously described, defined through the dispensing line 48', via the inner chamber 100 of the cap part 36' and through the hole 98 of the upper cap part 92. The hole 98 is initially sealed by a piercable membrane 96. The piercing of the piercable membrane 96 and the continuation of the second flow path B was described in FIG. 8D.

Figure 11A:
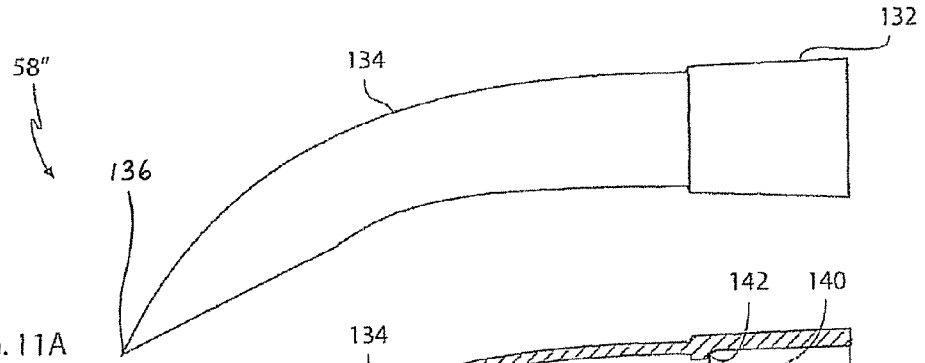
FIGS. 11A-11D are a series showing the improved tapping spout according to the present invention in various views.

FIG. 11A shows a side view of a spout 58" according to the present invention. The spout is intended to be used together with the beverage dispensing system (not shown) as described above. The spout 58" comprises a valve connector 132 intended to be positioned around a dispensing valve (not shown) as described above, optionally using a connector (not shown) in-between. The spout 58" further comprises a longitudinal wall 134 which is oriented downwardly towards a spout tip 136.

Figure 11B:
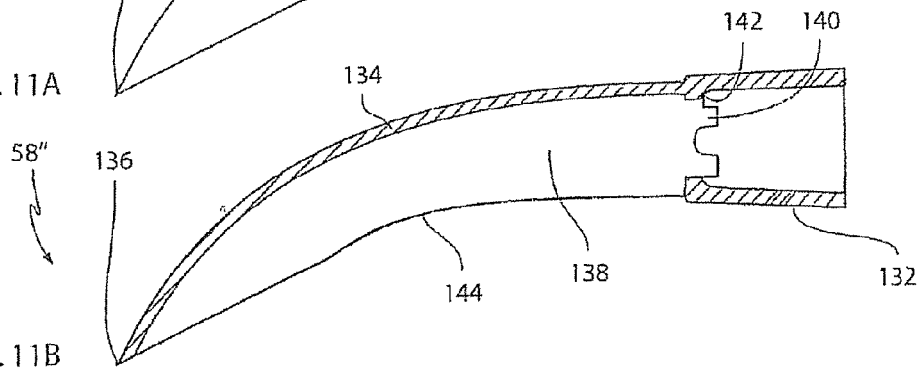

FIG. 11B shows a cut-out side view of a spout 58" according to the present invention. A plurality of capillary flow passages 138 are defined in parallel from the valve connector 132 constituting an inlet to the spout tip 136 constituting an outlet. Inner spout walls 140 are separating each of the capillary flow passages of the plurality of capillary flow passages 138. The inner spout wall 140 extends into the valve connector 132. When mounted, the valve (not shown) will extend to the stop 142 of the valve connector 132. The longitudinal wall 134 bends downwardly in a regular manner from the valve connector 132 to the spout tip 136 when the spout 58" is mounted on a beverage dispensing system as the one shown in FIG. 3. The longitudinal wall 134 does not completely enclose the lower part of the spout 58" which consequently forms a ventilation opening 144.

Figure 11C:
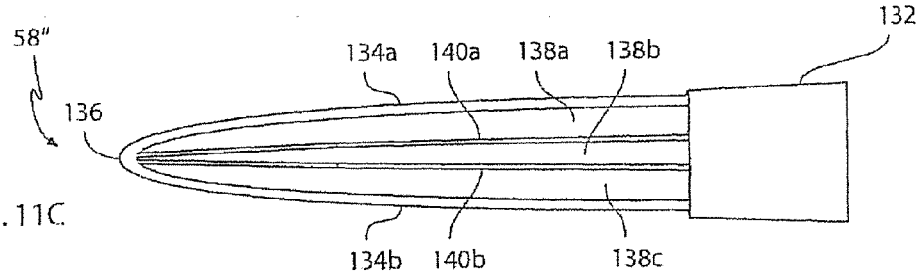

FIG. 11C shown an exterior view towards the lower side of the spout 58" into the ventilation opening 144 revealing the capillary flow passages 138*a*, 138*b* and 138*c* extending from the valve connector 132 to the spout tip 136. A first capillary flow passage 138*a* is defined between a first longitudinal wall part 134*a* and a first inner spout wall 140*a*, a second capillary flow passage 138*b* is defined between the first inner spout wall 140*a* and a second inner spout wall 140*b*, and the third capillary flow passage 138*c* is defined between the second inner spout wall 140*b* and a second longitudinal wall part 134*b*. The longitudinal wall parts 134*a*, 134*b* and the inner spout walls 140*a*, 140*b* are monotonically converging from the valve connector 132 to the spout tip 136 and consequently the flow area defined by the capillary flow passages 138*a*,

138*b* and 138*c* are monotonically decreasing from the valve connector 132 to the spout tip 136.

The flow area defined by each of the capillary flow passages 138*a*, 138*b* and 138*c* at the valve connector 132 should be small enough to allow a stream of beverage to remain inside the flow passage and not to fall out through the ventilation opening 144. A stream of beverage entering any of the capillary flow passages 138*a*, 138*b* and 138*c* at the valve connector 132 will be transported from the valve connector 132 to the spout tip 136 where it will be released, e.g. into a beverage glass, by utilizing a combination of three flow effects. The three flow effects being the momentum of the stream generated by the pressurized beverage container, the gravity due to the downwardly shape of the longitudinal wall 134 and the capillary force generated by the converging flow passages 138*a*, 138*b* and 138*c*.

When the valve (not shown) is just closed and the last part of the beverage stream enters the spout 58", this last part will also be subjected to the momentum of the stream generated by the pressurized beverage container, the gravity due to the downwardly shape of the longitudinal wall 134 and the capillary force generated by the converging flow passages 138*a*, 138*b* and 138*c*. The applicant has found out that by combining the above three flow effects it is avoided that any beverage will remain inside the spout 58". The last stream of beverage will thus be propelled towards the spout tip 136 by the combination of the three effects which effectively clears the whole capillary flow passage 138. Only a single drop may in the worst case remain attached to the spout tip 136. A prolonged dripping of the spout 136 is thereby avoided. This feature is particular useful in connection with disposable dispensing systems, in which a drip tray is not normally provided for. The ventilation opening 144 further prevents any beverage from remaining inside the spout due to the suction effect, i.e. air is allowed to enter the spout near the valve connector 132 such that the beverage stream may be replaced by air.

In addition to the above, the centrally located second flow passage 138*b* has a smaller flow area than the first flow passage 138*a* and the third flow passage 138*c* located around the second flow passage 138*b*. A stream of beverage having a laminar parabolic flow profile and entering the spout 58" at the valve connector 132 will be split into an inner stream part entering the second flow passage 138*b* and two outer stream parts entering the first flow passage 138*a* and the third flow passage 138*c*, respectively. The flow profile in the dispensing line (not shown) is substantially laminar and parabolic, i.e. the flow velocity of the outer stream parts flowing near the walls of the dispensing line will be lower than the flow velocity of the inner stream part near the center of the stream. Consequently, the inner stream part which will enter the second flow passage 138*b* of the spout 58" at the valve connector 132 having a higher velocity than the outer streams part. Since the flow area of the second capillary flow passage 138*b* is smaller, the inner stream part will then be subjected to a higher flow resistance than the outer stream parts entering any of the first flow passage 138*a* and the third flow passage 138*c*. Since the inner stream part is subjected to a higher flow resistance compared to the outer stream part, the stream will assume a flat flow profile instead of a parabolic flow profile. A flat flow profile, which is also known as a planar flow profile, has a substantially uniform velocity in the inner and outer parts of the stream, i.e. substantially the same flow velocity in all of the flow passages. Thereby the amount of turbulence generated in the spout 58" will be reduced and the steam will remain laminar. By keeping the flow laminar, the risk of beverage remaining in the spout is further reduced.

The material used for the spout 58" is most preferably being poly(dimethylsiloxane), or a similar material having an e-modulus (elastic modulus) of less than 3. Alternatively, the spout 58" may be made of a different material but having a coating of poly(dimethylsiloxane) material in case another material is preferred for the spout itself. Materials having an e-modulus less than 3, also known as release coatings, have a low level of wetting and will further contribute to prevent any beverage from remaining in the spout after the valve is closed. More details concerning release coatings may be found in the publication "Mechanical factors favoring release from fouling release coatings", by R. F. Brady and I. L. Singer, published in "Biofouling", Volume 15, Issue 1-3, 2000, pages 73-81, of 1 Jan. 2000.

Figure 11D:
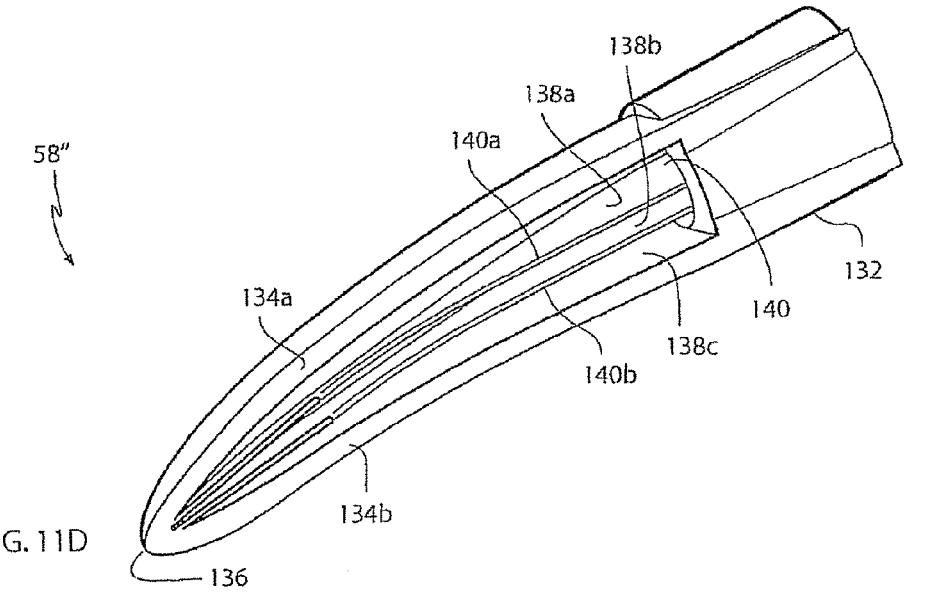

FIG. 11D shows a perspective view of the spout 58" according to the present invention. It is contemplated that further flow passages can be used, such as 10 or 100, depending on the desired amount of beverage to be dispensed. It is further contemplated that although the spout 58" has been described in connection with a beverage dispensing system for dispensing beverages, in particular carbonated beverages such as beer, the spout according to the present invention may be used in connection with dispensing or similar handling of various other liquids where spillage should be avoided, such as dispensing of oil, petrol, soap, disinfectant, etc.

FIG. 12A1 shows a beverage dispensing system 10" comprising a container 12, a dispensing line 48 and a handle 56. The handle 56 is controlling a dispensing valve 54 which is operable between a beverage dispensing position and a non-beverage dispensing position. The upper part of the container is provided with a grip 146 for easy transporting of the beverage dispensing system 10. The grip 146 is mounted on a base part 68. The base part 68 is mounted on the mouth (not shown) of the beverage container 12.

The beverage container 12 comprises a rounded bottom 14, a shoulder 18 and a wall 16 interconnecting the bottom 14 and the shoulder 18. The bottom is connected to a base 154 which is flat and allows the beverage container 12 to have a rounded bottom. A rounded bottom allows a higher pressure to be used inside the container without causing deformation of the bottom 14. The container is filled by beverage 60. The wall 16 includes a visual inspection section, which may be a transparent section of the wall 16 as in the present embodiment, for allowing visual inspection of the interior of the container 12. The container 12 includes a canister 26 extending from the bottom 14 to the shoulder 18. The canister 26 is fixed inside the container 12. The canister 26 is in contact with the beverage 60.

The canister 26 has a temperature indicator which preferably constitutes a layer of heat sensitive ink 148, i.e. a layer of lacquer having thermocromic properties. Liquid crystals may alternatively be used for the same purpose, however, for cost reasons the heat sensitive ink 148 is preferred. In the present figure the beverage container 12 is stored at room temperature, such as 20-23 degrees C. The heat sensitive ink is of a type having a color transition in the range 12-20 degrees C., such as 15-17 degrees C., i.e. between room temperature and beer serving temperature. In the present figure, the beverage is assuming room temperature and the heat sensitive ink 148 is assuming a white color to indicate this. A user observing the beverage dispensing system 10" will immediately know that the beverage needs cooling and will put the beverage dispensing system 10" inside a refrigerator for a specific amount of time until the beverage is sufficiently cooled.

FIG. 12A2 shows the beverage dispensing system 10" in which the beverage is cooled down to proper serving temperature, such as between 5 to 12 degrees C. The heat sensitive ink 148 of the canister 26 will thereby change color to black. A user observing the beverage dispensing system 10" will immediately know that the beverage is sufficiently cooled and ready for dispensing. Preferably, a reversible ink is used as heat sensitive ink 148 such that in case the beverage heat up again, the heat sensitive ink 148 will re-assume the white color to indicate that renewed cooling is needed. It is obvious that other colours than black/white may be used.

The above feature allows a user to determine when a beverage dispensing system under cooling has reached the proper serving temperature, and further allows the user to cool the beverage again in case the beverage has re-assumed room temperature after being subjected to a higher temperature for a time period.

FIG. 12B1 shows a beverage dispensing system 10'" in which the beverage assumes room temperature. The beverage dispensing system 10'" comprising a container 12' having a cylindrical wall 16' made of metal and a dispensing valve 54' located near the bottom 14' part of the container 12'. The wall 16' has a circular window 150' near the dispensing valve 54'. The window 150' is transparent and may be made of plastics. The interior of the container 12' of the beverage dispensing system 10'" comprises a canister 26' located near the dispensing valve 54'. The canister 26 is being visible through the window 150'. The canister 26' is painted by a layer of heat sensitive ink 148 as described above. The canister 26 may be used for cooling the beverage as described above, however, it may also be used as a dispensing line or a combination of dispensing line and cooling.

FIG. 12B2 shows a beverage dispensing system 10'" in which the beverage has been cooled to a temperature suitable for drinking. The heat sensitive ink 148 has thereby changed its color to indicate that the beverage has the suitable drinking temperature.

FIG. 12C1 shows a beverage dispensing system 10"" in which the beverage is assuming room temperature. The beverage dispensing system 10"" comprising a container 12 which is entirely transparent. The canister 26 and the heat sensitive ink 148 painted on the canister may, in addition to informing the user about the beverage temperature, be used for informing the user about the product, such as in the present embodiment in which the heat sensitive ink 148 forms the logotype of the beverage company Carlsberg®. At room temperature the heat sensitive ink 148 assumes a non-distinguishable color as indicated by the dashed lines when observed through the wall 16. By non-distinguishable color is meant a color which cannot be distinguished from the outside of the container. Preferably, the canister 26 is painted in a color by non-temperature sensitive ink while the heat sensitive ink 148 is chosen to be of the type assuming a color which is identical to the color of the canister when stored at room temperature. For example, the canister 26 may be painted green by non-temperature sensitive ink while the logotype of heat sensitive ink 148 may be pained by a type of temperature sensitive ink being green at room temperature. The logotype of heat sensitive ink 148 will thus be non-distinguishable at room temperature. Alternatively, the wall 16 of the beverage container 12 may have a specific optical filter characteristic preventing transmission of wavelengths corresponding to the specific color. For example, the wall 16 of the beverage container 12 may have an optical filter characteristic which only transmits wavelengths corresponding to the green color. The heat sensitive ink 148 and the canister 26 may be painted in a color different from green at room temperature. In this way the logotype of heat sensitive ink 148 will be non-distinguishable.

FIG. 12C2 shows the beverage dispensing system 10"" in which the beverage has been cooled to a suitable drinking temperature. The layer of heat sensitive ink 148 should be of the type switching from a non-distinguishable color to a distinguishable color, thereby rendering the logotype of heat-sensitive ink 148 to be visible through the wall 12.

FIG. 12D1 shows the beverage dispensing system 10"" in which the beverage assumes room temperature. The beverage dispensing system 10"" comprises a container 12 which is entirely transparent. In the present embodiment the logotype constituting the product information is painted by non-heat sensitive ink 152 whereas the heat sensitive ink 148 forms the word "Cool". At room temperature the heat sensitive ink 148 assumes a non distinguishable color as described above in connection with FIG. 12C1 when observed through the wall 16.

FIG. 12D2 shows the beverage dispensing system 10"" in which the beverage has been cooled to a suitable drinking temperature. The layer of heat sensitive ink 148 should be of the type switching from a non-distinguishable color to a distinguishable color, thereby rendering the word "Cool" on the canister 26 to be visible through the wall 12. The heat sensitive ink 148 is preferably located in the lower part of the beverage container to be in contact with the beverage even after a considerable amount of beverage has already been dispensed.

Figures 13A, 13B, 13C:
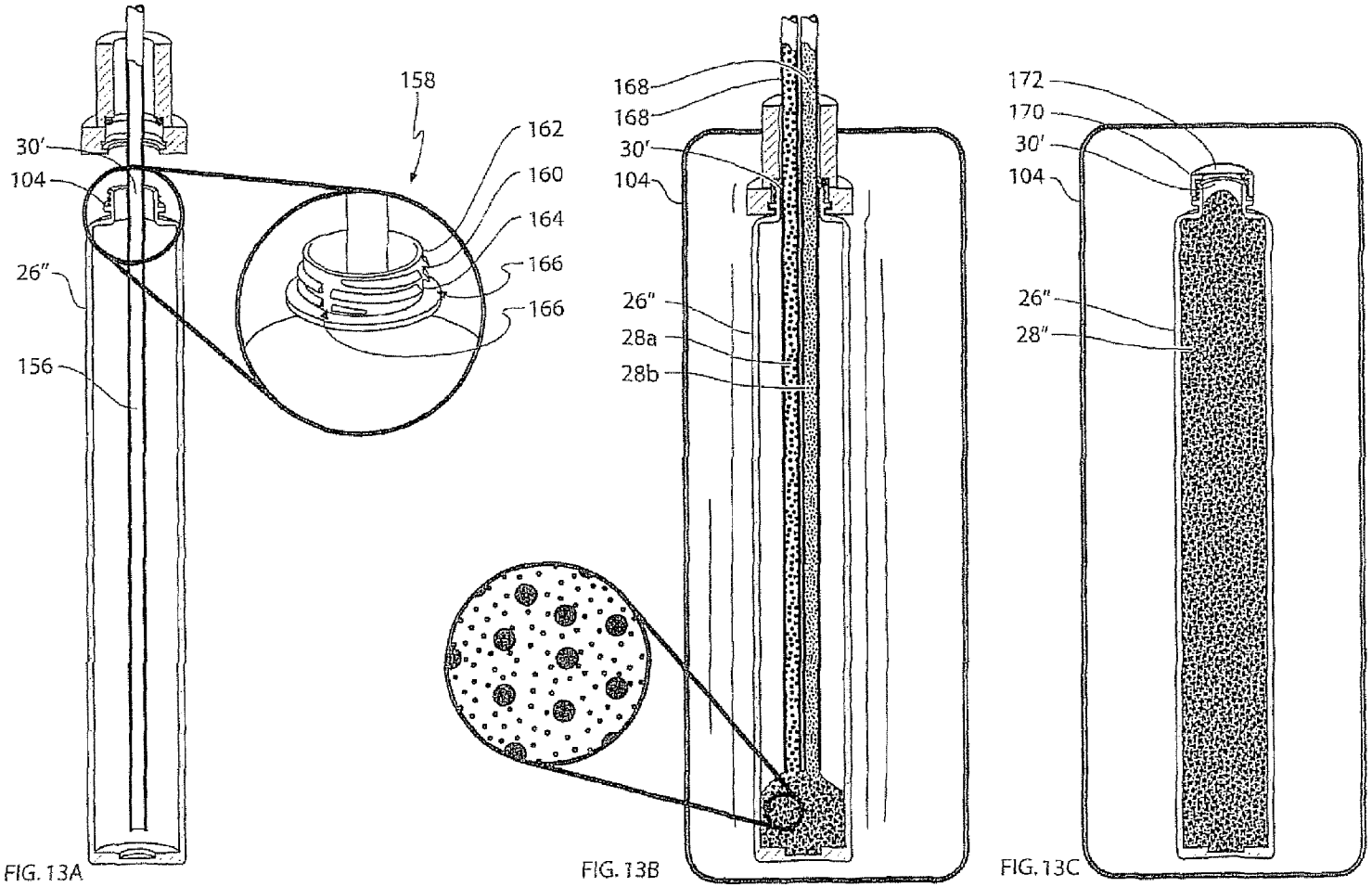
FIGS. 13A-13K are a series showing presently preferred steps of filling a canister with activated carbon.

FIG. 13A shows an optional flushing of a canister 26" by carbon dioxide. The canister 26" is in principal identical to the previously presented canister 26', except that the canister 26" is non-foldable, i.e. not comprising any folds, and comprises, in addition to a cylindrical body, a cylindrical neck part 158 above the rim 104. The cylindrical neck part 158 is shown in the close up view in connection with FIG. 13A. The cylindrical neck part 158 is subdivided into a lower neck portion 160 and an upper neck portion 162 and further comprises a screw thread 164 along the upper and lower neck portions 160, 162. The screw thread 164 is constituted by helical protrusions encircling the cylindrical neck 158 and which are interrupted at certain locations to form straight passages or pressure relief vents 166 though the screw thread 164 between the upper neck portion 164 and the lower neck portions 160. The flushing by carbon dioxide is performed in order to flush out any oxygen possibly remaining inside the canister 26". The flushing is performed by introducing a flushing tube 156 through the opening 30' of the canister 26" and flushing the interior of the canister 26" by carbon dioxide.

FIGS. 13B and 13C show the introduction of activated carbon 28" into the canister similar to the filling described in connection with FIG. 6*b*. The activated carbon 28", constituting the adsorption material, is filled into the canister 26" by introducing a dual filling tube 168 through the opening 30'. The dual filling tube 168 supplies two sorts of activated carbon 28*a* and 28*b*, differing in the size of granulates. The granulates 28*b* have in the present context about 10 times greater volume than the granulates 28*a*. This can be seen in detail in the close up view in connection with FIG. 13B. The purpose of filling with two different sizes of the granulates 28*a* and 28*b* is to achieve a higher density of activated carbon in the canister 26" than would be obtainable by using granulates of the larger size only, since by using large granulates 28*b* only would yield large unfilled spaces between the individual granulates. By also filling by small size granulates 28*a* these spaces between the large granulates are filled by the small granulates. The applicant has obtained a density of activated carbon inside the canister of 0.54 kg/liter by using granulates of two different sizes compared to a density of 0.45 kg/liter by using large granulates only. The canister26" is optionally kept within a filling chamber which is indicated by the box. The filling chamber may include carbon dioxide at atmospheric pressure.

Prior to being introduced into the canister, the activated carbon has been treated to remove any oxygen and/or water molecules which may have been adsorbed during storage and handling. The treatment comprises heating the activated carbon in an oxygen free environment to a temperature of about 20° C.-50° C. in order to desorb any oxygen and/or water molecules.

FIG. 13C shows the canister 26" onto which a lid 170 has been loosely applied onto the cylindrical neck part 158 by screwing the lid 170 by e.g. half a turn to mutually engage the screw threads of the lid and the cylindrical neck. The lid has a piercable membrane 172 at the top made of e.g. aluminium. The canister 26" is thereby assembled but not filled by carbon dioxide.

Figure 13E:
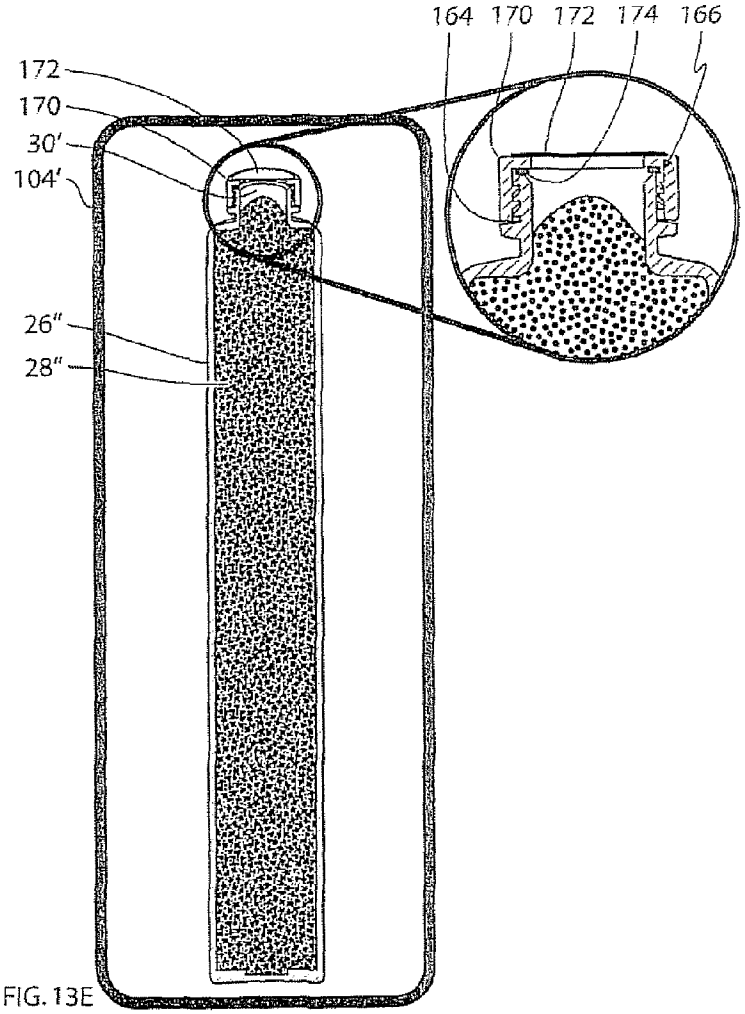
Figure 13D:
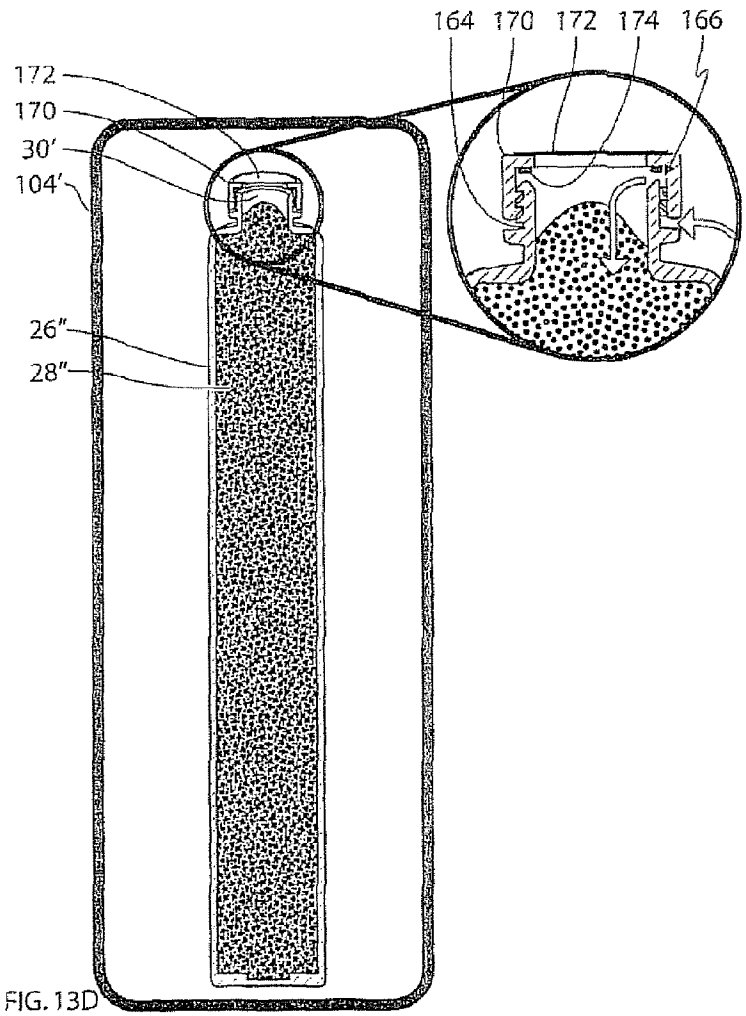

FIG. 13D shows the filling of carbon dioxide into the canister 26" by placing the canister 26" into a pressure chamber indicated by a box in FIG. 13D. The pressure in the pressure chamber should correspond to the initial pressure of the beverage container, e.g. 2-3 bar, or higher, such as 5-6 bar. During filling, the temperature of the activated carbon 28" will increase due to adsorption. To compensate for the increased temperature, the pressure chamber is preferably held at a low pressure. The carbon dioxide will enter into the canister 26" via the pressure relief vents 166 of the screw thread 164 as indicated by the arrows in the close up view of the lid 170 in a loose position in connection with FIG. 13D. In the close up view a sealing ring 174 of the lid 170 is shown in a non-sealing position allowing the carbon dioxide to enter the interior of the canister 26". The smaller flow area obtained by the pressure relief vents allows for a slightly slower filling, which will avoid exceptional temperatures in the activated carbon 28".

The pressure chamber is preferably held at a low temperature, such as −20° C.--30° C. in order to further compensate for the temperature increase of the activated carbon during adsorption. More preferably, a cold surface, e.g. a cooling block, may be held adjacent the canister 26" in order to conduct heat away from the canister 26". The amount of $CO_2$ to be filled into the canister 26" for a 5 liter beverage container corresponds to 23 liter at 40° C.

FIG. 13E shows the canister 26" onto which the lid 170 has been fastened by screwing the lid 170 onto the cylindrical neck part 158 until the sealing ring 174 of the lid 170 seals against opening 30' of the canister 26". The canister 26" may thereafter be removed from the pressure chamber.

Figure 13F:
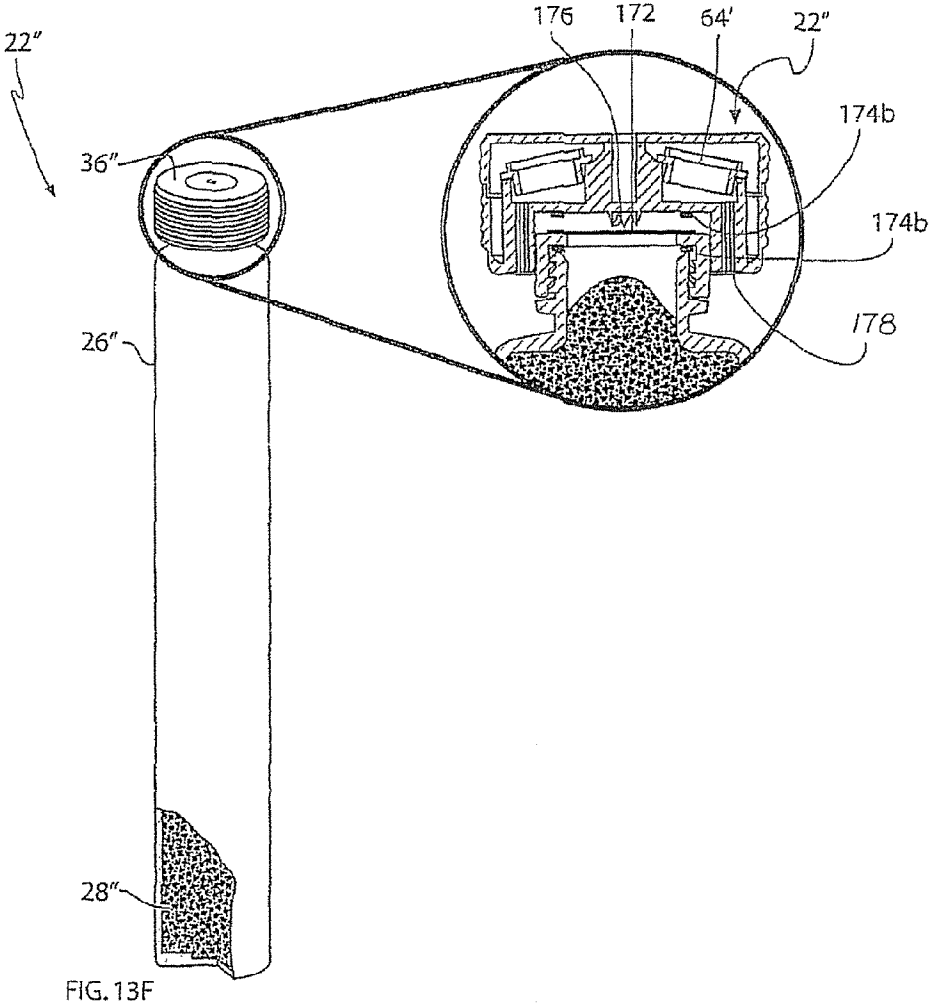

FIGS. 13E and 13F show a pressure generating device 22" formed by the canister 26" onto which a cap part 36" has been attached in a non-activated position. The cap part 36" is similar to the previously presented cap part 36', however, instead of being attached to the opening 30' of the canister 26" it is applied on top of the lid 170 and clamped between the outer circumferential surface of the lid 170 and the corresponding inner surface of the cap part 36". The cap part 36" further comprises a piercing mechanism 176 located above the piercable membrane 172 of the lid 170 and a further sealing ring **174*b* located encircling the piercing mechanism 176 outside the piercable membrane 172 and without contact with the lid 170. The present state is a non-activated state of the canister 26" prior to being introduced into the beverage container. The cap part 36" comprises, in addition to the water impermeable and gas permeable membrane 64, a set of capillary pipes 178 located between the gas permeable membrane 64 and the beverage container 12'. The capillary pipes 178 prevent large quantities of beverage to enter the cap part 36" in case the beverage container 12'** is placed upside down during handling.

Figure 13H:
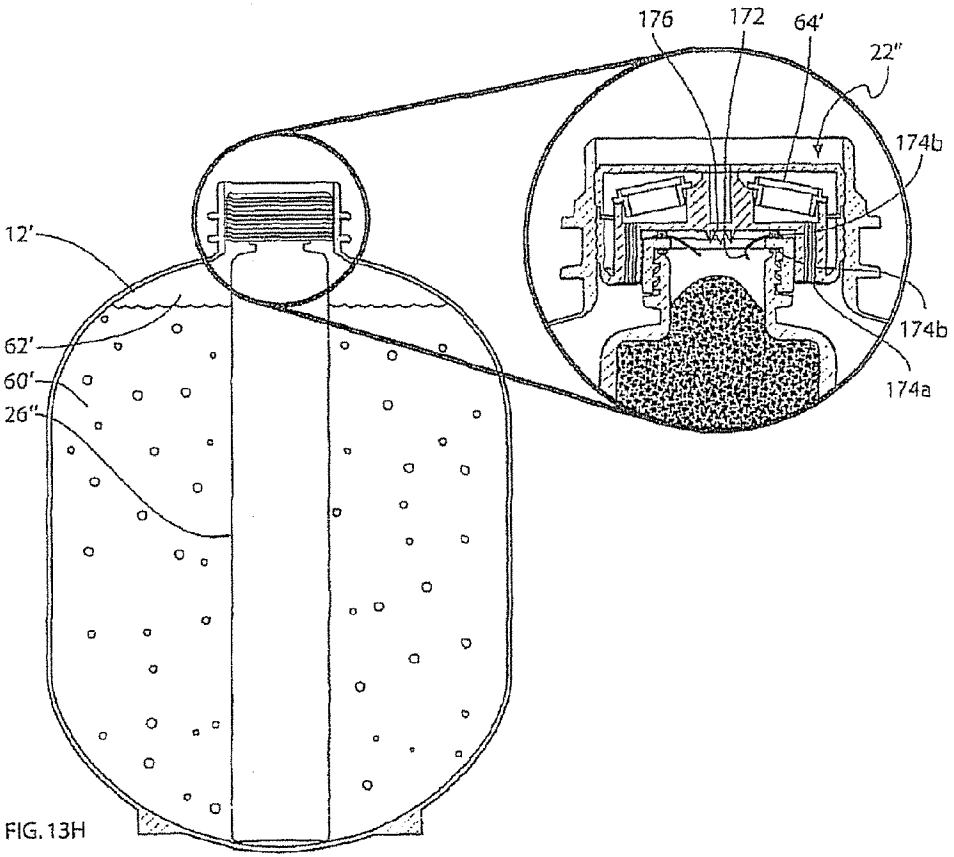
Figure 13G:
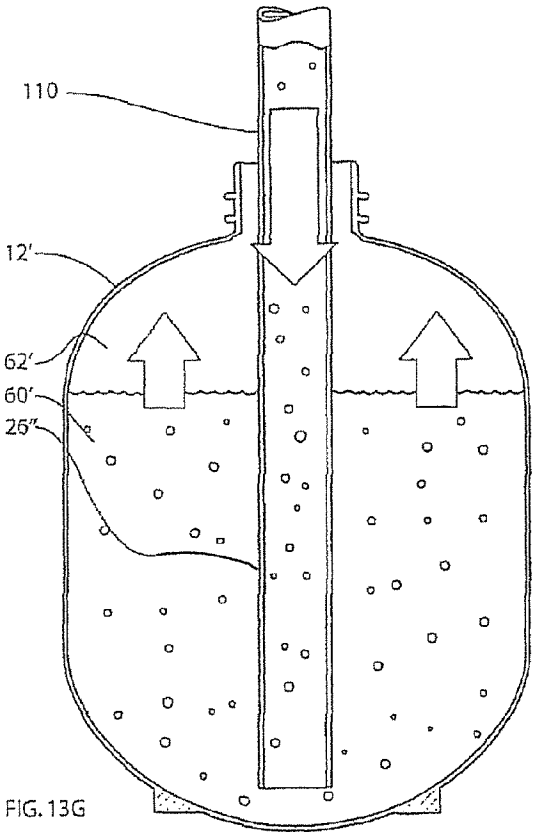

FIG. 13G shows the filling of carbonated beverage into the beverage container 12' which filling is identical to the filling of the container in FIG. 7A.

FIG. 13H shows the activation of the pressure generating device 22" during the installation of the canister 26" into the beverage container 12'. When the canister 26" is pushed into the container 12' by applying a pressure onto the cap part 36", the outer circumferential surface of the lid 170 will slide along the corresponding inner surface of the cap part 36" and the piercing mechanism 172, constituted by a sharp point, will move into and rupture the piercable membrane 172, the further sealing ring **174*b* will seal the lid 170 to the cap part 36", and, simultaneously the cap part 36" will be clamped securely into the beverage container as described in connection with FIG. 7. Gaseous communication is thereby established from the interior of the canister 26", via the gas permeable membrane 64 and the capillary pipe 178, into the beverage container 12', as can be seen in the close up of FIG. 13H. The canister 26" rests on the bottom of the beverage container 12'**.

Figure 13I:
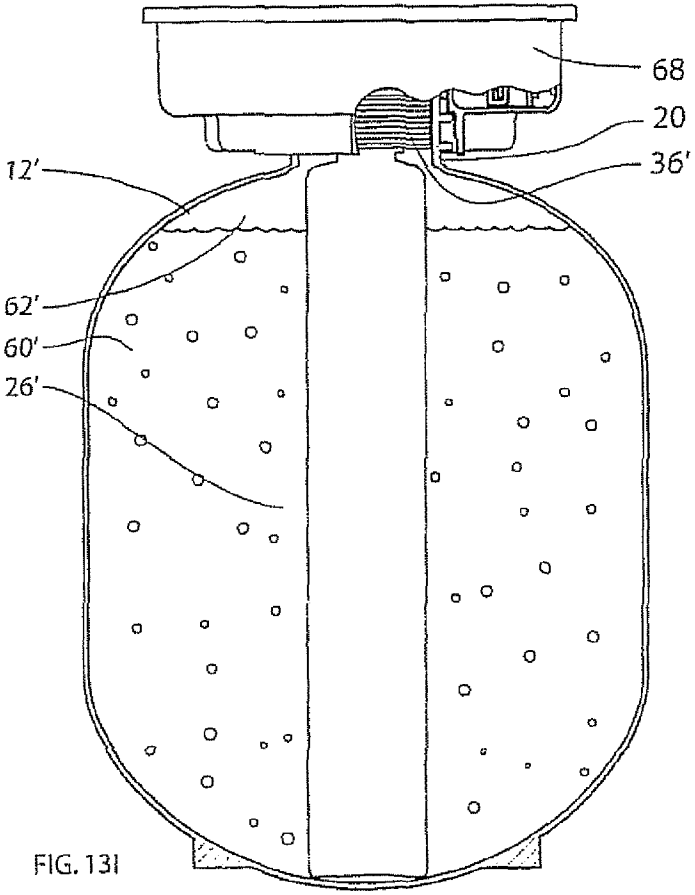

FIG. 13I shows the beverage container 12' onto which a base part 68 has been mounted.

Figure 13J:
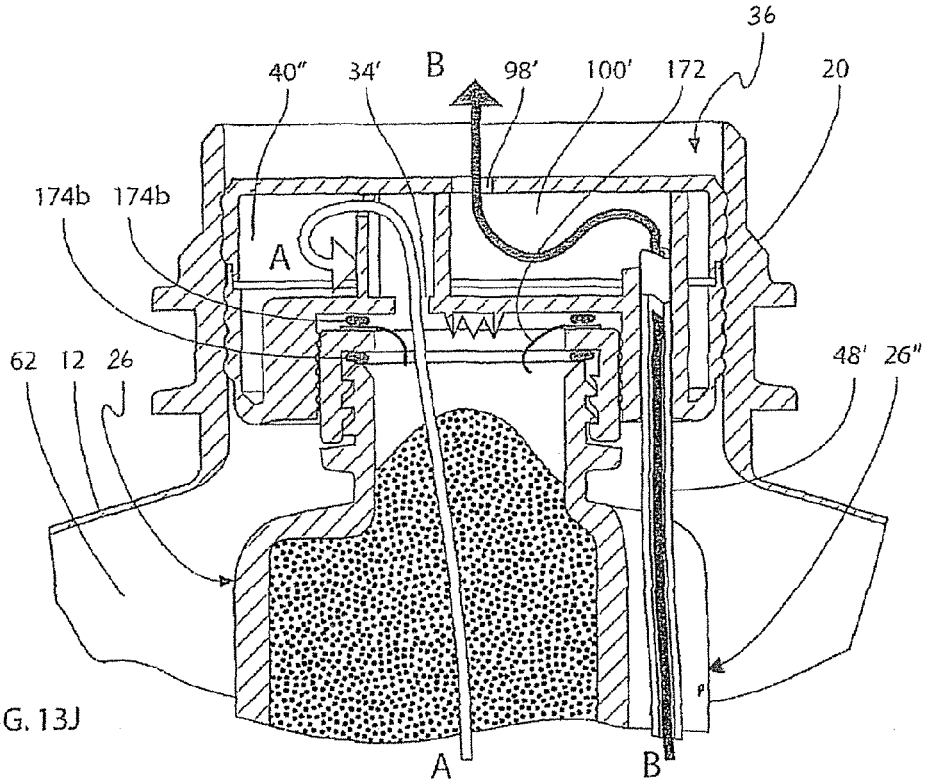

FIG. 13J shows a side view of the pressure generating device 22" of FIG. 5. The pressure generating device 22" has been installed into the beverage container 12 and the cap part 36' forms a seal of the mouth 20 of the beverage container 12'. The cap part 36" defines a first flow path, designated A, of gas which has been indicated in the figure by a non-filled arrow. The first flow path A extends from the interior of the canister 26", through the previously pierced piercable membrane 172 of the lid 170 into an outer chamber 40" of the cap part 36". The first flow path continues into the head space 62 of the beverage container 12' as will be explained in connection with FIG. 10B. The cap part 36' further defines a second flow path, designated B, of beverage which has been indicated in the figure by a filled arrow. The second flow path B extends from the beverage space (not shown) of the beverage container 12, via the dispensing line 48" located outside and along the canister 26", into the inner chamber 100' of the cap part 36" and through the hole 98' of the cap part 36". The first flow path A and the second flow path B remain fully separated.

Figure 13K:
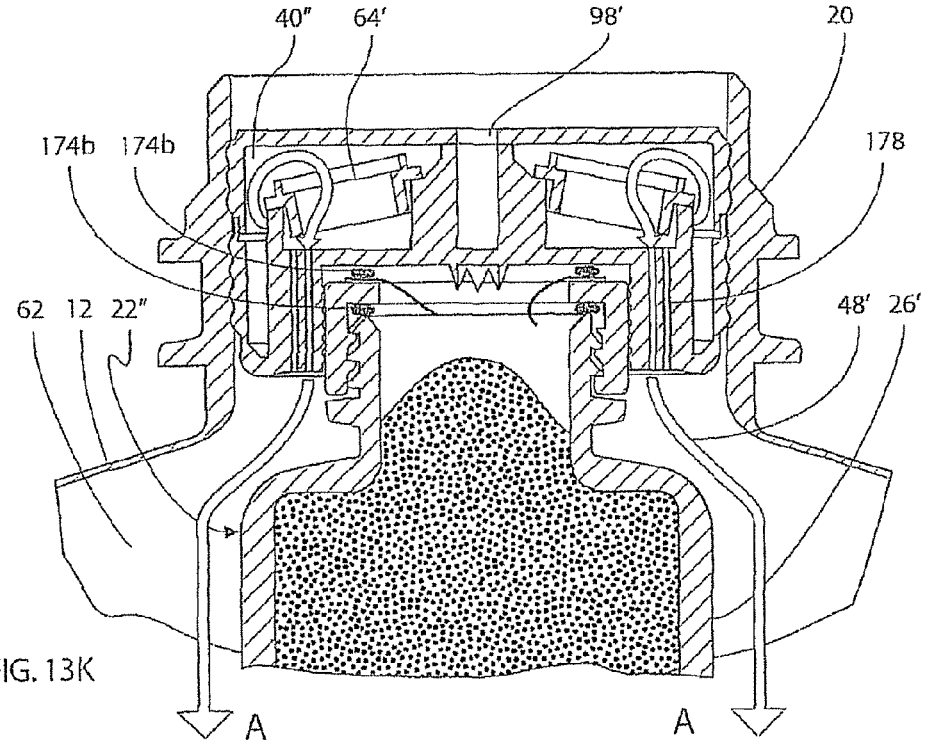

FIG. 13K shows the pressure generating device 22" of FIG. 13J from a second viewing direction being perpendicular to the first viewing direction and showing the continuation of the first flow path A from the outer chamber 40" of the cap part 36" into the head space 62 of the beverage container 12'. Continuing from the outer chamber 40", the first flow path A is split up into two flow paths each extending through one of the two gas permeable membranes, both designated the reference numeral 64', and via one of the capillary pipes, all designated the reference numeral 178, into the head space 62 of the beverage container. During normal operation of the beverage dispensing system, the carbon dioxide gas will flow in the direction as shown in the figure according to the first flow path A in order to equalize the pressure of the head space 62 with the pressure inside the canister 26" when the pressure in the head space 62 sinks due to e.g. leakage during storage or an expansion of the head space 62 resulting from beverage dispensing operations. However, in exceptional cases, e.g. when the head space is heated by e.g. sunlight, the gas pressure in the head space exceeds the pressure in the interior of the canister 26". In case the pressure in the head space 62 exceeds the pressure inside the canister 26" the first flow path A will be reversed and gas will flow from the head space 62 to the interior of the canister 26".

The gas permeable membranes 64' as well as the capillary pipes 178 will allow a bidirectional flow of gas. However, the capillary pipes 178 will not allow any liquid, e.g. beverage, to pass. The gas permeable membranes 64' act as a safety precaution to allow the interior of the canister 26" to remain dry in case very small droplets pass the capillary pipes 178, e.g. when the beverage container is shaken and/or put upside down and rests on the base part. The beverage is then prevented from entering the interior of the canister 26'. The gas permeable membrane 64' may e.g. be constituted by a Gore-tex® membrane. Gore-tex® is generally known to have the ability to allow a gas flow but prevent a flow of liquid. Other membranes from other manufacturers are equally applicable, e.g. membranes from the company Paal GmbH.

Figure 14:
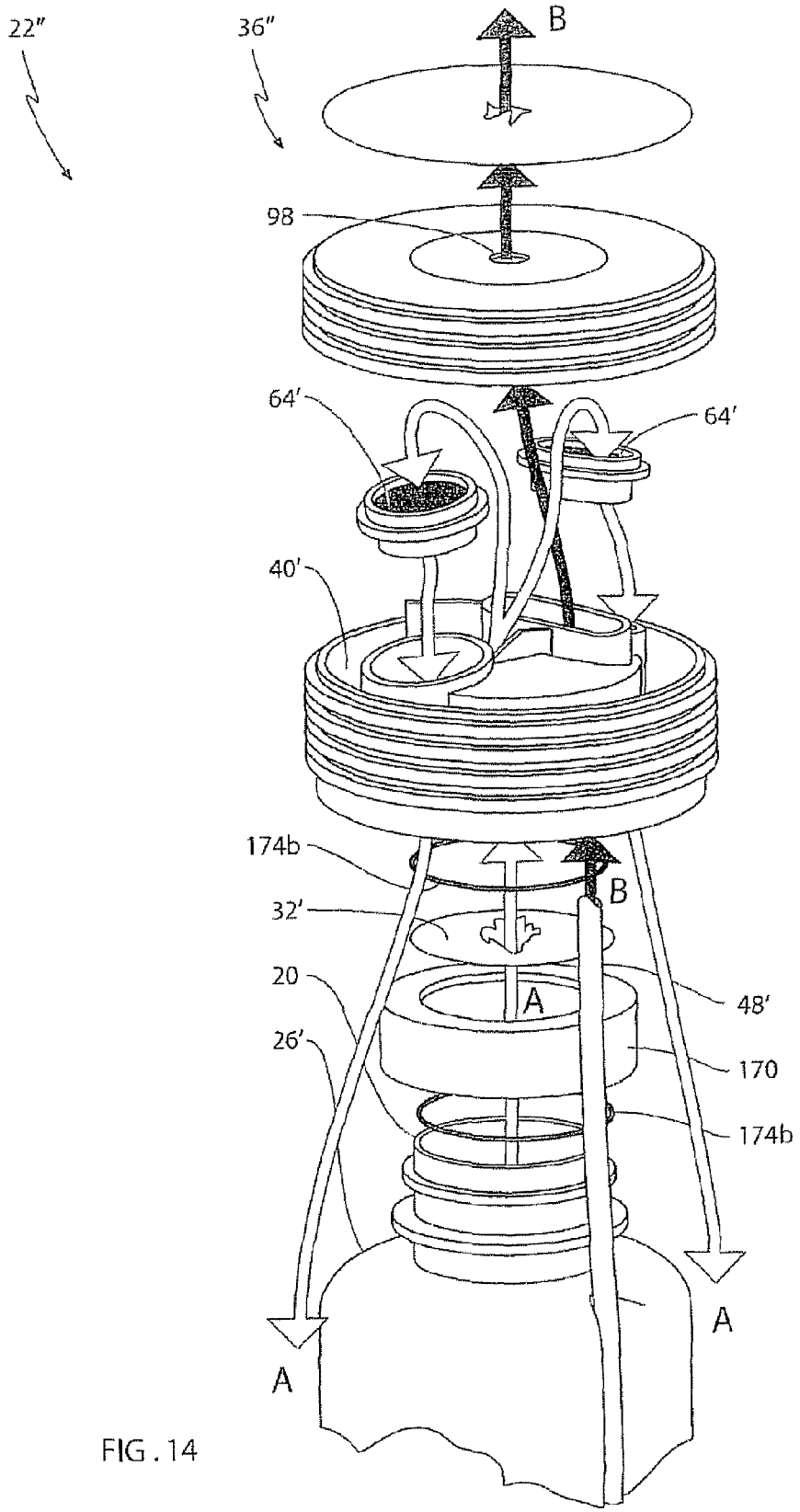
FIG. 14 is a perspective view of a pressure generating device.

FIG. 14 shows an exploded perspective view similar to FIG. 10C of the pressure generating device 22" including the canister 26", the lid 170 at the mouth 20 of the canister 26" and the cap part 36" which is mounted onto the lid 170.

Figure 15A:
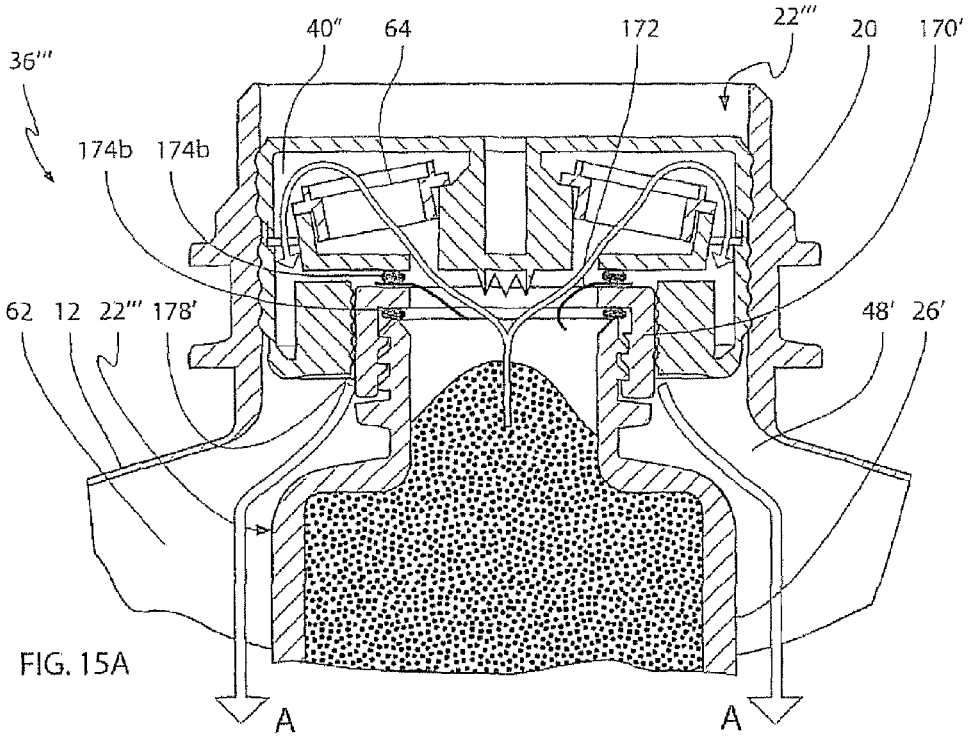
FIGS. 15A-15B are alternative embodiments of a pressure generating device.

FIG. 15A shows an alternative embodiment of a pressure generating device 22''', similar to the previous embodiment of the pressure generating device 22", however, in which the capillary pipe 178' is formed between the cap part 36''' and the lid 170'. The capillary pipe 178' may e.g. be formed as a helical groove along the outer circumferential surface of the lid 170' and/or the corresponding inner surface of the cap part 36'''.

Figure 15B:
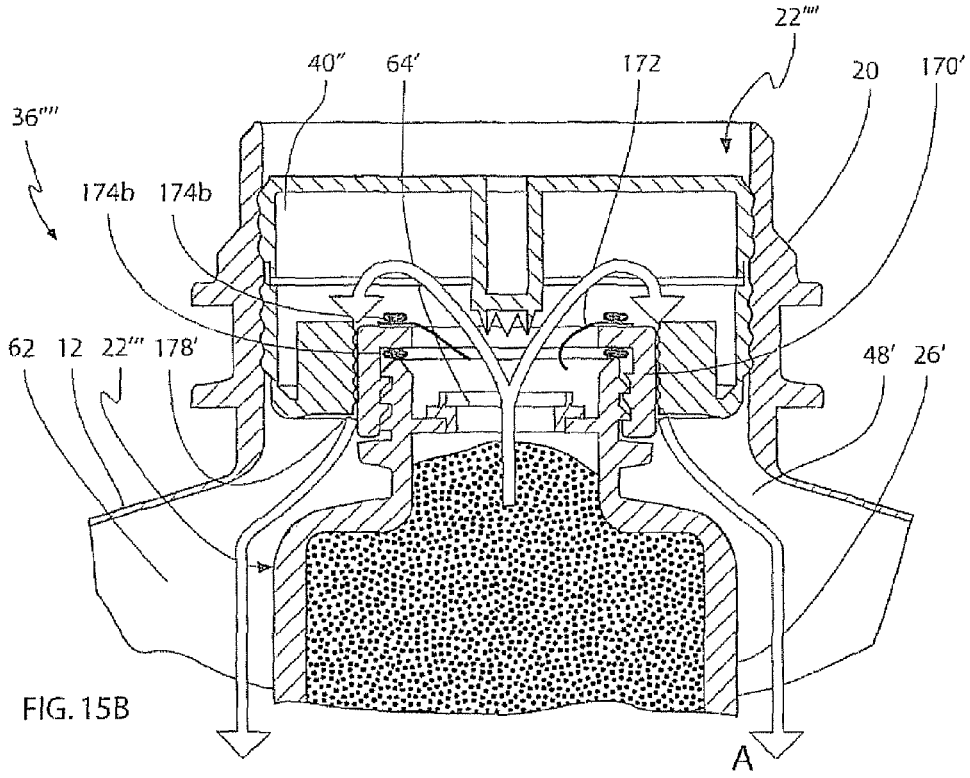

FIG. 15B shows yet an alternative embodiment of a pressure generating device 22'''', similar to the previous embodiment of the pressure generating device 22''' of FIG. 15A, however, in which the gas permeable membranes 64 have been omitted and the gas may flow directly from the interior of the canister 26" via the capillary pipes 178' formed between the cap part 36''' and the lid 170' into the head space of the beverage container. Optionally, a water impermeable, gas permeable membrane is located inside the canister neck part. The need for this membrane is depending on whether or not the beverage container is expected to be shaken or put upside down or not.

Figure 16:
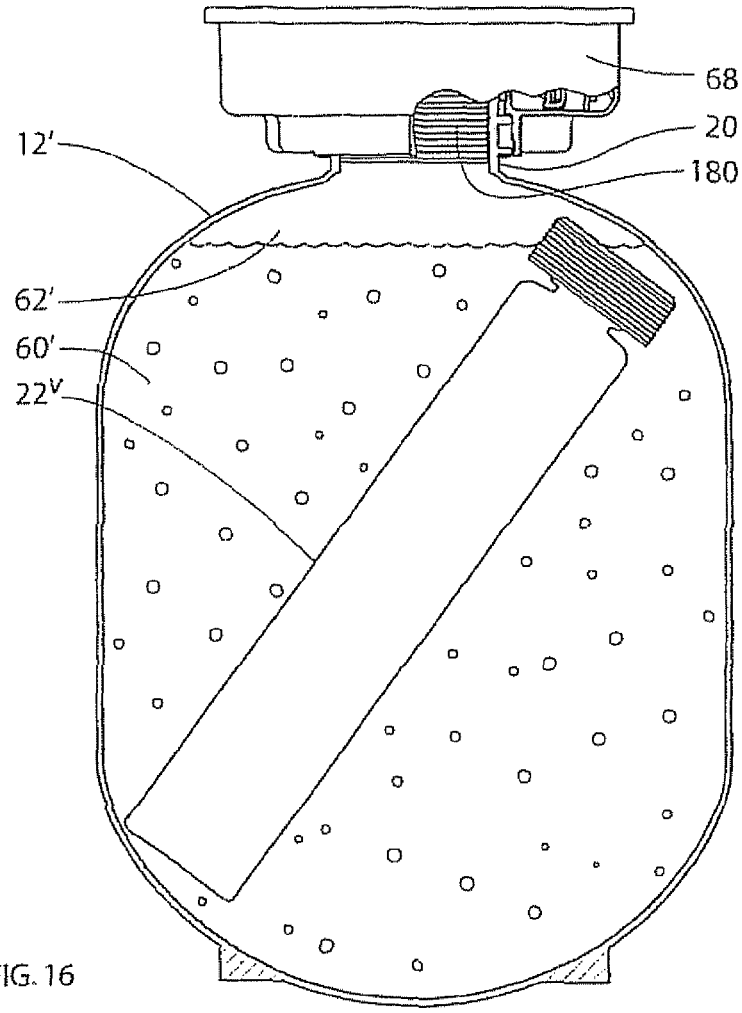
FIG. 16 is an alternative installation of a canister in a beverage container.

FIG. 16 shows a yet further embodiment of a pressure generating device $\mathbf{22}^{V}$ which is floating inside the beverage container 12'. The beverage container is closed off by a separate cap 180.

Figure 17B:
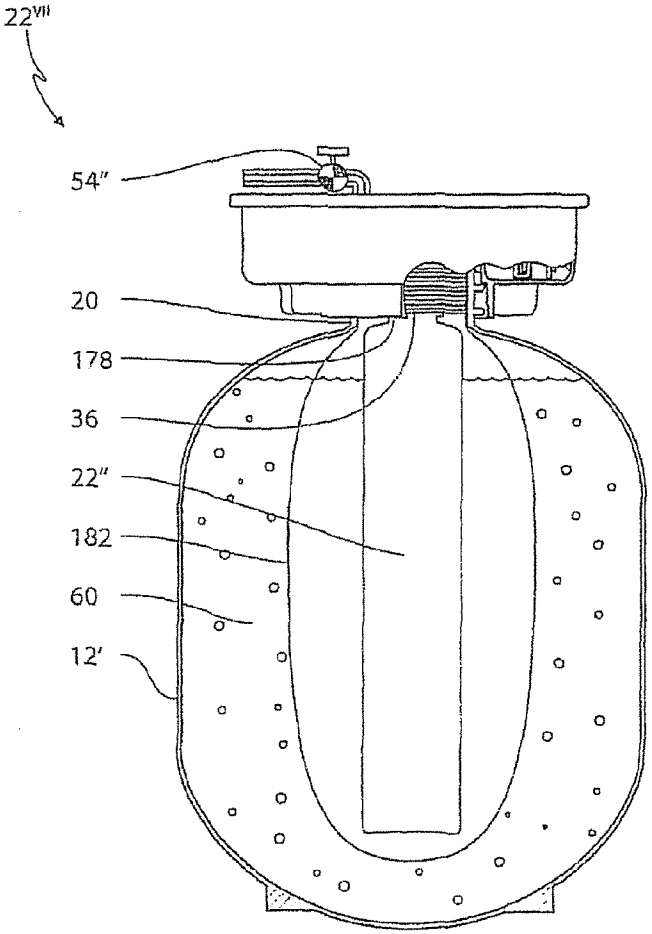
FIGS. 17A-17B show a yet further embodiment of a pressure generating device including a flexible bag.
Figure 17A:
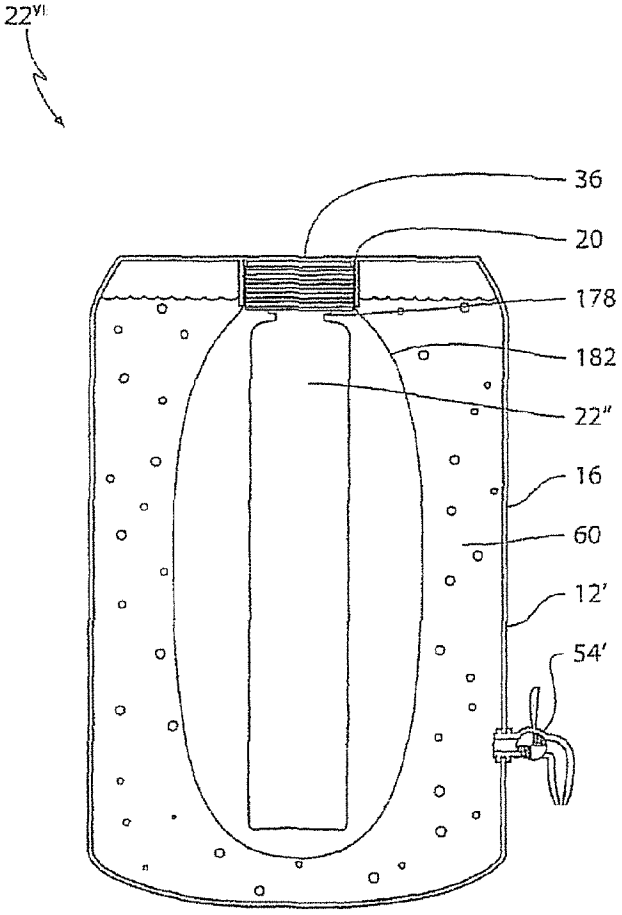

FIG. 17A shows a yet further embodiment of a pressure generating device $\mathbf{22}^{VI}$ similar to the previously presented pressure generating device 22" of FIG. 13F, together with a container 12'. The present embodiment additionally comprising a flexible bag 182 which is enclosing the pressure generating device 22". The flexible bag 182 is connected to the capillary pipe 178 of the pressure generating device $\mathbf{22}^{VI}$ and constitutes a gas and liquid proof bag, such as a bag of polymeric foil or preferably folded aluminum foil. The beverage 60 is stored outside the flexible bag 182 and fills the entire space outside the pressure generating device, i.e. no headspace is present. The flexible bag 182 is pressurized by the pressure generating device $\mathbf{22}^{VI}$. The container is sealed off by cap part 36 at the mouth 20 and the beverage is instead dispensed through a valve 54' located in the cylindrical wall 16 of the container 12. When the beverage 60 is dispensed though the dispensing valve 54', pressurized carbon dioxide will propagate from the canister 26 of the pressure generating device $\mathbf{22}^{VI}$ to the flexible bag 182. The flexible bag thus expands due to the pressure and keeps the beverage space pressurized. The bag 182 prevents any contact between the beverage 60 and the carbon dioxide. The present embodiment is therefore suitable together with non-carbonated beverages or beverage containing only a small amount of carbonization. Examples include beers which are pressurized by nitrogen instead of or in addition to carbon dioxide and non-beverages such as sprays, body lotion or the like.

FIG. 17B shows a yet further embodiment of a pressure generating device $\mathbf{22}^{VII}$ similar to the previously presented pressure generating device $\mathbf{22}^{VI}$ of FIG. 17A, however, the beverage 60 is dispensed though a valve 54" located in the cap part 36, similar to the previous presented embodiments, e.g. of FIG. 14.

Figure 18C:
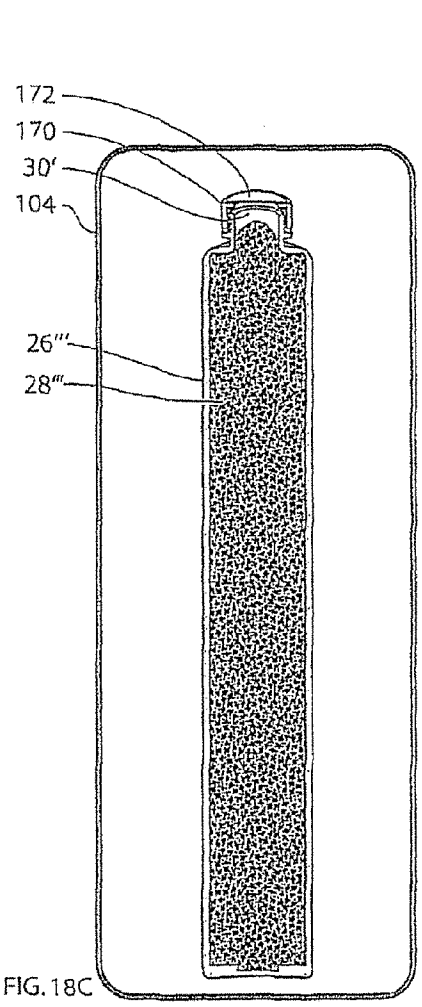
FIGS. 18A-18G are a series showing presently preferred steps of filling a canister with carbon dioxide.
Figure 18B:
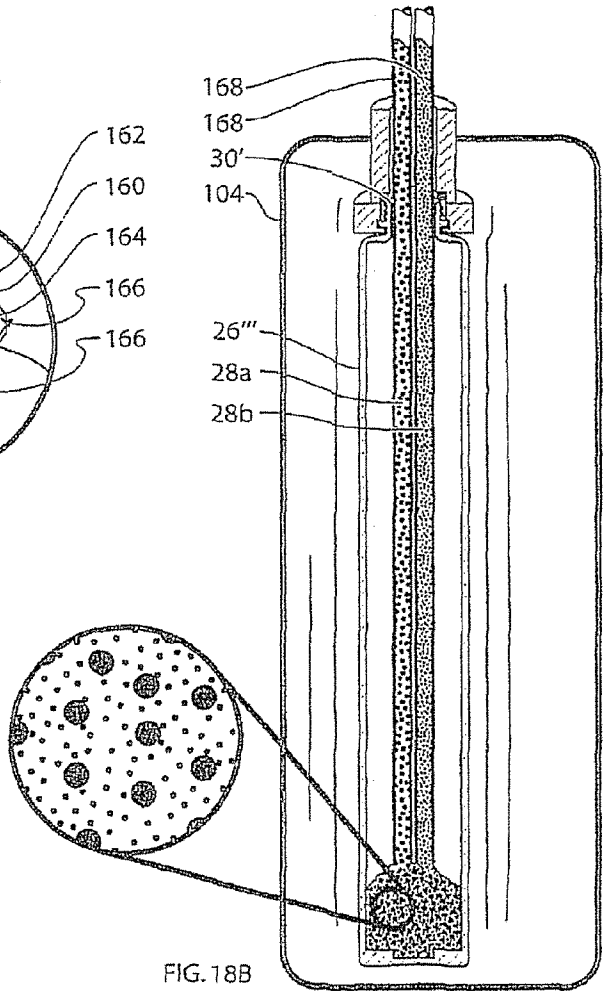
Figure 18A:
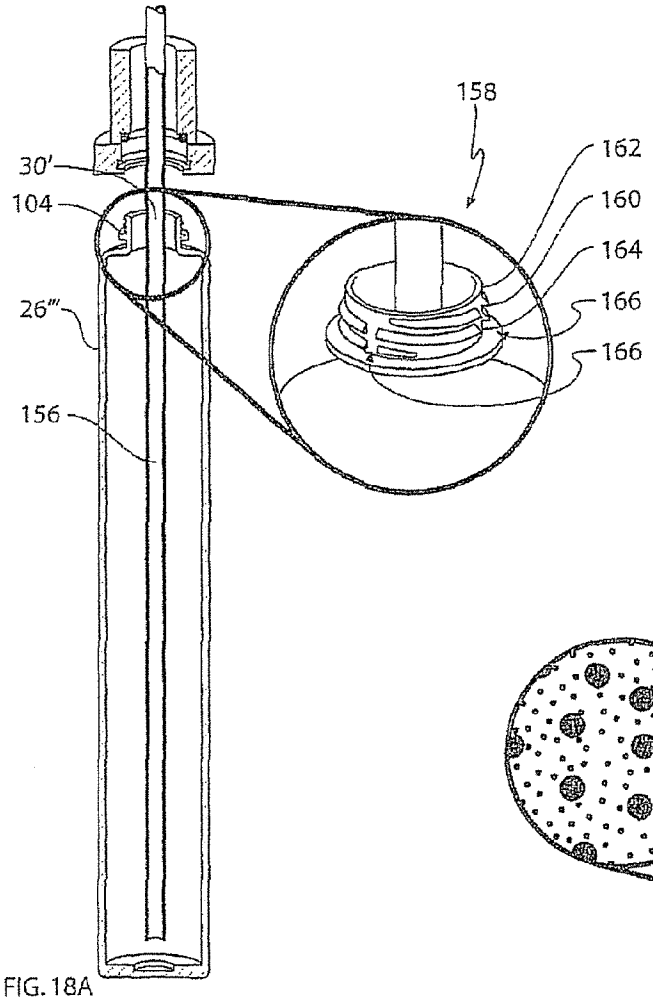

FIG. 18A shows an optional flushing of a canister 26''' by carbon dioxide. The canister 26''' is in principal identical to the previously presented canister 26". The cylindrical neck part 158 is shown in the close up view in connection with FIG. 13A. The cylindrical neck part 158 is subdivided into a lower neck portion 160 and an upper neck portion 162 and further comprises a screw thread 164 along the upper and lower neck portions 160, 162. The screw thread 164 is constituted by helical protrusions encircling the cylindrical neck 158 and which are interrupted at certain locations to form straight passages or pressure relief vents 166 though the screw thread 164 between the upper neck portion 164 and the lower neck portion 160. The flushing by carbon dioxide is performed in order to flush out any oxygen possibly remaining inside the canister 26'''. The flushing is performed by introducing a flushing tube 156 through the opening 30' of the canister 26''' and flushing the interior of the canister 26''' by carbon dioxide.

FIG. 18B shows the introduction of activated carbon into the canister similar to the filling described in connection with FIG. 6*b*. The activated carbon, constituting the adsorption material, is filled into the canister 26''' by introducing a dual filling tube 168 through the opening 30'. The dual filling tube 168 supplies two sorts of activated carbon 28*a* and 28*b*, differing in the size of granulates. The granulates 28*b* have in the present context about 10 times greater volume than the granulates 28*a*. This can be seen in detail in the close up view in connection with FIG. 13B. The purpose of filling with two different sizes of the granulates 28*a* and 28*b* is to achieve a higher density of activated carbon in the canister 26''' than would be obtainable by using granulates of the larger size only, since by using large granulates 28*b* only would yield large unfilled spaces between the individual granulates. By also filling by small size granulates 28*a* these spaces between the large granulates are filled by the small granulates. The applicant has obtained a density of activated carbon inside the canister of 0.54 kg/liter by using granulates of two different sizes compared to a density of 0.45 kg/liter by using large granulates only. The canister26''' is optionally kept within a filling chamber which is indicated by the box. The filling chamber may include carbon dioxide at atmospheric pressure.

Prior to being introduced into the canister, the activated carbon may be treated to remove any oxygen and/or water molecules which may have been adsorbed during storage and handling. The treatment comprises heating the activated carbon in an oxygen free environment to a temperature of about 20° C.-50° C. in order to desorb any oxygen and/or water molecules.

FIG. 18C shows the canister 26''' onto which a lid 170 has been loosely applied onto the cylindrical neck part 158 by screwing the lid 170 by e.g. half a turn to mutually engage the screw threads of the lid and the cylindrical neck. The lid has a piercable membrane 172 at the top made of e.g. aluminium. The canister 26''' is thereby assembled but not filled by carbon dioxide.

Figure 18D:
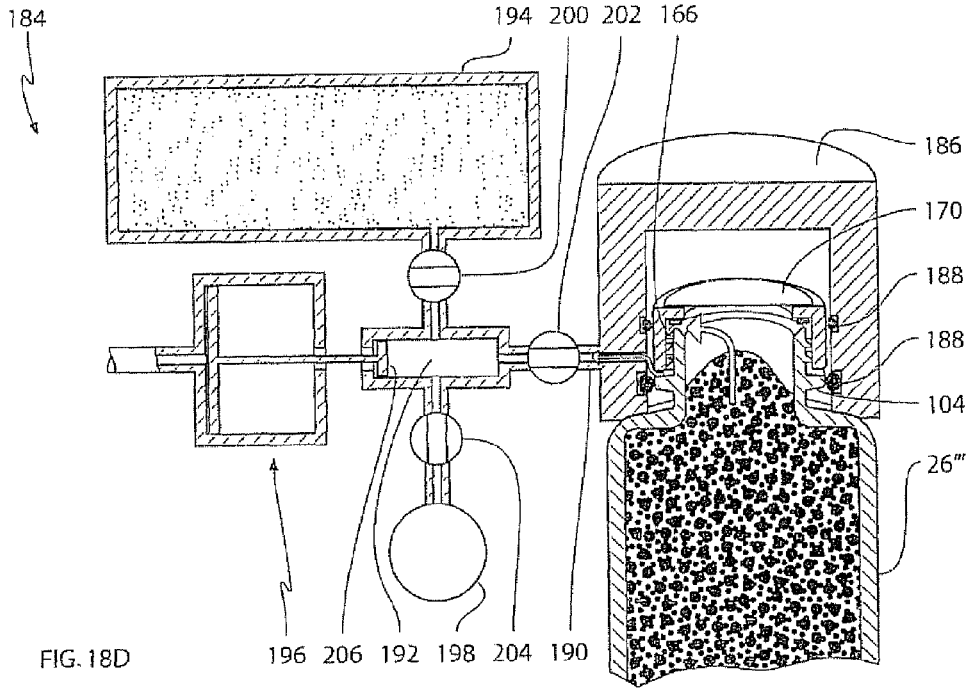

FIG. 18D shows the removal of any residual gases from the canister 26''' by using a carbon dioxide filling system 184. The canister 26''' is mounted onto a filling head 186 of the carbon dioxide filling system 184 such that a conduit 190 of the filling head 186 is located adjacent the transition between the lid 170 and the rim 104 of the canister 26'''. Seals 170 seal the lid 170 and the rim 104 of the canister 26''' to the filling head 186. The conduit 190 leads to a cylindrical chamber 192 having a predetermined volume of 37 ml. The chamber 192 is further connected to vacuum 198 and to a tank 194 including liquid $CO_2$. A first valve 200, a second valve 202 and a third valve 204 connects the chamber 192 selectively to the tank 194 of liquid $CO_2$, the conduit 190 of the filling head 186 and the vacuum 198, respectively. The carbon dioxide filling system 184 further comprises a piston mechanism 196 connected to the chamber 192. The piston 206 is movable fluid tight within the chamber 192 between a position adjacent the conduit 190 and a position opposite the conduit 190.

In order to evacuate all gases from the canister 26''', the piston is located opposite the conduit 190, the first valve 200 is closed and the second and third valves 202 204 are opened. In this way the interior of the canister 26''' is connected to vacuum 198 via the conduit 190 and the pressure relief vents 166. At the same time the temperature in the canister 26''' will sink to about −80 degrees Celsius due to the quick degassing of the activated carbon. A dust filter may optionally be employed inside the canister in order to prevent any activated carbon to escape during the evacuation.

Figure 18E:
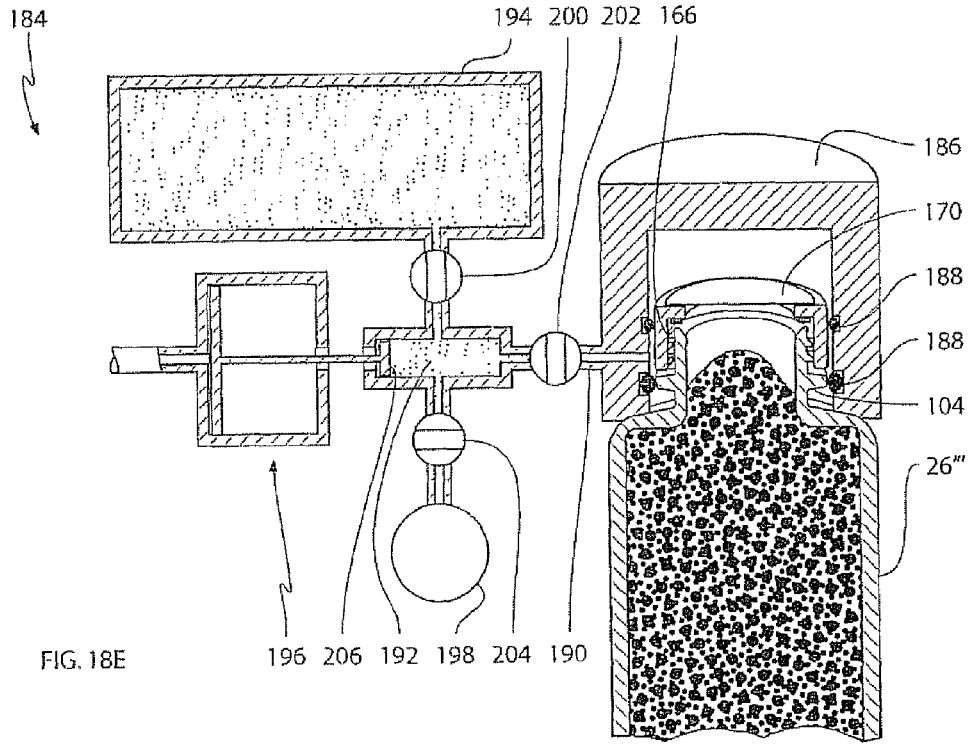

FIG. 18E shows the introduction of 37 ml of liquid $CO_2$ into the chamber 192. By opening the first valve 200 and at the same time closing both the second and third valves 202 204, the liquid $CO_2$ will pass into the chamber 198 and fill the entire chamber 198. In this way an amount of 37 ml of $CO_2$ may be determined. 37 ml of liquid $CO_2$ correspond to about 23 liters of gaseous $CO_2$ at room temperature.

Figure 18F:
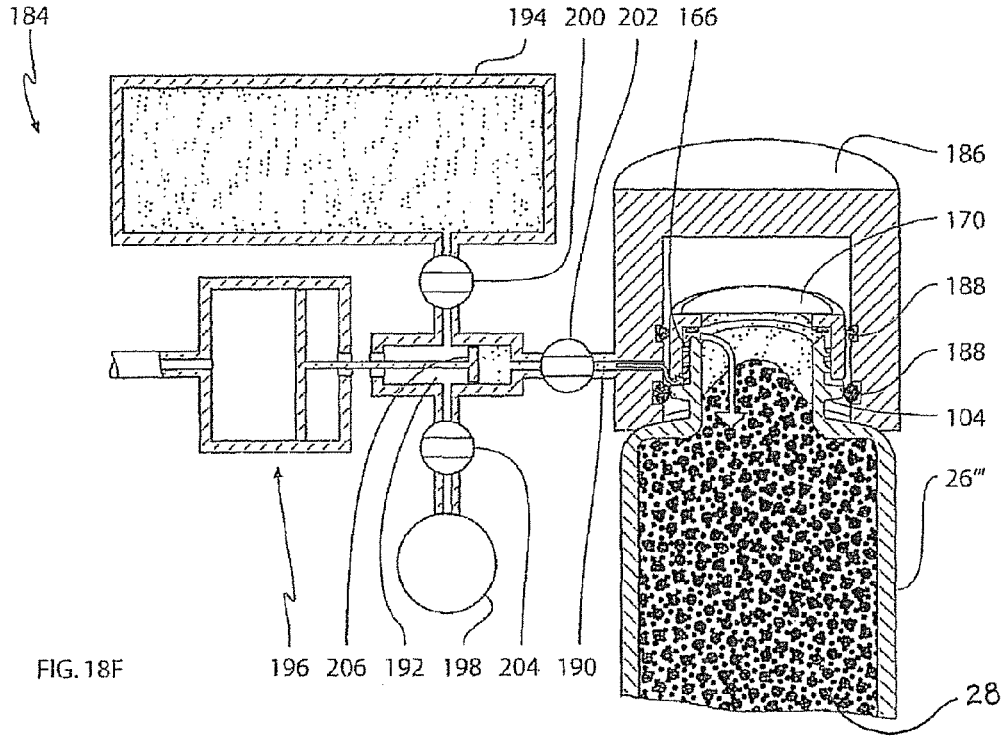
Figure 18G:
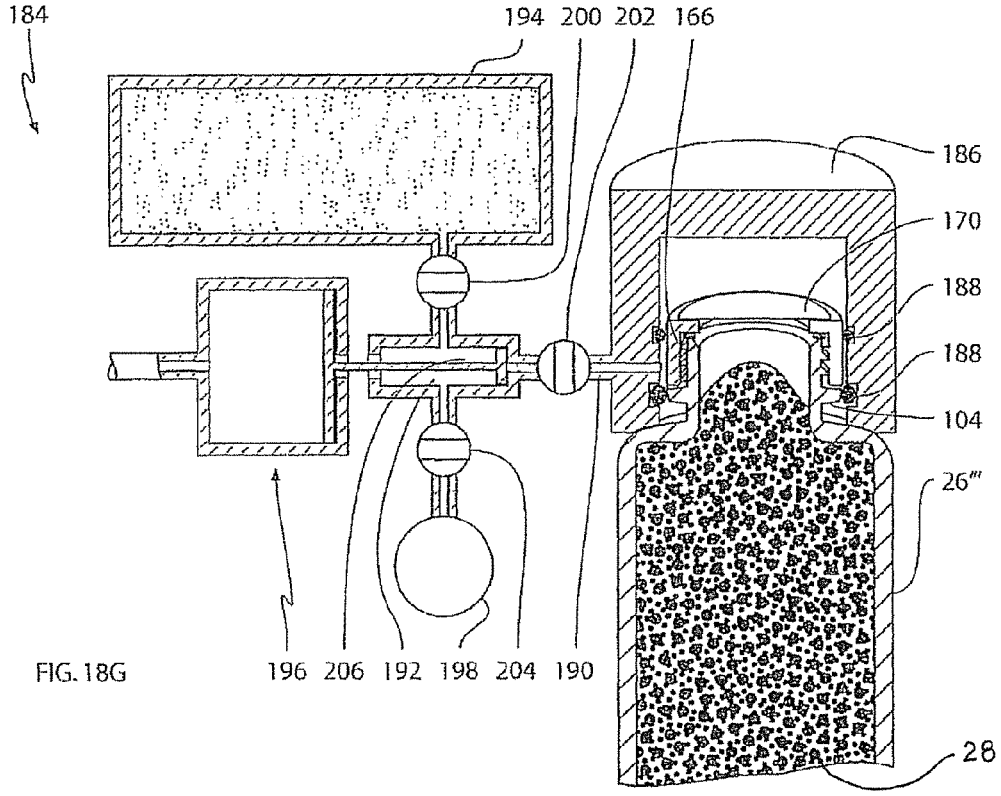
Figure 18H:
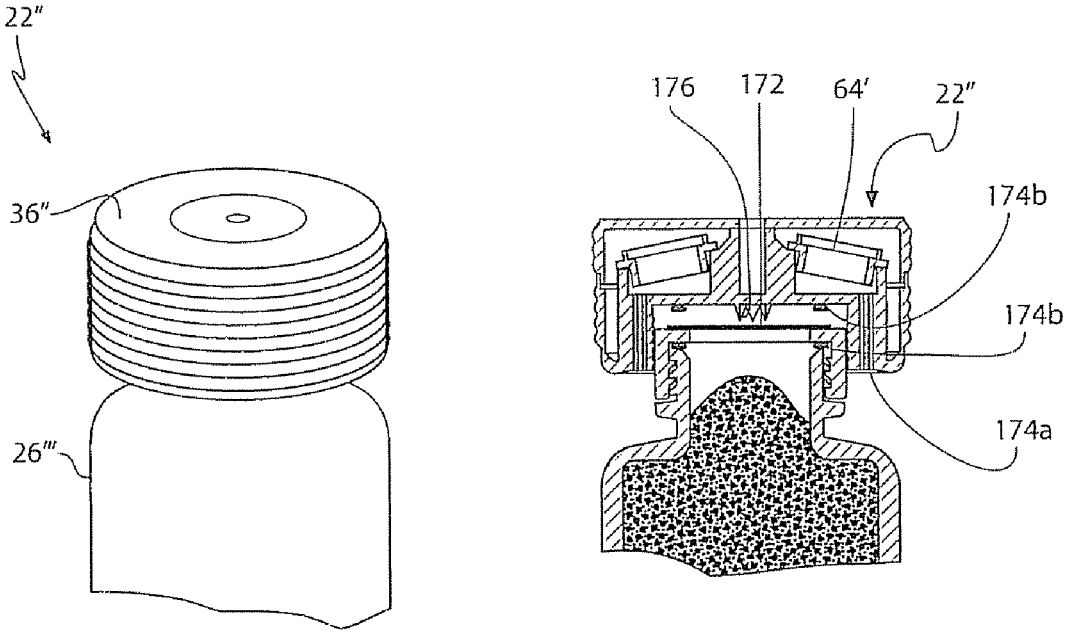

FIG. 18F shows the introduction of the content of the chamber 192 into the canister 26''' via the conduit 190 and the screw thread 166 as shown by the arrow. This is done by opening the second valve 202, closing the first and third valves 200, 204 and moving the piston 206 from an initial position opposite the conduit 190 to a position adjacent the conduit 190 by e.g. hydraulic or pneumatic power. The canister 192 should preferably be held at a low temperature, such as −40 to −50 degrees Celsius, during the filling. The liquid $CO_2$ is provided at a temperature of about −40 to −50 degrees Celsius and a pressure of at least above 5.11 bars. Please see FIG. 19 for the details.

When the liquid $CO_2$ enters the interior of the canister 26''' and contacts the activated carbon 28 inside the canister 26''', the activated carbon will vaporize and be adsorbed by the activated carbon. Since the activated carbon is held at a low temperature after evacuation, even as low as −80 degrees Celcius, the evaporation of the CO2 will not be instant upon contact with the activated carbon. Instead, some $CO_2$ will evaporate and become adsorbed by the activated carbon. The adsorption process generates heat, which is causing more of the liquid $CO_2$ to vaporize. The vaporization of the liquid $CO_2$ thus compensates for the heat produced during adsorption and thus a rapid adsorption may be achieved without any significant increase of the temperature of the activated carbon. Thus, the activated carbon is keep below the self destruction/self desorbing temperature without the need of any external cooling the activated carbon. It should be noted that no significant exchange of thermal energy between the activated carbon and the outside environment can take place due to the low thermal conductivity of carbon.

FIG. 18F shows the final step of filling the canister 26'''. In the final step, all of the valves 200, 202, 204 are closed and the lid 170 of the canister 26''' is closed and sealed by fastening the lid to the neck of the canister. When all of the liquid $CO_2$ has been adsorbed in the activated carbon, the pressure in the canister 26''' is about 2 bar and the temperature is about 20 degrees Celsius. Subsequently, the canister 26'''may be removed from the filling head 186.

Figure 19:
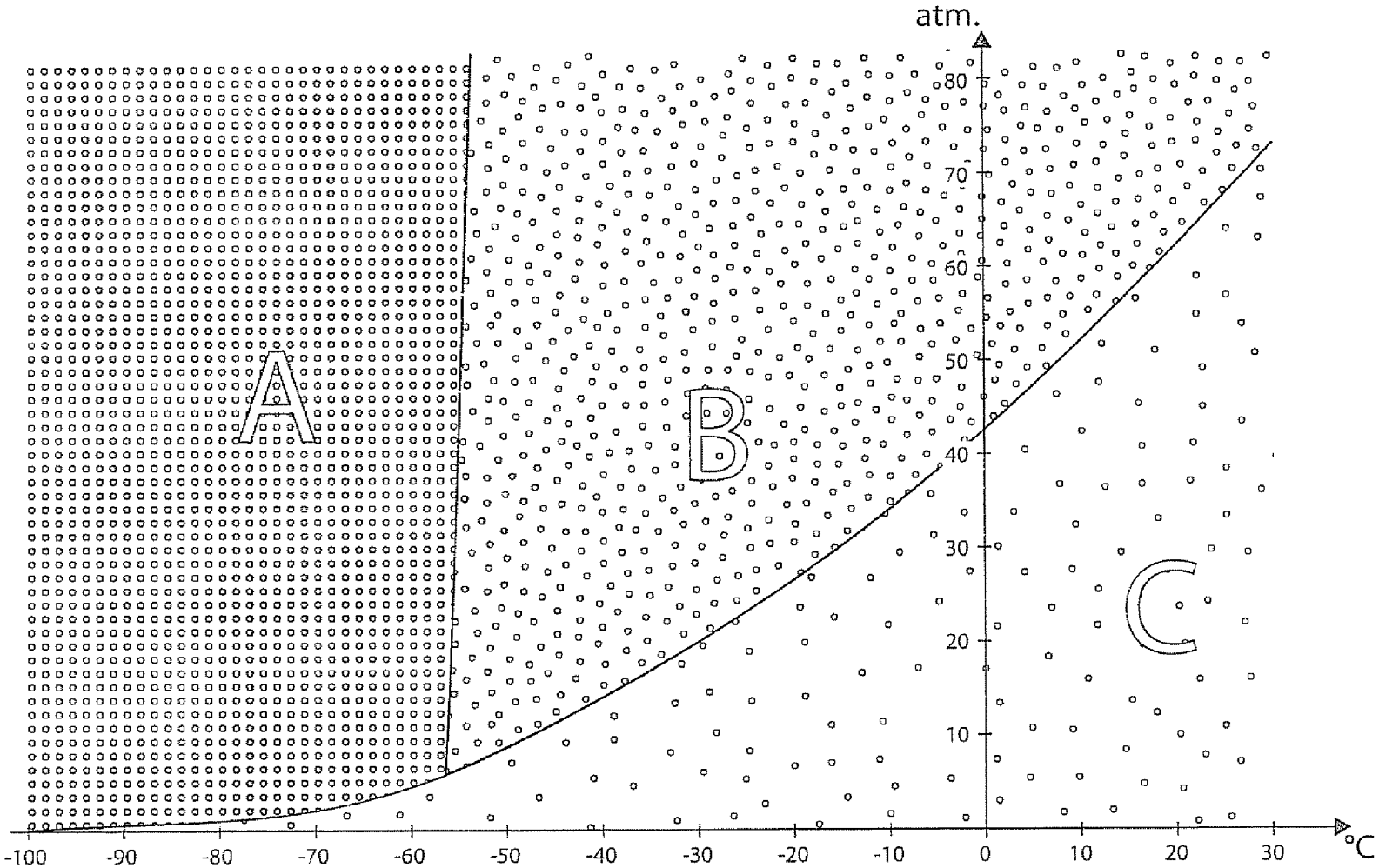
FIG. 19 is a plot showing a phase diagram for $CO_2$.
Figure 20:
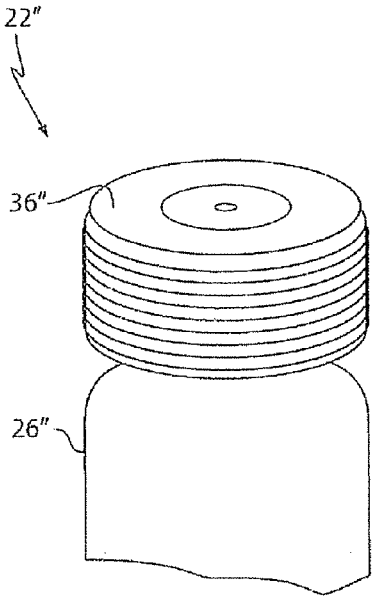
FIG. 20 is a partial perspective view of the pressure-generating device of FIGS. 13-E and 13F.
Figure 21:
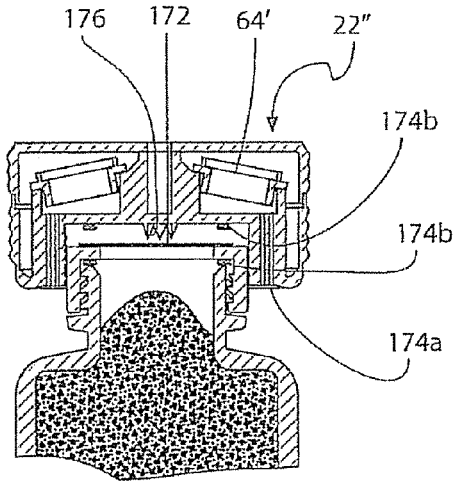
FIG. 21 is a detailed view of the cap structure shown in FIG. 13H.

FIG. 19 shows a plot of a phase diagram for $CO_2$. The ordinate axis represents the pressure in bar and the abscissa axis represents the temperature in degrees Celcius. The region designated A represents the temperature/pressure pairs in which $CO_2$ is in solid state, the region designated B represents the temperature/pressure pairs in which $CO_2$ is in liquid state and the region designated C represents the temperature/pressure pairs in which $CO_2$ is in gaseous state. The liquid $CO_2$ must thus be maintained at pressures and temperatures within the region B.

It is further contemplated that in a preferred embodiment of the pressure generating device as defined above, a small amount of oxygen scavenger is included. The oxygen scavenger is mixed together with the activated carbon in the canister, and preferably located near the opening of the canister. The purpose of the oxygen scavenger is to remove any oxygen possibly leaking into the canister during manufacture and handling. The amount of oxygen scavenger is in the range of 0.01-0.1% of the amount of activated carbon and due to the small amount the oxygen scavenger has not been illustrated. Suitable oxygen scavenger includes Fe-powder.

The applicant has performed proof of concept experiments and concluded that 68 g of activated carbon will be sufficient for properly dispensing 5 liters of carbonated beverage.

As an alternative mode of filling the canister of the pressure generating device by carbon dioxide, the technology disclosed in the applicants previous application EP2184259 may be utilized. In particular, the canister may include or be coupled to a $CO_2$ generating chemical system including two distinct chemical compounds for generating $CO_2$. The $CO_2$ generated when the two distinct chemical compounds are mixed is at least partially adsorbed by the activated carbon within the canister. The activation, i.e. the mixing of the two distinct chemical compounds may be performed either just prior to capping of the beverage container or by an activation mechanism to be operated by the user just prior to dispensing. A scavenger may be used to adsorb any excessive water used in connection with the CO2 generating chemical reaction.

It is obvious to a skilled person that various combination of the above embodiments may be contemplated.

Although the present invention has been described above with reference to specific embodiments, it is contemplated that numerous modifications may be deduced by a person having ordinary skill in the art and modification readily perceivable by a person having ordinary skill in the art is consequently to be construed as part of the present invention as defined in the appending claims.

Hereafter follows a list of parts with reference to the figures. One or more (') are used in order to distinguish alternative embodiments of the same part.

| List of parts: | |
|---|---|
| 10. | Beverage dispensing system |
| 12. | Beverage container |
| 14. | Bottom part of container |

-continued

| List of parts: | |
|---|---|
| 16. | Cylindrical wall of container |
| 18. | Shoulder part of container |
| 20. | Mouth part of container |
| 22. | Pressure-generating device |
| 24. | Dispensing device |
| 26. | Canister |
| 28. | Activated carbon |
| 30. | Opening |
| 32. | Burst membrane |
| 34. | Gas inlet |
| 36. | Cap part |
| 36a. | Upper cap part |
| 36b. | Lower cap part |
| 38. | Gas outlet |
| 40. | Outer chamber (first passage) |
| 42. | Circumferential wall |
| 44. | Piercing element |
| 46. | Knob |
| 48. | Dispensing line |
| 50. | Channel |
| 52. | First passage |
| 54. | Dispensing valve |
| 56. | Tapping handle |
| 58. | Spout |
| 60. | Beverage |
| 62. | Headspace |
| 64. | Gas-permeable membrane |
| 66. | Beverage glass |
| 68. | Base part |
| 70. | Support |
| 72. | Actuation member |
| 74. | Hood |
| 76. | Aperture |
| 78. | Small O-ring |
| 80. | Large O-ring |
| 82. | Connecting part |
| 84. | First projection |
| 86. | Fork |
| 88. | Second projection |
| 90. | Steps |
| 92. | Dispensing line part |
| 94. | Connector |
| 96. | Pierceable membrane |
| 98. | Hole |
| 100. | Inner chamber (second passage) |
| 102. | Sealing lips |
| 104. | Rim |
| 106. | Filling nozzle |
| 108. | Folds |
| 110. | Filling pipe |
| 112. | Pressure nozzle |
| 114. | Circumferential flange |
| 116. | Rod |
| 118. | Plug |
| 120. | Intermediate space |
| 122. | Flexible valve part |
| 124. | Handle assembly |
| 126. | Axle |
| 128. | Actuating part |
| 130. | Needle |
| 132. | Valve connector |
| 134. | Longitudinal wall |
| 136. | Spout tip |
| 138. | Capillary flow passages (a, b, c) |
| 140. | Inner spout wall |
| 142. | Stop |
| 144. | Ventilation opening |
| 146. | Grip |
| 148. | Heat sensitive ink |

-continued

| List of parts: | |
|---|---|
| 150. | Window |
| 152. | Non-heat sensitive ink |
| 154. | Base |
| 156. | Flushing tube |
| 158. | Cylindrical neck part |
| 160. | Screw thread |
| 162. | Upper neck portion |
| 164. | Lower neck portion |
| 166. | Pressure relief vents |
| 168. | Dual filling pipe |
| 170. | Lid |
| 172. | Piercable membrane |
| 174. | Sealing ring |
| 176. | Piercing mechanism |
| 178. | Capillary pipe |
| 180. | Separate cap |
| 182. | Flexible bag |
| 184. | CO2 filling system |
| 186. | Filling head |
| 188. | Seal |
| 190. | Conduit |
| 192. | Chamber |
| 194. | Liquid CO2 tank |
| 196. | Piston mechanism |
| 198. | Vacuum |
| 200. | First valve |
| 202. | Second valve |
| 204. | Third valve |
| 206. | Piston |

1.st Set of Points Characterizing the Present Invention:

1. A method of introducing a canister into a beverage container, said beverage container defining:
   an opening defining a first perimeter,
   an opposing wall portion of said container located opposite said opening,
   a length between said opening and said opposing wall portion, and
   a second perimeter within said container and transversal to said length, said second perimeter being larger than said first perimeter, said canister defining:
   a bottom surface,
   an opposite top surface, and
   a cylindrical surface interconnecting said bottom surface and said top surface, said cylindrical surface defining a height between said top surface and said bottom surface, said height initially being larger than said length, said cylindrical surface defining a third perimeter being transversal to said height and being smaller than or equal to said first perimeter, said cylindrical surface comprising an inwardly oriented fold extending along at least a part of said height, said canister being filled with a flowable and substantially non-compressible material, said method comprising performing the steps of
   i) providing said canister and said beverage container,
   ii) inserting said canister into said beverage container in a non-inverted orientation via said opening of said beverage container,
   iii) juxtaposing said bottom surface of said canister and said opposing wall portion of said container,
   iv) subjecting said top surface of said canister to a force directed towards said bottom surface, said force causing a reformation of said canister while the volume of said canister is substantially maintained, said reformation substantially simultaneously comprising:
   reducing said height to less than said length, relocating said flowable and substantially non-compressible material, and unfolding said fold of said cylindrical surface, thereby expanding said third perimeter to exceed said first perimeter but not to exceed said second perimeter.

2. The method according to point 1, wherein said flowable material is constituted by granulates of activated carbon.
3. The method according to any of the preceding points, wherein said canister is made of polymeric material.
4. The method according to point 3, wherein said canister is made of PE or HDPE.
5. The method according to any of the preceding points, wherein said force is between 10N and 100 kN, such as between 100N and 10 kN and typically 1 kN.
6. The method according to any of the preceding points, wherein in step iv) said height is reduced by at least 10%, such as at least 20%, preferably at least 30%, more preferably at least 40% and most preferably at least 50%.
7. The method according to any of the preceding points, wherein said length is between 0.1 m and 1 m, typically between 0.2 m and 0.6 m, such as between 0.3 m and 0.5 m.
8. The method according to any of the preceding points, wherein said first perimeter defines a diameter being between 1 cm and 10 cm, such as between 2 cm and 8 cm, typically between 3 cm and 5 cm.
9. The method according to any of the preceding points, wherein said second perimeter defines a diameter being between 0.5 and 1.5 times said length, or typically between 0.75 and 1 times said length.
10. The method according to any of the preceding points, wherein said cylindrical surface comprises one or more further inwardly oriented folds extending along at least a part of said height.
11. The method according to any of the preceding points, wherein said canister further comprises a cap for sealing said opening
12. The method according to point 11, wherein said cap and said opening comprise mutually engaging protrusions.
13. The method according to any of the preceding points, wherein said method is performed in a chamber subjected to an elevated gas pressure.
14. A container assembly comprising a canister and a beverage container, said beverage container defining:

an opening defining a first perimeter, an opposing wall portion of said container located opposite said opening, a length between said opening and said opposing wall portion, and a second perimeter within said container and transversal to said length, said second perimeter being larger than said first perimeter, said canister defining:

a bottom surface, an opposite top surface, and a cylindrical surface interconnecting said bottom surface and said top surface, said cylindrical surface defining a height between said top surface and said bottom surface, said height being smaller than said length, said cylindrical surface defining a third perimeter being transversal to said height and being larger than said first perimeter, said canister being filled with a flowable and substantially non-compressible material, said canister originating from a process in which:

i) said canister has been inserted into said beverage container in a non-inverted orientation via said opening of said beverage container, ii) said bottom surface of said canister has been juxtaposing said opposing wall portion of said container, and iii) said top surface of said canister has been subjected to a force directed towards said bottom surface, said canister has been reformed while the volume of said canister has been substantially maintained, in which reformation substantially simultaneously:

said height has been reduced to less than said length, said flowable and substantially non-compressible material has been relocated, and a fold of said cylindrical surface has been unfolded, thereby expanding said third perimeter to exceed said first perimeter but not to exceed said second perimeter.

15. A canister for use in a container assembly comprising said canister and a beverage container, said beverage container defining:

an opening defining a first perimeter an opposing wall portion of said container located opposite said opening, a length between said opening and said opposing wall portion, and a second perimeter within said container and transversal to said length, said second perimeter being larger than said first perimeter, said canister defining:

a bottom surface, an opposite top surface, and a cylindrical surface interconnecting said bottom surface and said top surface, said cylindrical surface defining a height between said top surface and said bottom surface, said height being larger than said length, said cylindrical surface defining a third perimeter being transversal to said height and being smaller than or equal to said first perimeter, said cylindrical surface comprising an inwardly oriented fold extending along at least a part of said height, said canister being filled with a flowable and substantially non-compressible material, said canister being suitable for a process in which:

i) said canister being inserted into said beverage container in a non-inverted orientation via said opening of said beverage container, ii) said bottom surface of said canister being juxtaposing said opposing wall portion of said container, and iii) said top surface of said canister being subjected to a force directed towards said bottom surface, said canister being reformed while the volume of said canister has been substantially maintained, in which reformation substantially simultaneously:

a) said height being reduced to less than said length, b) said flowable and substantially non-compressible material being relocated, and c) said fold of said cylindrical surface being unfolded, thereby expanding said third perimeter to exceed said first perimeter but not to exceed said second perimeter.

2nd set of points characterizing the present invention:

1. A method of filling a canister with propellant gas by performing the following steps:

providing a canister having a specific volume filled with activated carbon, said activated carbon having a first temperature, causing said activated carbon to adsorb a first amount of propellant gas while allowing said activated carbon to assume a second temperature, said second temperature being higher than said first temperature, allowing said activated carbon to cool to a third temperature, said third temperature being lower than said second temperature, and causing said activated carbon to adsorb a second amount of propellant gas while allowing said activated carbon to assume a fourth temperature, said fourth temperature being higher than said third temperature, said second and fourth temperatures being below the self-destruction or self-desorption temperature of said activated carbon.

2. The method according to point 1, wherein said first and third temperatures are substantially equal to room temperature or less.
3. The method according to any of the preceding points, wherein each of said first and second amount of $CO_2$ corresponds to a gas volume at atmospheric pressure which exceeds the specific volume of said activated carbon by at least a factor 5, preferably a factor 10.
4. The method according to any of the preceding points, wherein said canister further comprises a specific quantity of an oxygen scavenger.
5. The method according to point 4, wherein said oxygen scavenger comprises Fe-powder.
6. The method according to point 5, wherein said Fe-powder amounts to 0.01-0.1% by weight of said activated carbon.
7. The method according to any of the points 4-5, wherein said oxygen scavenger is located at an opening of said canister.
8. The method according to any of the preceding points, wherein said canister is sealed when said canister is allowed to cool to said third temperature.
9. The method according to any of the preceding points, wherein said canister is cooled by being rested for a specific long time in a temperature above 0 C, or, alternatively, wherein said canister is cooled by being rested for a specific short time in a temperature equal to or less than 0 C.
10. The method according to any of the preceding points, wherein said canister has an opening being sealed by a burstable membrane.
11. The method according to any of the preceding points, wherein said first and second amounts of propellant gas are substantially equal.
12. The method according to any of the preceding points, wherein said propellant gas is constituted by $CO_2$.
13. The method according to any of the preceding points, wherein said canister has an absolute pressure of between 1-4 bar, such as 3 bar, before adsorbing said second amount of propellant gas and an absolute pressure of between 4-8 bar, such as 6 bar, after adsorbing said second amount of propellant gas.
14. The method according to any of the preceding points, wherein said first and second amount of propellant gas is adsorbed by said activated carbon during a time period not exceeding 10 seconds, preferably not exceeding 5 second.
15. A canister filled with a specific volume of activated carbon, said specific volume exceeding the volume which can be filled in a single filling step, said canister being provided at a first temperature constituting room temperature or below, said canister has been filled in two filling steps in which in a first step said activated carbon having adsorbed a first amount of propellant gas at a filling pressure of between 1-4 bar, and in a second step said specific volume of activated carbon having adsorbed a second amount of propellant gas at a filling pressure of between 4-8 bar while said activated carbon is allowed to assume a second temperature, said second temperature being higher than said first temperature while not exceeding the self-destruction or self-desorption temperature of said activated carbon.

3rd set of points characterizing the present invention:

1. A container assembly comprising:
   a beverage container for containing a beverage, preferably a carbonated beverage, said beverage establishing a head space and a beverage space within said container,
   a canister located within said beverage container and defining an inner space for containing propellant gas under an elevated pressure, and
   a cap sealing off both said beverage container and said canister, said cap comprising a first fluid passage for allowing a propellant gas flow from said inner space of said canister to said head space of said beverage container and a second fluid passage allowing a beverage flow from said beverage space of said beverage container to the outside of said beverage container, said first passage and said second passage being separated.
2. The container assembly according to point 1, wherein said cap comprises an outer wall, an inner wall and a circumferential wall interconnecting said outer and inner walls, said circumferential wall sealing against said beverage container and said inner wall sealing against said canister.
3. The container assembly according to any of the preceding points, wherein said cap further comprises an activation mechanism, said activation mechanism defining a non-activated state in which said first flow passage and/or said second flow passage is closed off, and, an activated state in which said first flow passage and/or said second flow passage is open.
4. The container assembly according to point 3, wherein said activation mechanism includes:
   a piercable membrane sealing off said first fluid passage and/or said second fluid passage, and
   a piercing member for piercing said piercable membrane, said piercing member being in said non-activated state distant to said piercing membrane and said piercing member being in said activated state in a position in which said piercable membrane is pierced by said piercing member, said piercable membrane being positioned either in said cap or alternatively in said canister.
5. The container assembly according to any of the preceding points, wherein said propellant gas is constituted by carbon dioxide.
6. The container assembly according to any of the preceding points, further including a dispensing valve either within or downstream said second fluid passage, said dispensing valve being operable between a non-dispensing position preventing beverage dispensing via said second passage and a dispensing position allowing beverage dispensing via said second passage.
7. The container assembly according to any of the preceding points, wherein said cap part comprises a centrally located inner chamber establishing at least a part of said second fluid passage and an outer chamber at least partially enclosing said inner chamber and establishing said first fluid passage.
8. The container assembly according to any of the preceding points, wherein said cap part further includes a gas permeable membrane for preventing liquid flowing from said beverage space of said container to said inner space of said canister via said first fluid passage.
9. The container assembly according to any of the preceding points, wherein said first passage and/or said second passage is connected to a pipe which is extending into said head space and/or beverage space, respectively.

10. The container assembly according to point 8, wherein said gas permeable membrane defines a liquid barrier of at least 70 mN/m and a gas permeability of more than 0.014 l/sec.bar.

11. The container assembly according to any of the preceding points, wherein said inner space of said canister further comprises activated carbon.

12. A method of dispensing beverage by providing a container assembly, said container assembly comprising:

a beverage container containing a beverage, said beverage establishing a head space and a beverage space within said container, a canister located within said beverage container and defining an inner space containing propellant gas under an elevated pressure, and a cap sealing off both said beverage container and said canister, said cap comprising a first fluid passage for allowing a propellant gas flow from said inner space of said canister to said head space of said beverage container and a second fluid passage allowing a beverage flow from said beverage space of said beverage container to the outside of said beverage container, said first passage and said second passage being separated, said method comprising the steps of:

transporting a stream of propellant gas from said inner space of said canister to said head space of said beverage container via said first fluid passage, and transporting a stream of beverage from said beverage space of said beverage container to the outside of said beverage container via said second fluid passage.

13. A method of assembling a container assembly by performing the steps of:

providing a beverage container for containing a beverage, providing a canister defining an inner space, and providing a cap for sealing off both said beverage container and said canister, said cap comprising a first fluid passage and a second fluid passage, said first passage and said second passage being separated, establishing a head space and a beverage space within said beverage container by filling said beverage container with a first amount of beverage, filling said canister by a second amount of propellant gas under an elevated pressure, mounting said cap onto said canister, and mounting said cap onto said beverage container such that said canister is located within said beverage container, said first fluid passage is leading from said inner space of said canister to said head space of said beverage container and said second fluid passage is leading from said beverage space of said beverage container to the outside of said beverage container.

14. The method according to point 13, wherein said canister is sealed by a rupturable membrane after said filling.

15. A cap for sealing off both a beverage container and a canister, said beverage container containing a beverage for establishing a head space and a beverage space, said canister defining an inner space for containing propellant gas under an elevated pressure, said cap comprising a first fluid passage for allowing a propellant gas flow from said inner space of said canister to said head space of said beverage container and a second fluid passage allowing a beverage flow from said beverage space of said beverage container to the outside of said beverage container, said first passage and said second passage being separated.

4th set of points characterizing the present invention:

1. A spout for use in a beverage dispensing system, said spout defining an inlet for receiving beverage, preferably being a carbonated beverage, and an outlet for releasing said beverage, said outlet being located below said inlet when said spout is attached to said beverage dispensing system, said spout comprising one or more capillary flow passages extending between said inlet and said outlet, each of said one or more capillary flow passages defines:

a monotonically decreasing flow area from said inlet to said outlet, and a ventilation opening for allowing air to flow from the outside into said capillary flow passage.

2. The spout according to point 1, wherein said one or more capillary flow passages constitute at least one central capillary flow passage and at least one peripheral capillary flow passage outside of said central capillary flow passage.

3. The spout according to point 2, wherein said central capillary flow passage exhibits a smaller flow area than said peripheral capillary flow passage at any given distance between said inlet and said outlet and thereby provides a substantially flat or planar flow profile.

4. The spout according to any of the preceding points, wherein each capillary flow passage is established between two longitudinal wall parts extending between said inlet and said outlet and a transversal wall part extending between said two longitudinal wall parts.

5. The spout according to point 4, wherein each of said one or more flow passages defines a maximum distance between said first and second longitudinal walls of 1 to 5 mm, such as a maximum distance of 3 mm.

6. The spout according to point 4 or 5, wherein said transversal wall part defines a concave surface between upper ends of said longitudinal walls said first longitudinal wall and said second longitudinal wall.

7. The spout according to any of the preceding points, wherein said one or more ventilation openings of said one or more capillary flow passages constitute a single opening which is located at the lower side of said spout.

8. The spout according to any of the preceding points, wherein said ventilation opening extends between said inlet and said outlet.

9. The spout according to any of the preceding points, wherein said longitudinal walls converge towards a point at said outlet.

10. The spout according to any of the preceding points, wherein said spout is made of or at least has a coating of a material having an e-modulus (elastic modulus) of less than 3, such as in the range 0.5 to 3, preferably less than 0.1, more preferably less than 0.01, such as 0.002, said material most preferably being (poly(dimethylsiloxane)).

11. The spout according to any of the preceding points, wherein said spout is substantially transparent for allowing visual inspection of said one or more capillary flow passages from the outside.

12. A beverage dispensing system including the spout according to any of the points 1-11, said beverage dispensing system further including:

a beverage container for holding said beverage, a dispensing valve having a valve discharge opening being in fluid communication with said beverage container and having a beverage dispensing position for allowing flow of beverage through said dispensing valve and a non-beverage dispensing position for preventing flow of beverage through said dispensing valve, said inlet of said spout being in fluid communication with said valve discharge opening of said dispensing valve, and a dispensing handle for operating said dispensing valve between said beverage dispensing position and said non-beverage dispensing position.

13. The dispensing system according to point 12, wherein said inlet of said spout is located immediately downstream of a shut-off plug of said dispensing valve.
14. The dispensing system according to point 12 or 13, wherein said beverage is received in said inlet subjected to a pressure of at least 0.25 bar above atmospheric pressure, such as 0.5 to 5 bar, preferably between 1 bar and 3 bar, more preferably 2 bar.
15. A method of dispensing a beverage, preferably a carbonated beverage, said method comprising providing a beverage dispensing system according to any of the points 12-14 and performing the steps of:
    operating said handle from said non-beverage dispensing position to said beverage dispensing position,
    receiving a stream of beverage from said dispensing valve of said beverage dispensing system into said inlet of said spout,
    transporting said stream of beverage from said inlet of said spout, via said one or more capillary flow passages, to said outlet of said spout, by utilizing the capillary effect,
    releasing said stream of beverage at said outlet of said spout,
    operating said handle from said beverage dispensing position to said non-beverage dispensing position, and
    emptying said one or more capillary flow passages by utilizing the capillary effect for allowing substantial all residual beverage within said one or more capillary flow passages to be released at said outlet of said spout.

5th set of points characterizing the present invention:

1. A beverage container assembly comprising:
    a beverage container defining a top, an oppositely located bottom and a wall extending between said top and said bottom, said wall defining at least a visual inspection wall section, said beverage container having a beverage space for containing a beverage, and
    a temperature indicator located within said beverage container and at least partly extending into said beverage space, said temperature indicator being visible from the outside of said beverage container through said visual inspection wall section of said beverage container.
2. The beverage container assembly according to point 1, wherein said temperature indicator is capable of shifting between a first visual indication associated with a first temperature range and a second visual indication associated with a second temperature range.
3. The beverage container assembly according to point 2, wherein said first temperature range includes temperatures in which said beverage is non-suitable for consumption while said second temperature range includes temperatures in which said beverage is suitable for consumption.
4. The beverage container assembly according to any of the points 2-3, wherein said visual inspection wall section has a specific optical filter characteristic, said optical filter characteristic preventing transmission of light emitted by said first visual indication or alternatively said second visual indication, and, allowing transmission of light emitted by said second visual indication or alternatively said first visual indication, respectively.
5. The beverage container assembly according to any of the points 2-4, wherein said first visual indication constitutes a first color range and said second visual indication constitutes a second color range.
6. The beverage container assembly according to point 5, wherein said first color range corresponds to light wavelengths below 510 nm and said second color range corresponds to light wavelengths above 510 nm.
7. The beverage container assembly according to any of the preceding points, wherein said temperature indicator is a layer of a heat sensitive ink.
8. The beverage container assembly according to any of the preceding points, wherein said temperature indicator is applied at least partially covering said visual inspection wall section of said beverage container.
9. The beverage container assembly according to any of the preceding points, wherein said temperature indicator is completely enclosed within said beverage space.
10. The beverage container assembly according to any of the preceding points, wherein said temperature indicator is applied on a canister located within said beverage container, said canister extending at least partly into said beverage space.
11. The beverage container assembly according to point 10, wherein said canister is constituted by a canister filled with propellant gas such as $CO_2$.
12. The beverage container assembly according to any of the preceding points, wherein said visual inspection wall section extends at least from said top to said bottom of said beverage container.
13. The beverage container assembly according to any of the preceding points, wherein said temperature indicator is located near the bottom of said beverage container and said beverage space is located near the bottom of said beverage container.
14. The beverage container assembly according to any of the preceding points, wherein said visual inspection wall section or alternatively said canister is graduated and constitutes a measure of the volume of the beverage within the beverage space while allowing said temperature indicator to be visible from the outside of said beverage container.
15. A method of handling a beverage comprising providing a beverage container assembly, said beverage container assembly comprising:
    a beverage container defining a top, an oppositely located bottom and a wall extending between said top and said bottom, said wall defining at least a visual inspection wall section, said beverage container having a beverage space containing a beverage, and
    a temperature indicator located within said beverage container and extending at least partly into said beverage space, said temperature indicator being visible from the outside of said beverage container through said visual inspection wall section of said beverage container, said method comprising the steps of:
    providing said beverage container assembly at a first temperature,
    cooling said beverage container assembly to a second temperature,
    inspecting said temperature indicator from the outside of said beverage container, and
    dispensing at least a part of said beverage from said beverage container.

6th set of points characterizing the present invention:

1. A method of filling a canister with propellant gas by performing the following steps:
    providing a canister, said canister defining a body part and a cylindrical neck part, said body part defining an inner space, said cylindrical neck part defining an opening for allowing access to the inner space of said body part, an upper neck portion located adjacent said opening and a lower neck portion located adjacent said body part, said cylindrical neck part comprising a first screw thread encircling said cylindrical neck part along said upper neck portion and said lower neck portion, said canister further comprising a lid for sealing off said opening of said neck part, said lid defining a second screw thread for cooperating with said first screw thread of said neck part, said first screw thread and/or said second screw thread comprising a first and/or a second pressure relief vent, respectively, intersecting said first screw thread and/or said second screw thread, respectively, for allowing a gas flow through said first screw thread and/or said second screw thread when said lid is applied in a loose position to said cylindrical neck part, introducing a specific volume of adsorption material into said canister via said opening, said propellant gas being adsorbable in and releasable from said adsorption material, applying said lid onto said cylindrical neck part in said loose position by allowing said first and second screw threads to partly engage while maintaining gaseous communication between the inner space of said canister and the outside via said first and/or second pressure relief vents, establishing a specific temperature such as a temperature below room temperature within said adsorption material, causing said adsorption material to adsorb a specific amount of propellant gas by introducing said propellant gas though said first and/or second pressure relief vent and said opening, while allowing said adsorption material to be heated from said specific temperature to an elevated temperature, said elevated temperature being below the temperature at which said adsorption material is destructed, decomposed or destroyed, or, at which said adsorption material is desorbing said propellant gas to a substantial extent, and fastening said lid onto said neck part in a sealed position by allowing said first and second screw threads to engage further for causing said lid to seal said opening and preventing gaseous communication between the inner space of said canister and the outside.

2. The method according to any of the preceding points, wherein said adsoption material comprising a specific volume of granulates, said granulates including a first group of granulates and a second group of granulates, said first group including granulates of a first size and said second group including granulates of a second size, said first size being at least ten times greater than said second size.

3. The method according to point 2, wherein said specific volume of adsorption material within said canister defines a specific density of at least 0.45 kg/liter, preferably at least 0.50 kg/liter, most preferably 0.54 kg/liter.

4. The method according to any of the preceding points, wherein said canister defines a volume of between 0.1 and 5 liters, preferably between 0.2 and 1 liter, more preferably between 0.3 and 0.7 liters, such as 0.4 liters, 0.5 liters or 0.6 liters.

5. The method according to any of the preceding points, wherein said canister is made by rigid plastics, such as PET.

6. The method according to any of the preceding points, wherein said adsorption material is activated carbon and/or said propellant gas is carbon dioxide.

7. A pressure generating device comprising:

a carbonisation canister, said canister defining a body part and a cylindrical neck part, said body part defining an inner space, said cylindrical neck part defining an opening for allowing access to the inner space of said body part, an upper neck portion located adjacent said opening and a lower neck portion located adjacent said body part, said canister further comprising a lid for sealing off said opening of said neck part, and a cap part covering said lid of said canister, said cap part establishing a first fluid passage for allowing a propellant gas flow from said inner space of said canister to the outside of said pressure generating device, said first fluid passage including a hydrophobic labyrinth for preventing the ingress of liquid into said pressure generating device to any substantial extent.

8. The pressure generating device according to point 7, wherein said cap part comprising a second fluid passage allowing a beverage flow through said cap part, said first fluid passage and said second fluid passage being separated.

9. The pressure generating device according to any of the points 7-8, wherein said lid including a piercable water and gas impermeable membrane, said piercabel membrane of said lid initially being unpierced, said cap part including a piercing mechanism for piercing said piercable membrane and establishing said first fluid passage when said cap is pushed onto said lid, said piercable membrane preferably being made of aluminium.

10. The pressure generating device according to any of the points 7-9, wherein said hydrophobic labyrinth comprises one or more capillary pipes, said one or more capillary pipes preferably each having a diameter of less than 1000 microns, more preferably less than 100 microns, most preferably less than 10 microns.

11. The pressure generating device according to point 10, wherein said hydrophobic labyrinth is at least partially established by a groove or grooves along the outer circumferential surface of the lid and/or the corresponding inner surface of the cap part.

12. The pressure generating device according to any of the points 7-8, wherein said hydrophobic labyrinth further comprises a liquid impermeable and gas permeable membrane such as a GORE-TEX™ membrane or a similar membrane produced by another company.

13. The pressure generating device according to any of the points 7-11, wherein said hydrophobic labyrinth defines a liquid barrier of at least 70 mN/m and a gas permeability of more than 0.014 l/sec. bar.

14. The pressure generating device according to any of the points 7-13, further comprising any of the features of points 1-6

15. A self regulating and constant pressure maintaining beverage dispenser assembly comprising a dispensing device and a beverage container, said beverage container defining an inner space, said inner space constituting:

a beverage space filled with carbonated beverage and communicating with said dispensing device for allowing dispensation of said carbonated beverage, and a head space communicating with said beverage space and filled with $CO_2$ having an initial pressure of 0.1-3 bar above the atmospheric pressure when subjected to a specific temperature of 2° C.-50° C., preferably 3° C.-25° C. and more preferably 5° C.-15° C., said beverage dispenser assembly further comprising a pressure generating device according to any of the points 7-13, said cylindrical neck part of said canister comprising a first screw thread encircling said cylindrical neck part along said upper neck portion and said lower neck portion, said lid defining a second screw thread for cooperating with said first screw thread of said neck part, said first screw thread and/or said second screw thread comprising a first and/or a second pressure relief vent, respectively, intersecting said first screw thread and/or said second screw thread, respectively, for allowing a gas flow through said first screw thread and/or said second screw thread when said lid is applied in a loose position to said cylindrical neck part, said canister communicating with said head space via said hydrophobic labyrinth and comprising a particular amount of adsorption material having adsorbed a specific amount of $CO_2$, said particular amount of adsorption material being inherently capable of regulating the pressure in said head space and capable of preserving the carbonisation of said carbonated beverage in said beverage space by releasing $CO_2$ into said head space via said hydrophobic labyrinth or by adsorbing $CO_2$ from said head space via said hydrophobic labyrinth, said specific amount of $CO_2$ being sufficient for allowing said head space to increase in volume and substituting said beverage space when said carbonated beverage having said specific temperature is being dispensed from said container by using said dispensing device and maintaining said initial pressure, or at least a pressure of 0.1-3 bar above the atmospheric pressure in said head space during the complete substitution of said beverage space by said head space.

We claim:

1. A method of filling a canister with propellant gas, comprising:

(a) providing a canister having a specific volume filled with activated carbon having a first temperature, wherein the canister comprises:

a body part and a cylindrical neck part, the body part defining an inner space, the cylindrical neck part including (a) an opening configured for allowing access to the inner space of the body part, (b) an upper neck portion located adjacent the opening, (c) a lower neck portion located adjacent the body part, and (d) a first screw thread encircling the neck part along the upper neck portion and the lower neck portion;

a lid configured and located to seal off the opening of the neck part, the lid defining a second screw thread configured and located to cooperate with the first screw thread of the neck part, at least one of the first screw thread and the second screw thread including a pressure relief vent located and configured to allow a gas flow through at least one of the first screw thread and the second screw thread when the lid is applied in a loose position to the cylindrical neck part, the lid being configured to be applied initially onto the neck part in the loose position by allowing the first and second screw threads to partly engage while maintaining gaseous communication between the inner space of the canister and the outside via the pressure relief vent;

(b) providing a volume of liquefied propellant gas at a second temperature and a first elevated pressure preventing the liquefied propellant gas from evaporating;

(c) evacuating the canister to create a state of vacuum within the canister, thereby cooling the activated carbon to a third temperature lower than the second temperature;

(d) injecting the volume of liquefied propellant gas into the canister through the pressure relief vent at a second elevated pressure preventing the liquefied propellant gas from evaporating;

(e) allowing the liquefied propellant gas to evaporate, and, in doing so, consuming energy as evaporation heat, the energy being generated due to the propellant gas being adsorbed by the activated carbon, thereby reducing the heating of the activated carbon; and (f) fastening the lid onto the neck part in a sealed position by allowing the first and second screw threads to engage further for causing the lid to seal the opening and preventing gaseous communication between the inner space of the canister and the outside.

2. The method of claim 1, wherein the liquefied propellant gas is liquefied $CO_2$.

3. The method of claim 1, wherein the first temperature is between 0 and 500 degrees Celsius.

4. The method of claim 1, wherein the second temperature is between −57 and −20 degrees Celsius.

5. The method of claim 1, wherein the third temperature is between −50 and −100 degrees Celsius.

6. The method of claim 1, wherein the first elevated pressure and the second elevated pressure are between 5.11 bar and 80 bar absolute pressure.

7. The method of claim 1, wherein the canister defines a volume of between 0.1 and 5 liters.

8. The method of claim 1, wherein the volume of liquefied propellant gas is between 1 ml and 10 ml.

9. The method of claim 1, wherein the activated carbon comprises a specific volume of granulates, said granulates including a first group of granulates of a first size and a second group of granulates of a second size, the first size being at least ten times greater than the second size.

10. The method of claim 1, wherein the specific volume of activated carbon within the canister defines a specific density of at least 0.45 kg/liter.

11. The method of claim 1, wherein the canister is made of a rigid plastic.

12. The method of claim 1, wherein the volume of liquefied propellant gas corresponds to a gas volume at atmospheric pressure which exceeds the specific volume filled with activated carbon by at least a factor 5.

13. The method of claim 1, wherein the propellant gas is adsorbed by the activated carbon during a time period not exceeding 10 seconds.

14. The method of claim 1, wherein the canister has an internal pressure between 1 and 3 bar above atmospheric pressure when at room temperature.

* * * * *

UNITED STATES PATENT AND TRADEMARK OFFICE

CERTIFICATE OF CORRECTION

PATENT NO. : 9,056,689 B2
APPLICATION NO. : 13/703332
DATED : June 16, 2015
INVENTOR(S) : Jan Norager Rasmussen et al.

It is certified that error appears in the above-identified patent and that said Letters Patent is hereby corrected as shown below:

On the title page, item (54), and in the specification, column 1, line 1, Title, delete "PROPELLENT" and insert -- PROPELLANT --, therefor.

On the title page, item (57), in column 2, line 2, delete "propellent" and insert -- propellant --, therefor.

On the title page, item (57), in column 2, line 3, delete "propellent" and insert -- propellant --, therefor.

In the specification

In column 13, line 64, delete "piercable" and insert -- pierceable --, therefor.

In column 13, line 66, delete "piercable" and insert -- pierceable --, therefor.

In column 14, line 3, delete "piercable" and insert -- pierceable --, therefor.

In column 14, line 4, delete "piercable" and insert -- pierceable --, therefor.

In column 14, line 6, delete "piercable" and insert -- pierceable --, therefor.

In column 14, line 7, delete "piercable" and insert -- pierceable --, therefor.

In column 14, line 10, delete "piercable" and insert -- pierceable --, therefor.

In column 14, line 14, delete "piercable" and insert -- pierceable --, therefor.

In column 17, line 14, delete "600 C." and insert -- 600° C. --, therefor.

In column 18, line 14, delete "Several" and insert -- several --, therefor.

In column 22, line 59, delete "descruction" and insert -- destruction --, therefor.

In column 24, line 38, delete "piercable" and insert -- pierceable --, therefor.

In column 24, lines 38-39, delete "piercabel" and insert -- pierceable --, therefor.

In column 24, line 40, delete "piercable" and insert -- pierceable --, therefor.

In column 24, line 42, delete "piercable" and insert -- pierceable --, therefor.

In column 24, line 45, after "a" delete "piercable" and insert -- pierceable --, therefor.

In column 24, line 45, after "the" delete "piercable" and insert -- pierceable --, therefor.

Signed and Sealed this
Nineteenth Day of January, 2016

Michelle K. Lee

Michelle K. Lee
*Director of the United States Patent and Trademark Office*

In column 24, line 49, delete “piercable” and insert -- pierceable --, therefor.

In column 24, line 50, delete “piercable” and insert -- pierceable --, therefor.

In column 30, line 10, delete “carbon” and insert -- carbon. --, therefor.

In column 39, line 24, delete “piercable” and insert -- pierceable --, therefor.

In column 39, line 27, delete “piercable” and insert -- pierceable --, therefor.

In column 41, line 19, delete “58’” and insert -- 56” --, therefor.

In column 41, line 20, delete “58”” and insert -- 56” --, therefor.

In column 42, line 27, delete “piercable” and insert -- pierceable --, therefor.

In column 42, line 28, delete “piercable” and insert -- pierceable --, therefor.

In column 44, line 51, delete “thermocromic” and insert -- thermochromic --, therefor.

In column 46, line 14, delete “non distinguishable” and insert -- non-distinguishable --, therefor.

In column 47, line 16, delete “piercable” and insert -- pierceable --, therefor.

In column 47, line 59, delete “piercable” and insert -- pierceable --, therefor.

In column 47, line 61, delete “piercable” and insert -- pierceable --, therefor.

In column 48, line 15, delete “piercable” and insert -- pierceable --, therefor.

In column 48, line 34, delete “piercable” and insert -- pierceable --, therefor.

In column 50, line 65, delete “piercable” and insert -- pierceable --, therefor.

In column 51, line 54, delete “Celcius,” and insert -- Celsius, --, therefor.

In column 52, line 12, delete “Celcius.” and insert -- Celsius. --, therefor.

In column 54, line 13, delete “piercable” and insert -- pierceable --, therefor.

In column 55, line 14, delete “10N” and insert -- 10 N --, therefor.

In column 55, line 15, delete “100N” and insert -- 100 N --, therefor.

In column 57, line 33, delete “0 C,” and insert -- 0° C., --, therefor.

In column 57, line 35, delete “0 C.” and insert -- 0° C. --, therefor.

In column 58, line 33, delete “piercable” and insert -- pierceable --, therefor.

In column 58, line 35, delete “piercable” and insert -- pierceable --, therefor.

In column 58, line 39, delete “piercable” and insert -- pierceable --, therefor.

In column 58, line 40, delete “piercable” and insert -- pierceable --, therefor.

In column 63, line 40, delete “adsoption” and insert -- adsorption --, therefor.

In column 64, line 16, delete “piercable” and insert -- pierceable --, therefor.

In column 64, line 17, delete “piercabel” and insert -- pierceable --, therefor.

In column 64, line 19, delete “piercable” and insert -- pierceable --, therefor.

In column 64, line 21, delete “piercable” and insert -- pierceable --, therefor.